US006168456B1

(12) United States Patent
Saka et al.

(10) Patent No.: US 6,168,456 B1
(45) Date of Patent: Jan. 2, 2001

(54) ELECTRICAL CONNECTION BOX

(75) Inventors: Yuuji Saka; Takahiro Onizuka; Yoshito Oka; Makoto Kobayashi; Nori Inoue; Jun Yamaguchi, all of Yokkaichi (JP)

(73) Assignee: Sumitomo Wiring Systems, Ltd., Yokkaichi (JP)

( * ) Notice: Under 35 U.S.C. 154(b), the term of this patent shall be extended for 0 days.

(21) Appl. No.: 09/307,763

(22) Filed: May 10, 1999

Related U.S. Application Data

(63) Continuation of application No. 08/948,494, filed on Oct. 10, 1997, now Pat. No. 5,934,929, which is a continuation of application No. 08/500,354, filed on Jul. 10, 1995, now abandoned.

(30) Foreign Application Priority Data

| | | |
|---|---|---|
| Jul. 15, 1994 | (JP) | 6-164281 |
| Jul. 21, 1994 | (JP) | 6-169320 |
| Jul. 22, 1994 | (JP) | 6-171315 |
| Jul. 24, 1994 | (JP) | 6-175765 |
| Jul. 27, 1994 | (JP) | 6-175761 |
| Aug. 3, 1994 | (JP) | 6-182331 |
| Aug. 22, 1994 | (JP) | 6-171313 |
| Sep. 2, 1994 | (JP) | 6-209590 |

(51) Int. Cl.[7] ..... H01R 4/24
(52) U.S. Cl. ..... 439/404
(58) Field of Search ..... 439/76.2, 404, 439/405, 403, 949, 942, 733.1, 741

(56) References Cited

U.S. PATENT DOCUMENTS

| | | | |
|---|---|---|---|
| 2,999,962 | 9/1961 | Wahl | 439/942 |
| 4,387,509 | 6/1983 | Dechelette . | |
| 4,592,614 | 6/1986 | Myers, Jr. | 439/404 |

(List continued on next page.)

FOREIGN PATENT DOCUMENTS

| | | |
|---|---|---|
| 3843664 | 7/1989 | (DE) . |
| 0171737 | 2/1986 | (EP) . |
| 2268004 | 6/1992 | (GB) . |

(List continued on next page.)

OTHER PUBLICATIONS

Patent Abstracts of Japan (Europe Pat. Office) No. 05300627, Yazaki Corp, Dec. 1993.*
Japanese Patent Abstract for JP 5–300627.
Kenneth Mason Publications Ltd., England, No. 28018, "Dual–level Printed Circuit Board Edge Connector", published Aug. 1987.

*Primary Examiner*—Neil Abrams
(74) *Attorney, Agent, or Firm*—Greenblum & Bernstein, P.L.C.

(57) ABSTRACT

An electrical connection box includes a casing having an upper casing (10) and a lower casing (11). Terminal holes (19, 20) are formed on the outer wall of the casing. An insulating plate (12), mounted in the casing, has a several of wiring grooves (13) formed on at least one of its opposite faces (12*a*, 12*b*). *Terminal driving portions (*24 and 25), obtained by increasing a width of the wiring grooves (13), are provided at predetermined locations in the wiring grooves (13). Wires (14, 15) having first and second diameters are inserted into and held in the wiring grooves (13). Pressing contact terminals (16, 17) includes a pressing contact portion (16*a*, 17*a*) and an input-output terminal portion (16*b*, 17*b*) formed at its opposite ends, respectively. The pressing contact portions (16*a*, 17*a*) are driven into the terminal driving portions (24, 25) to connect through pressing contact to the wires (14, 15) held in the wiring grooves. The input-output terminal portions (16*b*, 17*b*) project out of each of the terminal holes (19, 20) to connect to an external circuit. The pressing contact portions (FIG. 46) may include notches (117*g*, 117*h*) that bite into the wiring groove as the pressing portions engage the wires and expand outwardly. Small-diameter wires 14 may engage shorter pressing contact terminals 16, while large-diameter wires 15 engage longer pressing contact terminals 17.

2 Claims, 45 Drawing Sheets

U.S. PATENT DOCUMENTS

| | | | | |
|---|---|---|---|---|
| 4,648,673 | * | 3/1987 | Endo et al. | 439/395 |
| 4,684,765 | | 8/1987 | Beck et al. | 439/43 |
| 4,797,112 | | 1/1989 | Weisenburger | 439/942 |
| 4,938,719 | | 7/1990 | Sawai et al. | 439/714 |
| 4,997,388 | | 3/1991 | Dale et al. | 439/110 |
| 5,207,587 | | 5/1993 | Hamill et al. | 439/76.2 |

FOREIGN PATENT DOCUMENTS

| | | |
|---|---|---|
| 60-35911 | 2/1985 | (JP) . |
| 1166419 | 11/1989 | (JP) . |
| 2-88415 | 7/1990 | (JP) . |
| 2136989 | 11/1990 | (JP) . |
| 3120627 | 12/1991 | (JP) . |
| 5-300627 | 11/1993 | (JP) . |
| 6-96820 | 4/1994 | (JP) . |
| 6-44322 | 6/1994 | (JP) . |

* cited by examiner 88a
87
88b 88a
87
88b 88a
87
88b 88a
87
88b

ELECTRICAL CONNECTION BOX

CROSS-REFERENCE TO RELATED APPLICATIONS

This application is a continuation of Application No. 08/948,494, filed Oct. 10, 1997, now U.S. Pat. No. 5,934,929, issued Aug. 10, 1999, which is a continuation of Application No. 08/500,354, filed Jul. 10, 1995, now abandoned, both of which are hereby incorporated by reference in their entireties.

BACKGROUND OF THE INVENTION

The present invention generally relates to an electrical connection box for a motor vehicle and a method of assembling the electrical connection box. More particularly, the present invention relates to an electrical connection box in which an electric circuit including a number of fuses, relays, etc. is disposed in a concentrated manner so as to perform reasonable branch joint of wiring harnesses and an internal circuit is constituted by wires and pressing contact terminals such that not only wiring can be performed easily and positively but the electrical connection box as a whole is structurally simplified and made compact.

In a known electrical connection box of this kind in which it is possible to easily cope with design chances of an internal circuit a portion of a bus bar obtained by blanking an electrically conductive metal plate is formed by a wire and a pressing contact terminal which is connected to the wire through pressing contact. In case a portion of the internal circuit is formed by the wire and the pressing contact terminal, the pressing contact terminal is preliminarily attached to an upper casing or a lower casing of the electrical connection box and/or an insulating plate provided between the upper and lower casings and the wire is press fitted into the pressing contact terminal so as to be connected to the pressing contact terminal through pressing contact as disclosed in Japanese Utility Model Laid-Open Publication Nos. 3-120627 and 1-166419 and Japanese Patent Laid-Open Publication No. 6-96820.

In case a circuit formed by the wires and the pressure welding terminals and a circuit formed by bus bars is employed as an internal circuit for the electrical connection box as disclosed in Japanese Utility Model Laid-Open Publication No. 1-166419, a high-current electrically conductive member is required to be provided at a power source circuit connected to a battery. Meanwhile, at a load circuit connected to the power source circuit by branch joint, a low-current electrically conductive member may be provided and design changes are made frequently. Therefore, as shown in FIG. 1, bus bars 1 are used for the power source circuit, while wires 2 and pressing contact terminals 3 are used for the load circuit such that the bus bar 1 and the wire 2 are connected to each other by a fuse 4.

In case the wires and the pressing contact terminals are used as the internal circuit for the electrical connection box, the wires are required to be laid inside the upper and lower casings. However, since the pressing contact terminals are driven into the upper and lower casings in advance, the pressing contact terminals prevents the wires from being laid in the upper and lower casings easily. Furthermore, there is also such a problem that since each of the upper and lower casings has a peripheral wall, a wiring head interferes with the peripheral wall so as to restrain wiring space. In order to solve these problems, a wiring die 5 shown in FIGS. 2A and 2B has been used. The wiring die 5 is formed with a groove 6 conforming to a wiring pattern of a wire 2 and the wire 2 is inserted into the groove 6 while being fed from a wire feeder 7 by a pairs of head rollers 8. At this time, since the wire 2 has rigidity to some extent and show a strong tendency to wind, depth of the groove 6 is set so as to be twice or more as large as diameter of the wire 2 such that the wire 2 is held in the groove 6 positively without moving away from the bottom of the groove 6.

After the wire 2 has been placed in the groove 6 of the wiring die 5 as described above, the upper or lower casing or the insulating plate, to which the pressing contact terminals are preliminarily attached, is set on the wiring die 5 such that the pressing contact terminals are brought into contact with the wire 2. Subsequently, by projecting push pins from surface of the wiring die 5, the upper or lower casing or the insulating plate, to which the wire 2 and the pressing contact terminals are attached, is pushed out of the wiring die 5.

If a portion of the internal circuit of the electrical connection box is formed by the wires and the pressing contact terminals, the wiring die is required so as to lay the wires in a predetermined pattern as described above. Thus, a number of wiring dies should be prepared for different wiring patterns. Meanwhile, a transfer step in which the wires placed in the grooves of the wiring die are connected, through pressing contact, to the pressing contact terminals attached to the upper or lower casing or the insulating plate is required to be performed, thereby resulting in rises of production cost of the electrical connection box and increase of the number of operational steps.

Meanwhile, in case the pressing contact terminals are attached to the upper or lower casing and the wires are connected to the pressing contact terminals simultaneously with laying the wires on an inner face of the upper or lower casing, such a problem arise that since an outer face of each of the upper and lower casings are made uneven by connector portions, it is impossible to lay and connect the wires to the pressing contact terminals stably. Furthermore, since pressing contact of the wires with the pressing contact terminals attached preliminarily to the upper or lower casing and assembly of the upper and lower casings are performed concurrently, it is disadvantageously impossible to check whether or not the wires are held in pressing contact with the pressing contact terminals properly.

Moreover, if the power source circuit disposed at the upstream side of the internal circuit of the electrical connection box is formed by the bus bars and the load circuit disposed at the downstream side of the internal circuit of the electrical connection box is formed by the wires and the pressing contact terminals as shown in FIG. 1, configuration of the internal circuit becomes complicated and the number of operational steps increases due to difference between structure for attaching the bus bars to the electrical connection box and structure for attaching the wires and the pressing contact terminals to the electrical connection box. In addition, since not only the wiring die but a die for forming the bus bars is required to be provided, production cost of the electrical connection box is raised greatly. Moreover, when the electrical connection box is used in common with other types of motor vehicles, such a drawback may be incurred frequently in which design changes of the power source circuit are required to be made frequently but cannot be made.

This drawback can be eliminated when the power source circuit is also formed by the wires and the pressing contact terminals. However, diameter of the wires for the power source circuit is large, while diameter of the wires for the load circuit is small or medium-sized. Therefore, if these wires having different diameters are laid on an identical plane, area required for laying the wires is increased, so that space for installing the electrical connection box increases and thus, such a case may happen that the electrical connection box cannot be installed at some locations.

Meanwhile, when the wires are laid on the upper or lower casing or the insulating plate, the wires should not overlap each other, thus resulting in such a problem that the wiring pattern is forced to be made complicated. In this case, bending of the wires is limited by the strength, etc. As the number of the wires to be laid increases, this problem becomes more conspicuous.

Generally, as shown in FIG. 3, the pressing contact terminal 3 is formed by blanking an electrically conductive metal plate having a uniform thickness and is formed, at its upper and lower portions, with a terminal portion 3*c* and a pressing contact portion 3*b*, respectively. The terminal portion 3*c* has a shape of an elongated tab, while the pressing contact portion 3*b* has a downwardly opening slot 3*a*. By fitting into the slot 3*a* the wire 2 laid in a casing C, the pressing contact portion 3*b* is thrust into an insulating coating 2*a* of the wire 2 so as to be connected to a conductor 2*b* of the wire 2. Through a relay terminal R having female terminals at its opposite ends, the terminal portion 3*c* is electrically connected to a platelike terminal T of a relay, a fuse or the like.

Since the terminal portion 3*c* of the known pressing contact terminal 3 acts as a male terminal having a shape of a tab, the terminal portion 3*c* cannot be directly connected to the terminal T having a shape of a tab, e.g., a relay, a fuse, etc., so that the relay terminal R should be used between the terminal portion 3*c* and the terminal T and thus, a height h of the electrical connection box in the direction of connection between the terminal portion 3*c*and the terminal R is required to be increased. As a result, the electrical connection box is made larger in size.

Furthermore, since the relay terminal R is required to be provided, the number of components for the electrical connection box increases and assembly of the electrical connection box is troublesome.

In order to solve the above mentioned problems of the known electrical connection box of FIG. 3, a pressing contact terminal 3' shown in FIG. 4 may be considered. The pressing contact terminal 3' has a base plate portion 3*d* extending from the pressing contact portion 3*b* and a pair of curled portions 3*e* are, respectively, curved laterally inwardly towards each other from opposite sides of the base plate portion 3*d* so as to form a pair of female terminal portions 3*c*'. Thus, if the male terminal T having a shape of a tab is inserted in between the curled portions 3*e* and the base plate portion 3*d*, the relay terminal R of FIG. 3 can be eliminated.

However, since the circuit connected to the terminal T of a relay, a fuse, etc. is usually a power source circuit through which high current flows, a large-diameter wire should be employed for forming the power source circuit in place of the bus bar. Therefore, the pressing contact terminal to which the large-diameter wire is connected through pressing contact should have large thickness for securing high strength and have large area of its contact with the wire. However, unless the curled portions 3*e* have a small thickness of, for example, 4 mm or less, it is difficult to form the curled portions 3*e*. Hence, in the case of the pressing contact terminal for the large-diameter wire, the female terminal portion 3*c*' cannot be formed by providing the curled portions 3*e* and thus, the relay terminal R is forced to be used.

SUMMARY OF THE INVENTION

Accordingly, a first object of the present invention is to eliminate the above mentioned various problems of conventional electrical connection boxes in which a load circuit of an internal circuit is formed by wires and pressing contact terminals, while a power source circuit of the internal circuit is formed by bus bars.

A second object of the present invention is to provide an electrical connection box which not only eliminates a hitherto necessary wiring die in case an internal circuit of the electrical connection box is formed by wires and pressing contact terminals but stably enables easy and positive pressing contact of the pressing contact terminals with the wires and in which not only it is possible to check whether or not the pressing contact terminals are held in pressing contact with the wires properly but the internal circuit including a power circuit can be wholly formed by the wires and the pressing contact terminals.

A third object of the present invention is to provide an electrical connection box in which the pressing contact terminal can be directly connected to a male terminal such as a relay and a fuse without using a relay terminal.

A fourth object of the present invention is to provide an electrical connection box in which branch joint of wiring harnesses is performed rationally and the pressing contact terminals can be connected, through pressing contact, to large-diameter wires forming the power source circuit of the internal circuit.

In order to accomplish these objects of the present invention, an electrical connection box embodying the present invention comprises: a casing which is constituted by an upper casing and a lower casing and has a plurality of terminal holes formed on its outer wall; an insulating plate which is mounted in the casing and has a plurality of wiring grooves formed on at least one of its opposite faces such that a plurality of terminal driving portions each obtained by increasing a width of each of the wiring grooves are provided at predetermined locations of each of the wiring grooves; a plurality of wires which are inserted into the wiring grooves so as to be held in the wiring grooves, respectively; a plurality of pressing contact terminals each of which includes a pressing contact portion and an input-output terminal portion formed at its opposite ends, respectively; the pressing contact portion being driven into each of the terminal driving portions so as to be connected, through pressing contact, to each of the wires (14, 15) held in the wiring grooves (13), while the input-output terminal portion is projected out of each of the terminal holes so as to be connected to an external circuit.

Meanwhile, from the opposite faces of the insulating plate, the pressing contact terminals are connected, through pressing contact, to the wires laid in the wiring grooves of the insulating plate such that the insulating plate, the wires and the pressing contact terminals are provided integrally; wherein the insulating plate, the wires and the pressing contact terminals provided integrally are accommodated in the casing such that the input-output terminal portions of the pressing contact terminals are projected out of the upper casing and the lower casing.

In the electrical connection box of the above described arrangement, the wires are initially inserted into the wiring grooves of the insulating plate directly so as to be laid in the wiring grooves and then, the pressing contact terminals are brought into pressing contact with the wires so as to be mounted on the insulating plate. In this state, since the wires and the pressing contact terminals are fixed to the insulating plate but the insulating plate is not yet assembled with the casing, it is possible to check whether or not the pressing contact terminals are brought into pressing contact with the wires properly.

Meanwhile, pressing contact of the pressing contact terminal with the wire and mounting of the pressing contact terminal on the insulating plate can be performed by a single step. Furthermore, since the insulating plate is of substantially flat shape having few uneven portions and the number of the uneven portions is smaller than that of the upper and lower casings, the wires and the pressing contact terminals can be mounted on the insulating plate stably.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 5:
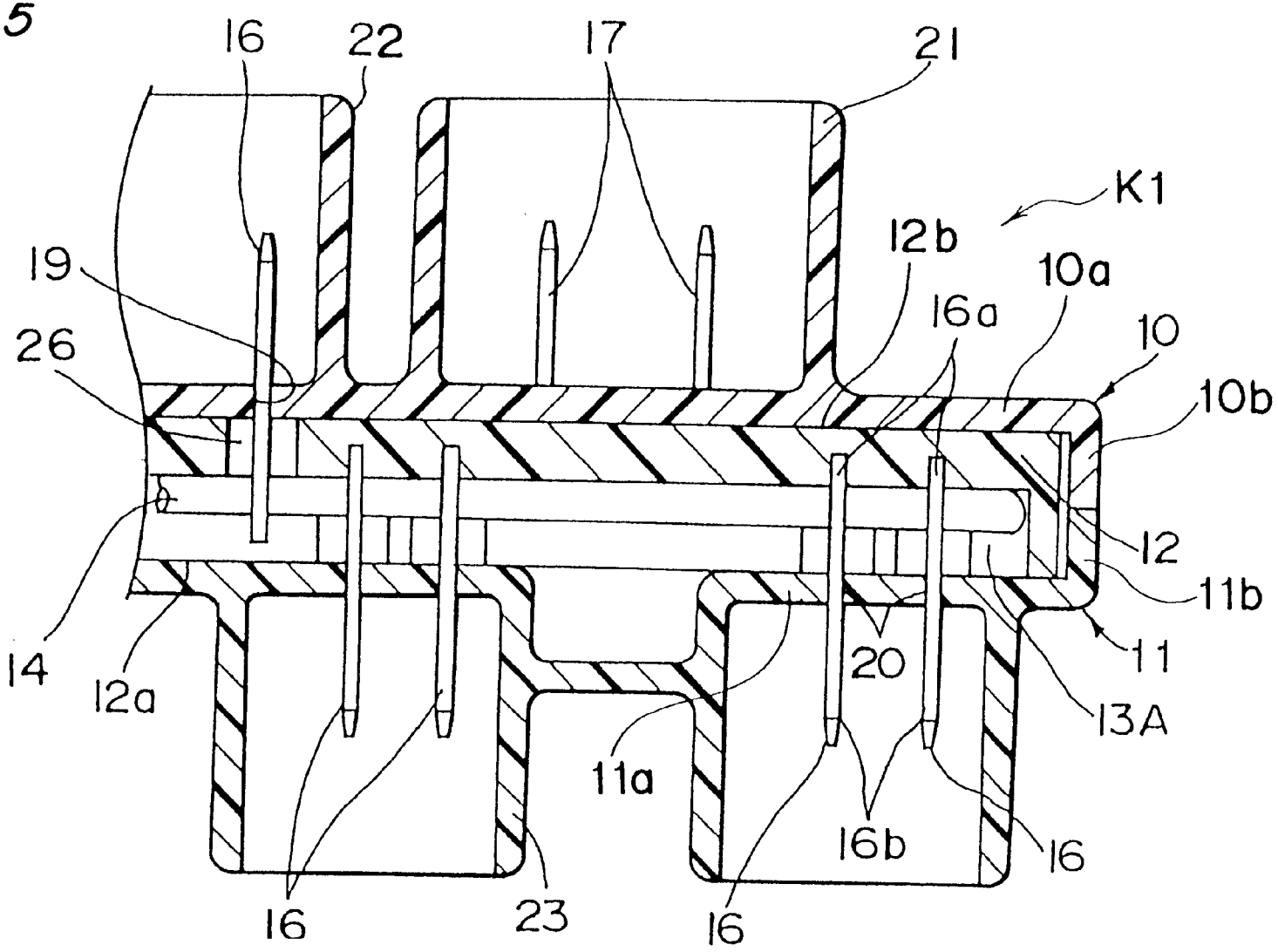
FIGS. 5 and 6 are fragmentary vertical sectional views of an electrical connection box according to a first embodiment of the present invention.
Figure 6:
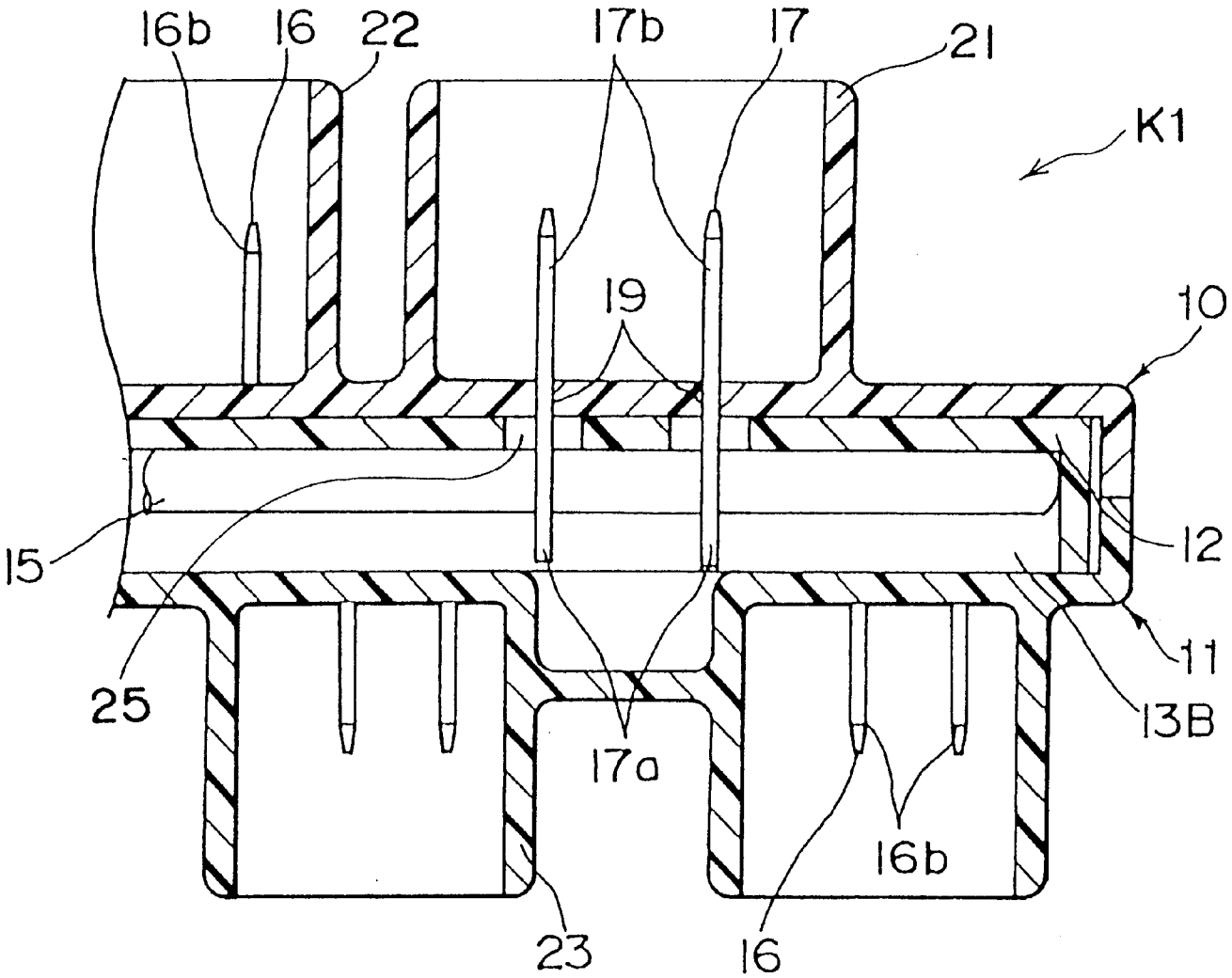
Figure 7:
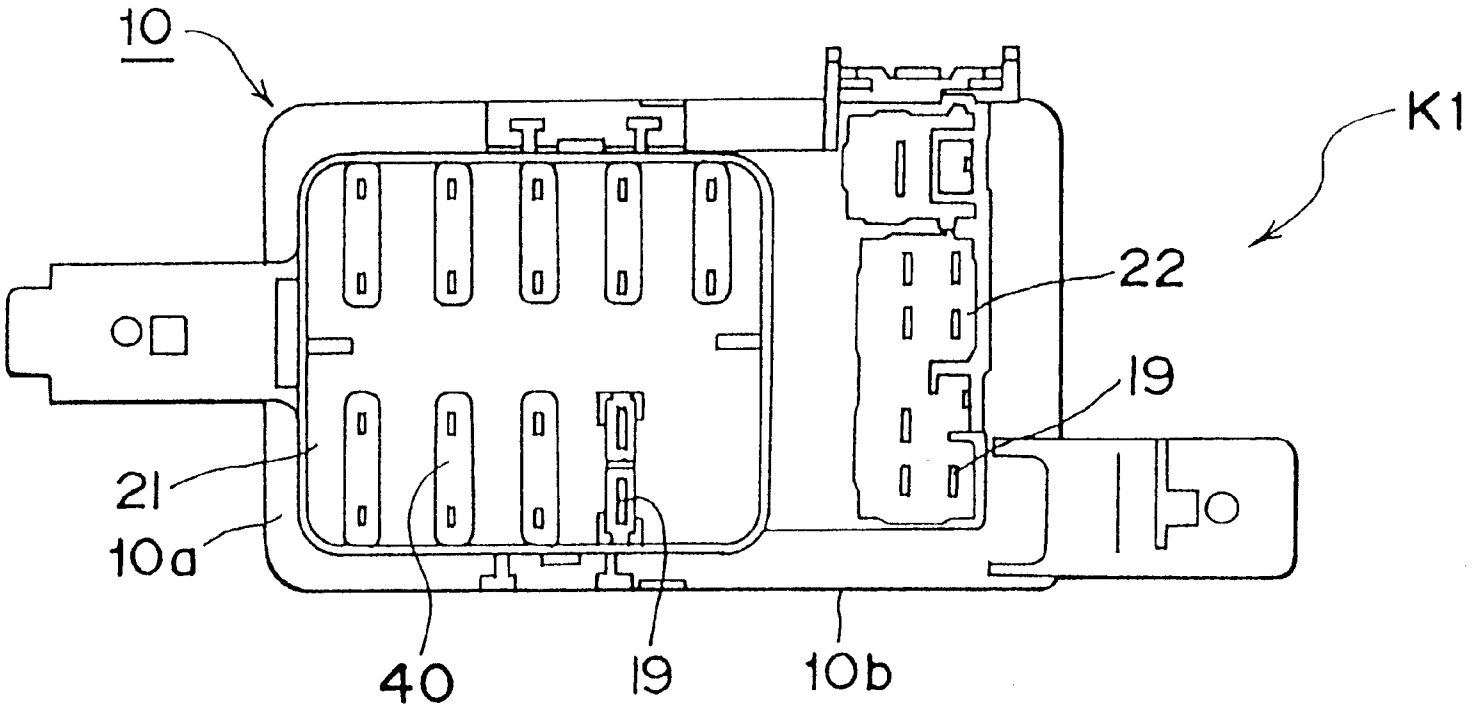
FIG. 7 is a top plan view of an upper casing of the electrical connection box of FIG. 5.

Referring now to the drawings, there is shown in FIGS. 5 to 11, an electrical connection box K1 according to a first embodiment of the present invention. As shown in FIGS. 5 and 6, the electrical connection box K1 includes an upper casing 10, a lower casing 11 and a thick insulating plate 12 gripped in the upper and lower casings 10 and 11. A plurality of wiring grooves 13A and 13B for receiving and holding wires are formed on a lower face 12*a* of the insulating plate 12 in accordance with a wiring pattern. Small-diameter wires 14 and large-diameter wires 15 are directly inserted into the wiring grooves 13A and 13B, respectively by a wire feeder (not shown).

A pressing contact portion 16*a* disposed at one end of a pressing contact terminal 16 is press fitted into the wire 14 held in the wiring groove 13A so as to be connected to the wire 14 through pressing contact. Similarly, a pressing contact portion 17*a* disposed at one end of a pressing contact terminal 17 is press fitted into the wire 15 held in the wiring groove 13B so as to be connected to the wire 15 through pressing contact. An input-output terminal portion 16*b* disposed at the other end of the pressing contact terminal 16 and an input-output terminal portion 17*b* disposed at the other end of the pressing contact terminal 17 are projected out of terminal holes 19 and 20 which are, respectively, formed on outer walls of the upper and lower casings 10 and 11.

More specifically, the upper and lower casings 10 and 11 and the insulating plate 12 are molded in insulating resin such as polypropylene. A lower end portion of the upper casing 10 opens downwardly. Meanwhile, a fuse fitting portion 21 and a connector portion 22 for receiving a connector (not shown) are formed on an upper wall 10*a* of the upper casing 10. Inside outer peripheral walls of the fuse fitting portion 21 and the connector portion 22, the terminal holes 19 are formed on the upper wall 10*a*.

On the other hand, an upper end portion of the lower casing 11 opens upwardly. Meanwhile, connector portions 23 for receiving connectors protrude from a lower wall 11*a* of the lower casing 11. Inside outer peripheral walls of the connector portions 23, the terminal holes 20 are formed on the lower wall 11*a*. When the upper and lower casings 10 and 11 have been assembled with each other, a lower end face of an outer peripheral wall 10*b* of the upper casing 10 and an upper end face of an outer peripheral wall 11*b* of the lower casing 11 are brought into contact with each other such that the upper and lower casings 10 and 11 form a casing for the electrical connection box K1.

Figure 9:
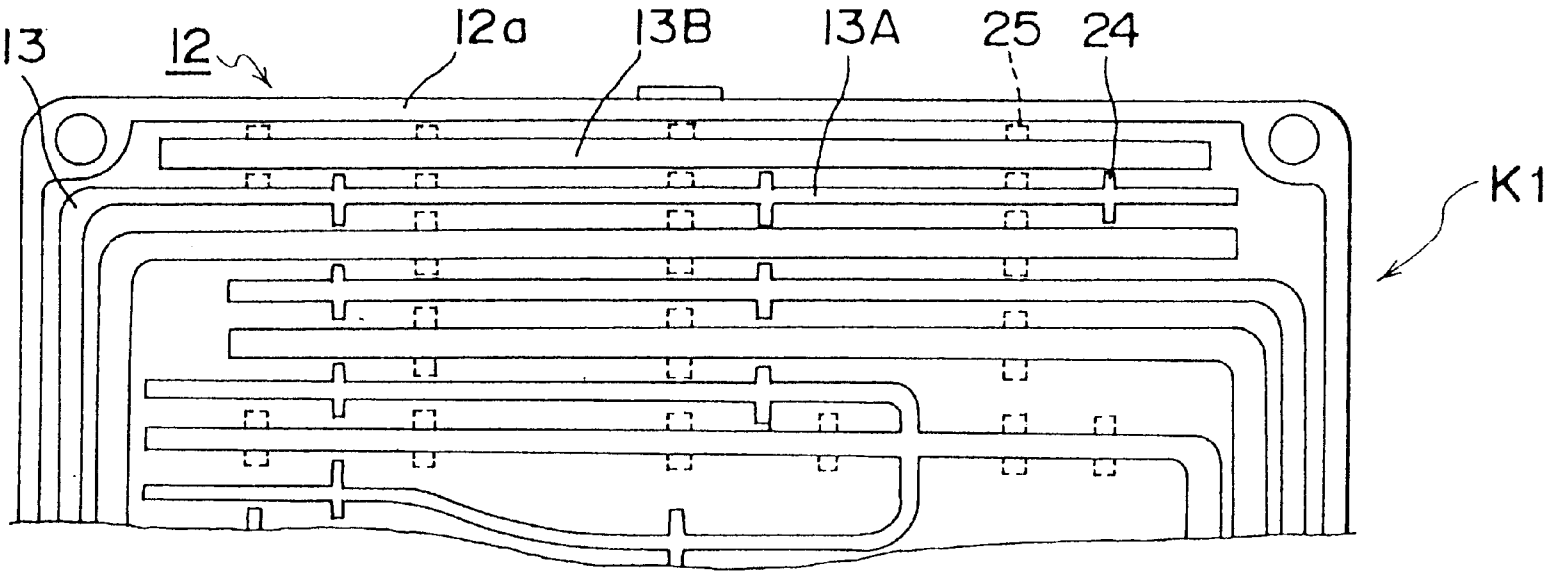
FIG. 9 is a bottom plan view of an insulating plate of the electrical connection box of FIG. 5.
Figure 10:
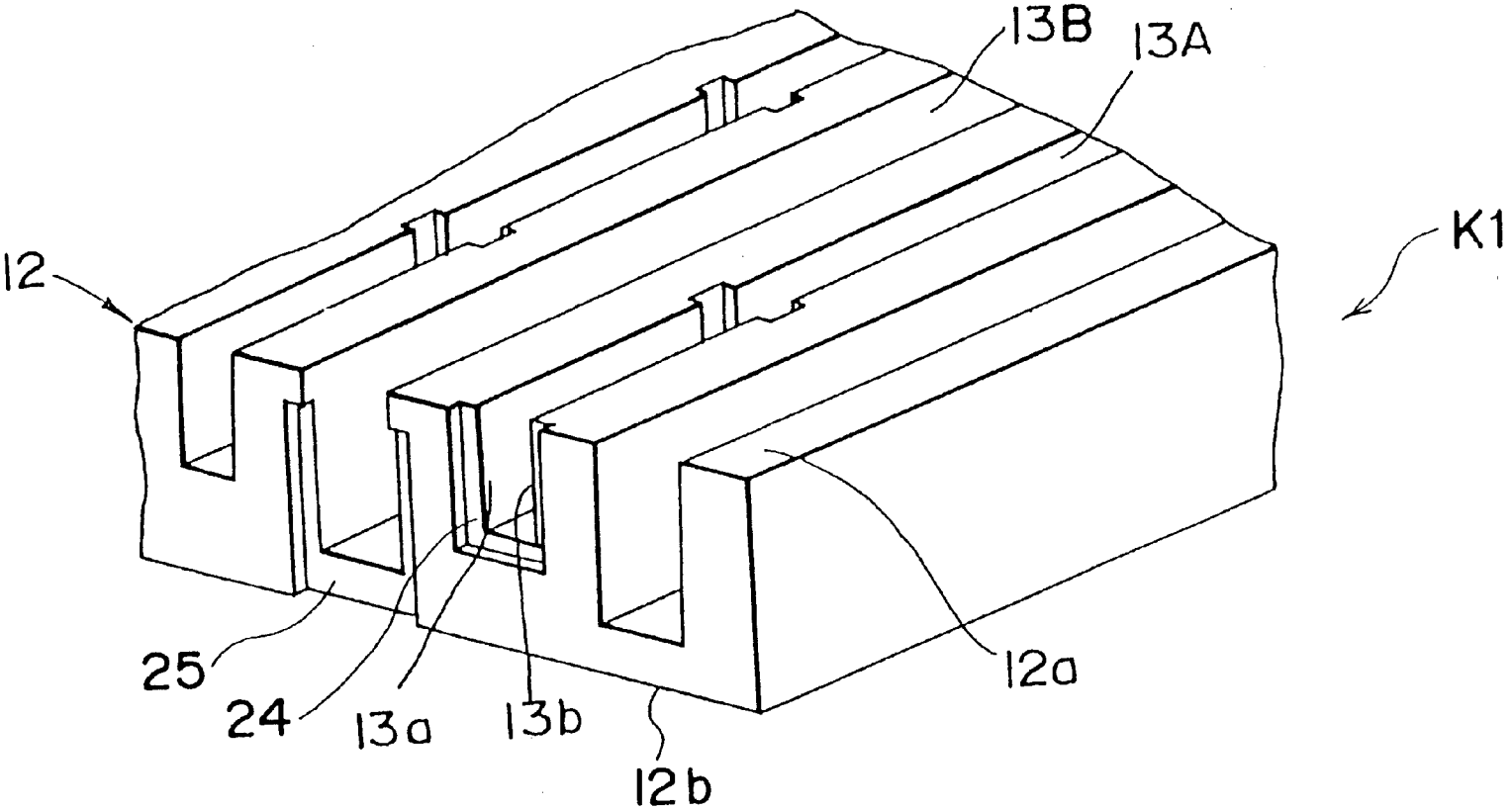
FIG. 10 is a fragmentary perspective view of the insulating plate of FIG. 9.
Figure 11:
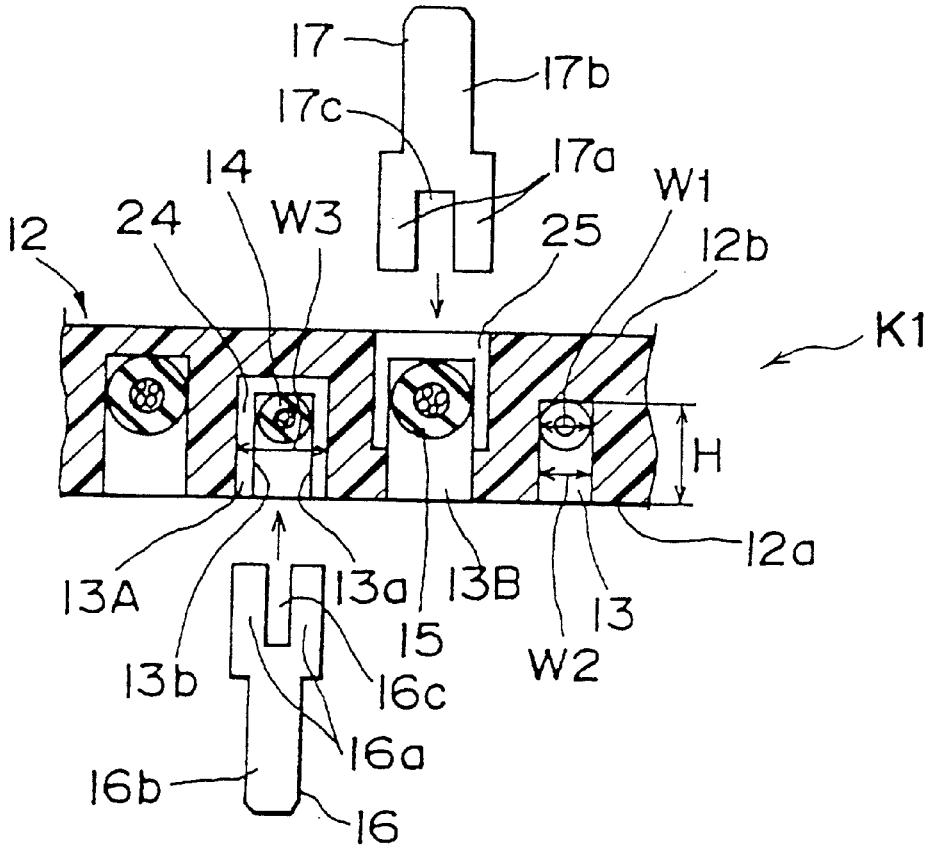
FIG. 11 is a sectional view showing insertion of wires and pressing contact terminals into the insulating plate of FIG. 9.

As shown in FIG. 5, the insulating plate 12 is molded into such a shape as to be closely fitted into a space defined inside the upper and lower casings 10 and 11 at the time the upper and lower casings 10 and 11 have been assembled with each other. In this embodiment, the insulating plate 12 is formed into a shape of a flat plate having a substantially uniform thickness. As shown in FIGS. 9 to 11, the wiring grooves 13A and 13B are formed on the lower face 12*a* of the insulating plate 12, which is brought into contact with an inner surface of the lower wall 11*a* of the lower casing 11. The wiring grooves 13A are provided for receiving the small-diameter wires 14, while the wiring grooves 14A are provided for receiving the large-diameter wires 15. The wiring grooves 13A and 13B extend rectilinearly and are partially bent so as to have a substantially U-shaped cross section.

In this embodiment, assuming that W1 denotes a diameter of each of the wires 14 and 15 and W2 denotes a width of each of the wiring grooves 13A and 13B, the diameter W1 and the width W2 are set so as to satisfy a relation of ($W1 \geqq W2$). Furthermore, supposing that H denotes a depth of each of the wiring grooves 13A and 13B, the depth H and the diameter W1 are set so as to satisfy a relation of ($H \geqq W1$). The depth H of each of the wiring grooves 13A and 13B is not restricted to the above mentioned relation but may assume any value larger than the diameter W1 of each of the wires 14 and 15. However, it is preferable that the depth H is not less than twice the diameter W1 of each of the wires 14 and 15.

Meanwhile, at portions of the wiring groove 13A where the small-diameter wire 14 inserted into the wiring groove 13A is connected to the pressing contact terminal 16, opposed side faces of 13*a* and 13*b* of the wiring groove 13A are recessed so as to have a width W3 such that a downwardly opening terminal driving portion 24 for driving the pressing contact terminal 16 thereinto is formed. On the other hand, terminal driving portions 25 for driving the pressing contact terminals 17 thereinto, respectively are formed on the wiring grooves 13B so as to open to an upper face 12*b* of the insulating plate 12. The terminal driving portion 25 does not extend to the lower face 12*a* of the insulating plate 12 but is formed from the upper face 12*b* to an intermediate depth of the wiring groove 13B.

As shown in FIG. 5, terminal driving portions 26 for driving the pressing contact terminals 16 thereinto, respectively are further formed on the wiring grooves 13A so as to open to the upper face 12*b* of the insulating plate 12. The terminal driving portions 24 confront the terminal holes 20 of the lower casing 11. The terminal driving portions 25 confront the terminal holes 19 of the fuse fitting portion 21 of the upper casing 10, while the terminal driving portions 26 confront the terminal holes 19 of the connector portion 22 of the upper casing 10.

As shown in FIG. 11, each of the pressing contact terminal 16 brought into pressing contact with the small-diameter wire 14 and the pressing contact terminal 17 brought into pressing contact with the large-diameter wire 15 is of a shape similar to that of known pressing contact terminals and is formed by an electrically conductive metal plate. The male input-output terminal portions 16*b* and 17*b* are formed at one end of each of the pressing contact terminals 16 and 17, while the pressing contact portions 16*a* and 17*a* are formed at the other end of each of the pressing contact terminals 16 and 17. The pressing contact portion 16*a* is formed, at its central portion, with a slot 16*c* so as to be bifurcated. Likewise, the pressing contact portion 17*a* is formed, at its central portion, with a slot 17*c* so as to be bifurcated. The pressing contact portion 16*a* of the pressing contact terminal 16 is of such a dimension as to be press fitted into the terminal driving portions 24 and 26, while the pressing contact portion 17*a* of the pressing contact terminal 17 is of such a dimension as to be press fitted into the terminal driving portion 25.

Hereinafter, a method of assembling the electrical connection box K1 of the above described arrangement is described. Initially, the insulating plate 12 is turned upside down such that the lower face 12*a* of the insulating plate 12 is oriented upwardly. Then, the small-diameter wire 14 is fed by the wire feeder so as to be directly inserted into the wiring groove 13A. At this time, the wire 14 is press fitted into the wiring groove 13A which has the depth H twice or more the diameter W1 of the wire 14 and the width W2 slightly smaller than the diameter W1 of the wire 14. Therefore, even if the wire 14 inserted into the wiring groove 13A has a tendency to wind, the wire 14 can be positively held in the wiring groove 13A without moving away from the bottom of the wiring groove 13A.

Subsequently, the large-diameter wire 15 is fed by the wire feeder so as to be directly inserted into the wiring groove 13B. In the same manner as the wire 14, the wire 15 is press fitted into the groove 13B which has the depth H twice or more the diameter W1 of the wire 15 and the width W2 slightly smaller than the diameter W1 of the wire 15. Therefore, the wire 15 can also be held in the groove 13B without moving away from the bottom of the wiring groove 13B. Meanwhile, since the insulating plate 12 has a shape of a flat plate free from projections, the wires 14 and 15 can be stably inserted into the wiring grooves 13A and 13B, respectively.

After the wires 14 and 15 have been laid in the wiring grooves 13A and 13B, respectively, the pressing contact terminals 16 are press fitted into the terminal driving portions 24 initially. At this time, opposite side edges of the slot 16*c* of the pressing contact portion 16*a* of the pressing contact terminal 16 grip the wire 14 therebetween so as to be thrust into an insulating coating of the wire 14. By this pressing contact step; the pressing contact terminal 16 not only is electrically connected to a conductor of the wire 14 but is secured to the insulating plate 12 such that the input-output terminal portion 16*b* of the pressing contact terminal 16 projects out of the lower face 12*a* of the insulating plate 12.

Thereafter, the insulating plate 12 is over-turned such that the upper face 12*b* of the insulating plate 12 is oriented upwardly. Then, the pressing contact terminal 16 are press fitted into the terminal driving portions 26. Thus, the pressing contact terminal 14 not only is electrically. connected to the conductor of the wire 14 but is secured to the insulating plate 12 such that the input-output terminal portion 16*b* of the pressing contact terminal 16 projects out of the upper face 12*b* of the insulating plate 12.

Similarly, the pressing contact terminals 17 are press fitted into the terminal driving portions 25. Thus, the pressing contact terminal 17 not only is electrically connected to a conductor of the wire 15 but is secured to the insulating plate 12 such that the input-output terminal 17*b* of the pressing contact terminal 17 projects out of the upper face 12*b* of the insulating plate 12.

In a state where the pressing contact terminals 16 and 17 have been, respectively, connected, through pressing contact, to the wires 14 and 15 laid in the wiring grooves 13A and 13B of the insulating plate 12 as described above, the upper and lower casings 10 and 11 are not mounted on the upper and lower faces 12*b* and 12*a* of the insulating plate 12 and thus, it is possible to check whether or not the pressing contact terminals 16 and 17 are, respectively, held in pressing contact with the wires 14 and 15 properly.

Then, the upper and lower casing 10 and 11 are assembled with each other so as to grip the insulating plate 12 therebetween. At this time, not only the input-output terminal portions 17*b* of the pressing contact terminals 17 connected to the large-diameter wires 15 are projected out of the terminal holes 19 of the fuse fitting portion 21 of the upper casing 10 but the input-output terminal portions 16*b* of the pressing contact terminals 16 connected to the small-diameter wires 14 are projected out of the terminal holes 19 of the connector portion 22 of the upper casing 10. Meanwhile, the input-output terminal portions 16*b* of the pressing contact terminals 16 connected to the small-diameter wires 14 are projected out of the terminal holes 20 of the connector portions 23 of the lower casing 11.

An internal circuit of the electrical connection box K1 assembled as described above is constituted by only the small-diameter wires 14, the large-diameter wires 15 and the pressing contact terminals 16 and 17 connected to the wires 14 and 15, respectively. Namely, a power source circuit of the internal circuit is constituted by the large-diameter wires 15 and the pressing contact terminals 17 connected to the wires 15 through pressing contact such that the input-output terminal portions 17*b* of the pressing contact terminals 17 are connected to fuses 40 (FIG. 7) attached to the fuse fitting portion 21. On the other hand, a load circuit of the internal circuit is constituted by the small-diameter wires 14 and the pressing contact terminals 16 connected to the wires 14 through pressing contact such that the input-output terminal portions 16*b* of the pressing contact terminals 16 are connected to the connectors fitted into the connector portions 22 and 23.

Since the internal circuit of the electrical connection box is constituted by only the wires and the pressing contact terminals without using bus bars, it is possible to cope with design changes of the internal circuit easily.

As shown at least in FIGS. 5, 6, 11, 26, 27, 33, 34, 45 and 46, the pressing contact terminals 16 are shorter than the pressing contact terminals 17. The small-diameter wires 14 engage the shorter pressing contact terminals 16, while the large-diameter wires 15 engage the longer pressing contact terminals 17.

In the first embodiment, both the wiring grooves 13A for receiving the small-diameter wires 14 and the wiring grooves 13B for receiving the large-diameter wires 15 are mixedly formed on the lower face 12*a* of the insulating plate 12. However, the present invention is not restricted to this arrangement. For example, the narrower wiring grooves 13A for receiving the small-diameter wires 14 and the wider wiring grooves 13B for receiving the large-diameter wires 15 may be, respectively, formed on the opposite faces of the insulating plate 12 by disposing the wiring grooves 13A and 13B on the lower face 12*a* and the upper face 12*b* of the insulating plate 12, respectively.

In the first embodiment, since the wiring grooves 13B for the large-diameter wires 15 and the wiring grooves 13A for the small-diameter wires 14 are mixedly formed on an identical plane, large area is occupied by the wiring grooves 13A and 13B, so that the electrical connection box K1 is made large in size and thus, the electrical connection box K1 can be employed in case large space for installing the electrical connection box K1 is available.

Figure 12:
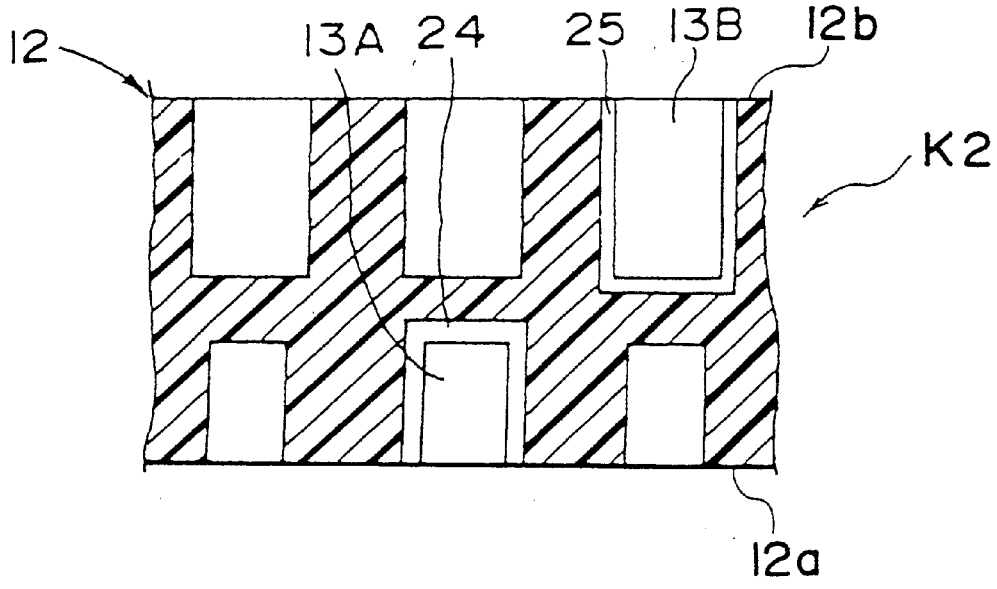
FIG. 12 is a fragmentary sectional view of an insulating plate of an electrical connection box according to a second embodiment.

However, if only narrow space is available for installing the electrical connection box K1, an electrical connection box K2 according to a second embodiment of the present invention may be employed as shown in FIG. 12. In the electrical connection box K2, the insulating plate 12 is made thicker than that of the first embodiment and the wiring grooves 13A and 13B are, respectively, formed on the lower face 12*a* and the upper face 12*b* of the insulating plate 12 so as to be aligned with each other. As a result, area occupied by the wiring grooves 13A and 13B is reduced greatly.

Meanwhile, in the first embodiment, the width W2 of each of the wiring grooves 13A and 13B formed on the insulating plate 12 and the diameter W1 of each of the wires 14 and 15 are set so as to satisfy the relation of ($W1 \geqq W2$). If the width W2 of each of the wiring grooves 13A and 13B is so set as to be not more than the diameter W1 of each of the wires 14 and 15 as described above, such an advantage can be achieved that the wires 14 and 15 can be, respectively, held in the wiring grooves 13A and 13B without moving away from the bottoms of the wiring grooves 13A and 13B after the wires 14 and 15 have been, respectively, inserted into the wiring grooves 13A and 13B. However, if the width W2 of each of the wiring grooves 13A and 13B is not more than the diameter W1 of each of the wires 14 and 15 through an overall length of the wiring grooves 13A and 13B, the wires 14 and 15 should be depressed into the wiring grooves 13A and 13B with a hand at the time the wires 14 and 15 are directly inserted into the wiring grooves 13A and 13B by the wire feeder. As a result, such a problem as drop of speed for inserting the wires 14 and 15 into the wiring grooves 13A and 13B arises.

Figure 13:
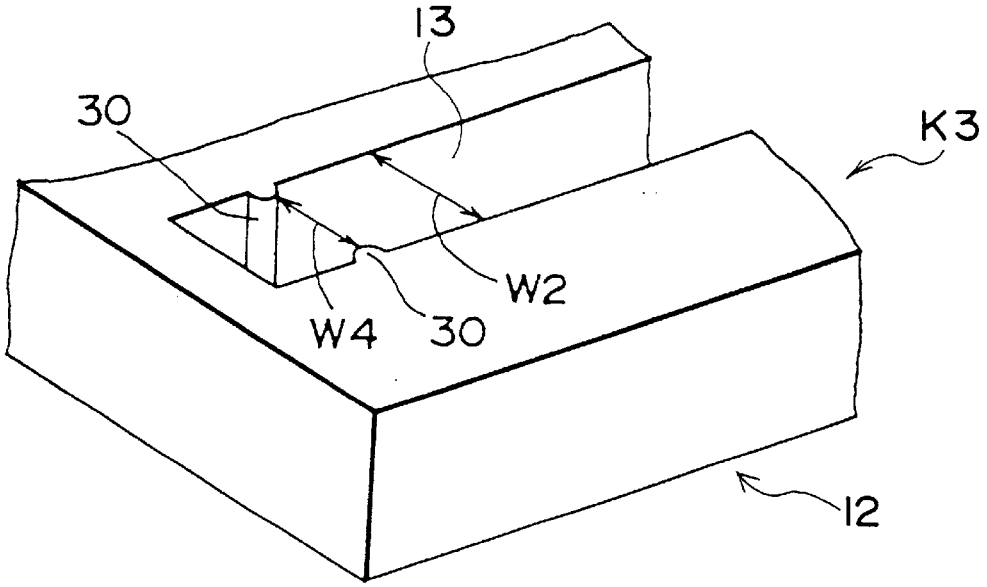
FIG. 13 is a fragmentary perspective view of an insulating plate of an electrical connection box according to a third embodiment of the present invention.
Figure 14:
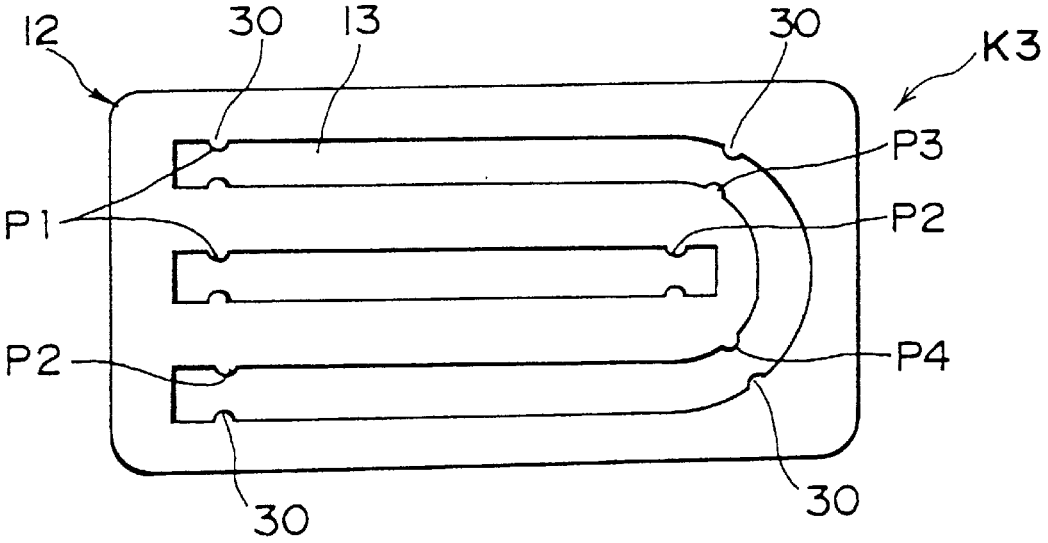
FIG. 14 is a schematic top plan view of the insulting plate of FIG. 13.

In order to solve this problem, an electrical connection box K3 according to a third embodiment of the present invention may be employed as shown in FIG. 13 and 14. As shown in FIG. 13, in order to facilitate insertion of the wires 14 and 15 into the wiring grooves 13, the width W2 of the wiring grooves 13 is set larger than the diameter W1 of each of the wires 14 and 15, i.e., $W1<W2$ to such a degree that not only the wires 14 and 15 can be smoothly inserted into the wiring grooves 13 without being depressed with a hand but each of the inserted wires 14 and 15 is brought into, at a point, contact with the opposed side faces of each of the wiring grooves 13. Furthermore, at each of predetermined longitudinal locations of each of the wiring grooves 13, a pair of ribs 30 are formed on the opposed side faces of each of the wiring grooves 13 so as to confront each other. A width W4 between the ribs 30 is so set as to satisfy a relation of ($W1 \geqq W4$), namely, $W2>W1 \geqq W4$.

As shown in FIG. 14, the ribs 30 are provided at least opposite ends P1 and P2 of one wiring groove 13 for receiving one wire. Meanwhile, in case the wiring groove 13 has a curved portion, the ribs 30 are further provided at opposite distal end points P3 and P4 of the curved portion. At the portions of the wiring groove 13, where the ribs 30 are provided, the wire 14 or 15 is depressed with a hand as required so as to come into contact with the bottom of the wiring groove 13. When the wire 14 or 15 has been depressed deeply into the wiring groove 13 at the opposite ends P1 and P2 of the wiring groove 13 and the opposite distal end points P3 and P4 of the curved portion of the wiring groove 13, intermediate portions of the wire 14 or 15 corresponding to those of the wiring groove 13 between neighboring ones of the points P1 to P4 are also carried deeply into the wiring groove 13. As a result, the ribs 30 provided at the predetermined locations of the wiring groove 13 can prevent the wire 14 or 15 from moving away from the bottom of the wiring groove 13.

Figures 15A, 15B, 15C, 15D:
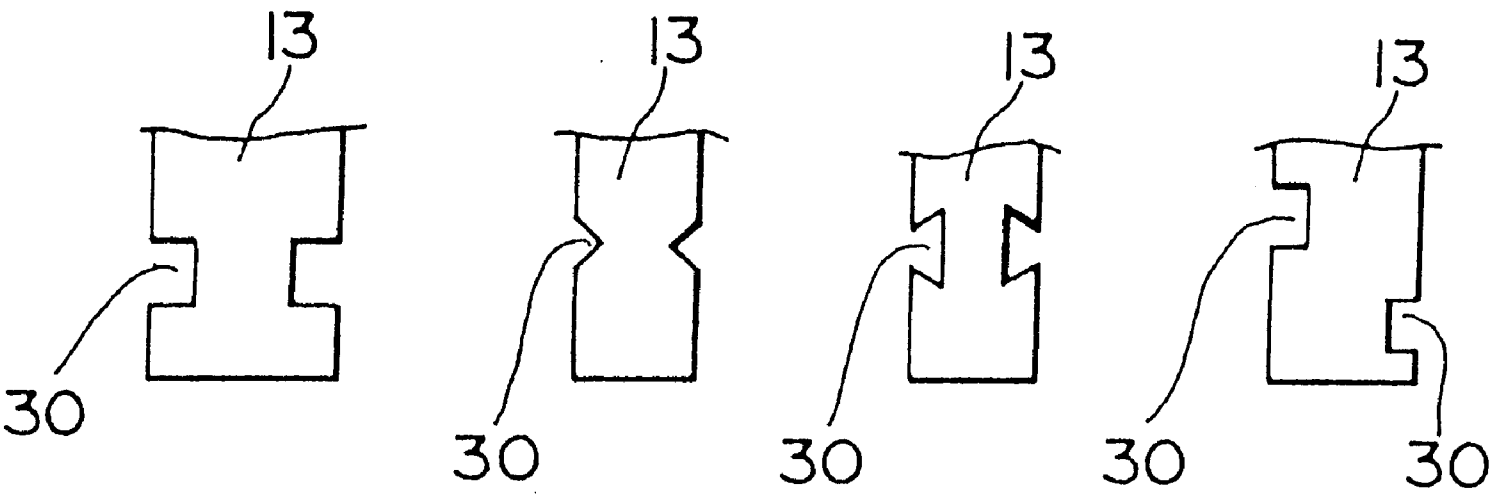
FIGS. 15A, 15B, 15C and 15D are fragmentary schematic views of insulating plates which are first, second, third and fourth modifications of the insulating plate of FIG. 13, respectively.

The rib 30 is formed into a semicircular cross-sectional shape in FIG. 13 but may have an arbitrary cross-sectional shape as shown in FIGS. 15A to 15D. In FIG. 15A, the rib 30 has a rectangular cross-sectional shape. In FIG. 15B, the rib 30 has a triangular cross-sectional shape. In FIG. 15C, the rib 30 has an inversely trapezoidal cross-sectional shape. Meanwhile, as shown in FIG. 15D, the ribs 30 may be staggered without confronting each other. In FIG. 15D, if the wiring groove 13 is formed zigzag at the ribs 30, the wire can be held in the wiring groove 13 further positively by the zigzag portions of the wiring groove 13 and thus, such a phenomenon that the wire is likely to move away from the bottom of a rectilinear portion of the wiring groove 13 can be prevented. Degree of zigzag of the wiring groove 13 is so set as to exert no influence upon insertion of the wire into the wiring groove 13 by the wire feeder.

Figure 16:
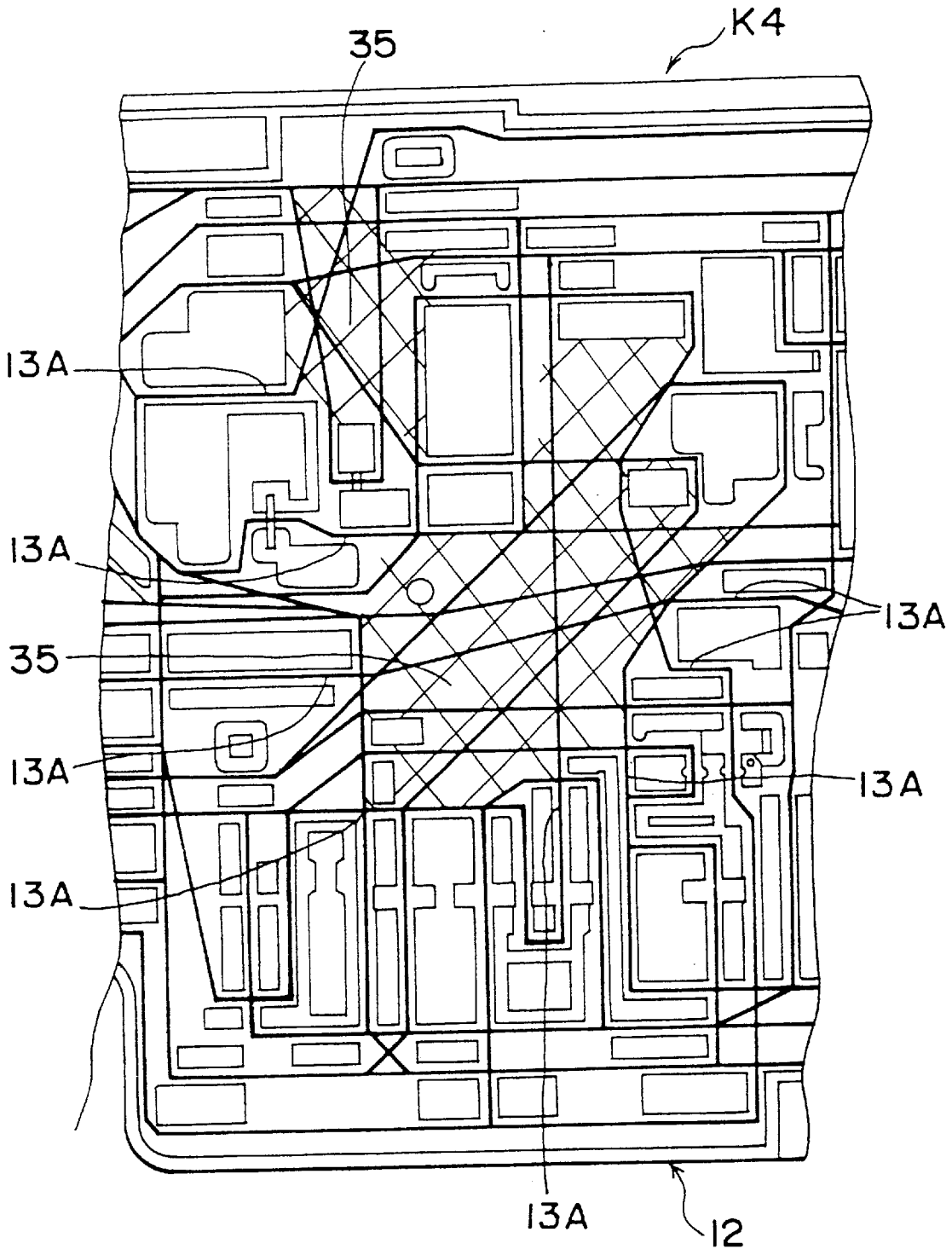
FIG. 16 is a fragmentary top plan view of an insulating plate of an electrical connection box according to a fourth embodiment of the present invention.

FIG. 16 shows the insulating plate 12 of an electrical connection box K4 according to a fourth embodiment of the present invention. In the electrical connection box K4, the insulating plate 12 has troughlike wiring grooves 35 shown by crossed hatching in FIG. 16. The troughlike wiring groove 35 is communicated with a number of the wiring grooves 13A in many directions and the wires 14 inserted into the wiring grooves 13A are laid in the troughlike wiring groove 35 in many directions so as to extend rectilinearly or obliquely in the troughlike wiring groove 60. Since a depth of the troughlike wiring groove 35 is twice or more the diameter of the wire 14, two or more wires 14 piled on each other may insersct with each other. If the troughlike wiring grooves 35 are provided in the insulating plate 12 as described above, the wires 14 can be laid in the troughlike wiring groove 35 in an arbitrary direction and thus, degree of freedom of wiring can be raised. In addition, when the wires 14 are inserted into the wiring grooves 13A by the wire feeder, a single wire 14 can be laid in the wiring grooves 13A continuously from a front end of the wire 14 to a rear end of the wire 14 by the troughlike wiring groove 35.

Figure 17:
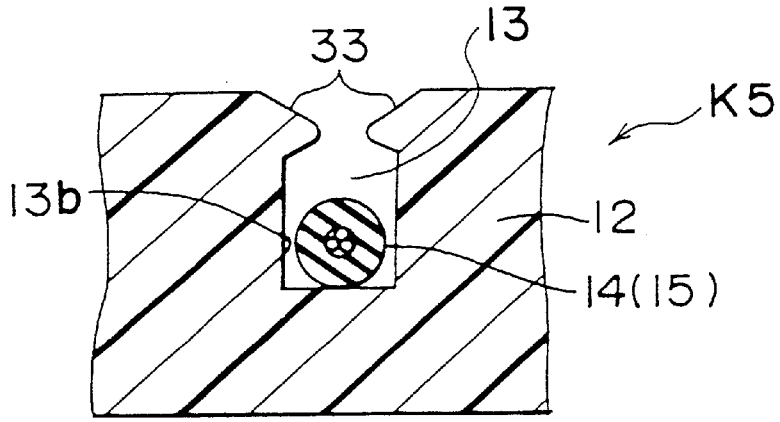
FIG. 17 is a fragmentary sectional view of an insulating plate of an electrical connection box according to a fifth embodiment of the present invention.
Figure 30:
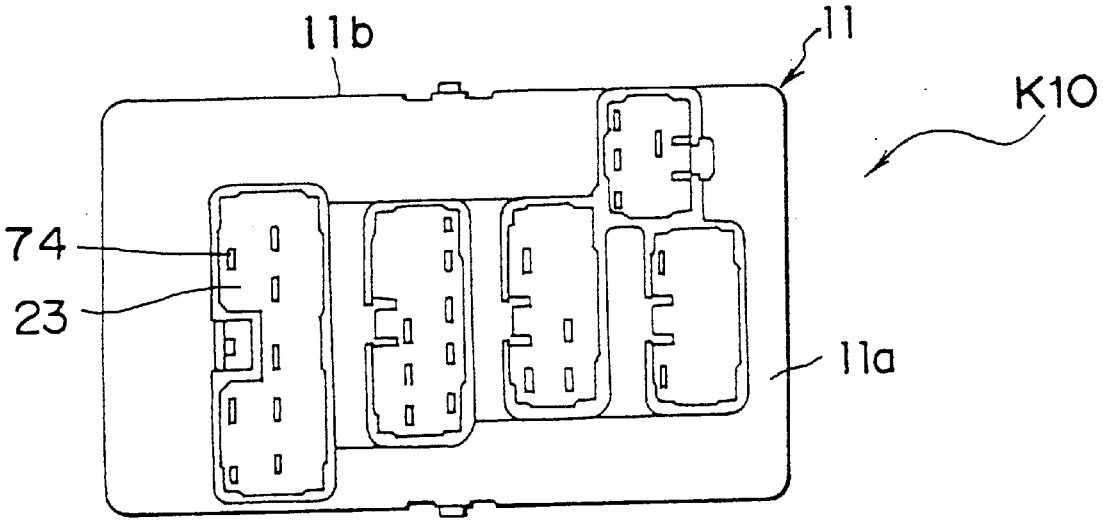
FIG. 30 is a bottom plan view of a lower casing of the electrical connection box of FIG. 27.

FIG. 17 shows the insulating plate 12 of an electrical connection box K5 according to a fifth embodiment of the present invention. In the electrical connection box K5, the width W2 of the wiring groove 13 is set so as to be not less than the diameter W1 of each of the wires 14 and 15 in the same manner as the third and fourth embodiments. After the wire 14 or 15 has been inserted into the wiring groove 13, a plurality of pairs of projections 33 are formed along the wiring groove 13 so as to protrude inwardly from the opposed side faces of a mouth of the wiring groove 13 at locations of the wiring groove 13 similar to those of the ribs 30. Namely, after the wire 14 or 15 has been inserted into the wiring groove 13, opposed edges of the mouth of the wiring groove 13 are crimped laterally inwardly into the projections 33 so as to reduce width of the mouth of the wiring groove 13 such that the projections 33 prevent the wire 14 or 15 from being detached from the wiring groove 13.

Figure 18:
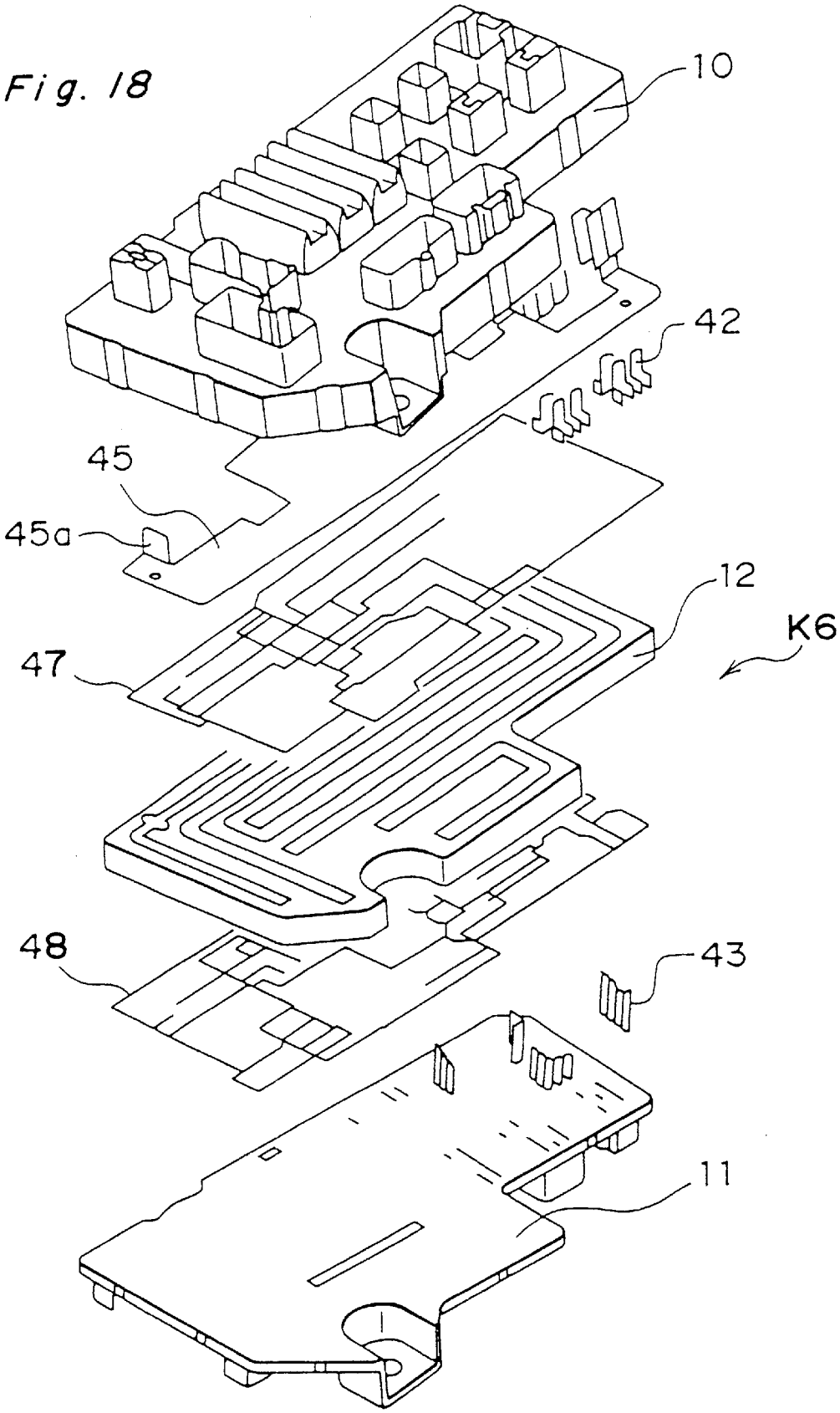
FIG. 18 is an exploded perspective view of an electrical connection box according to a sixth embodiment of the present invention.
Figure 19:
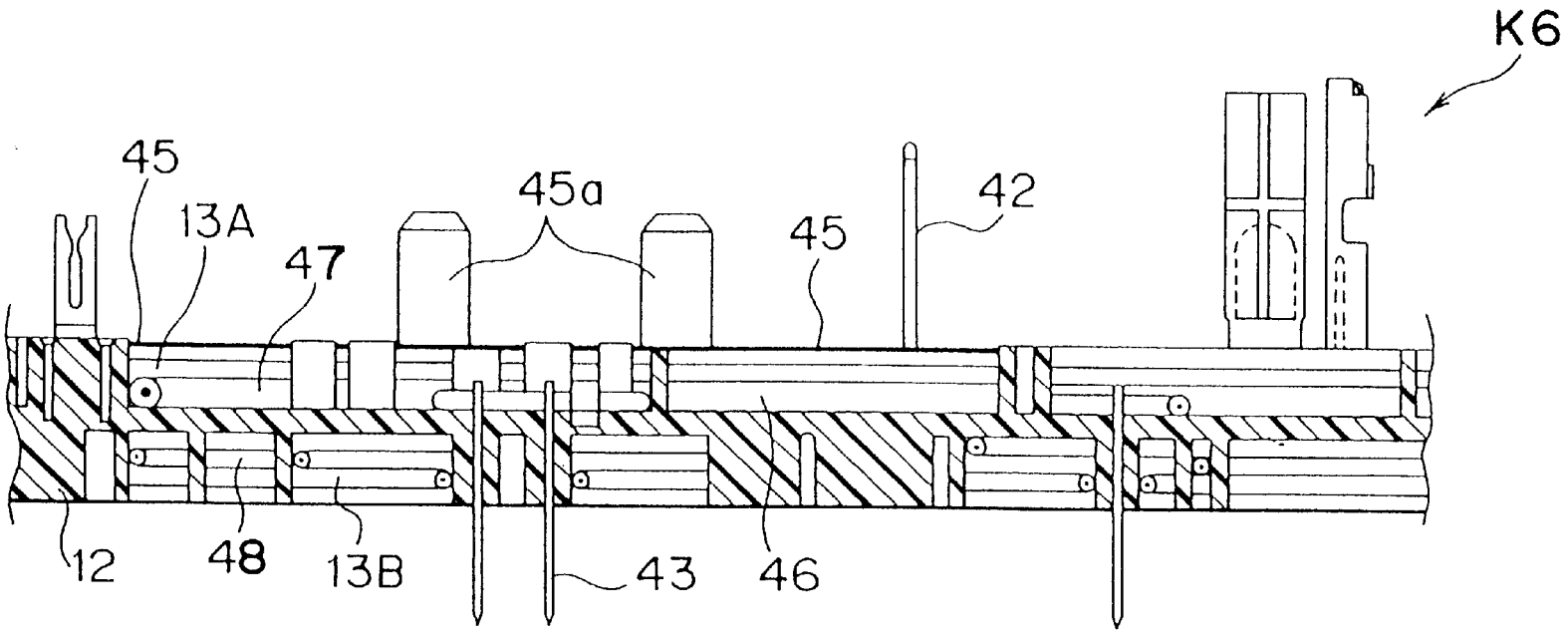
FIG. 19 is a fragmentary sectional view of the electrical connection box of FIG. 18.

FIGS. 18 and 19 show an electrical connection box K6 according to a sixth embodiment of the present invention. In the electrical connection box K6, the wiring grooves 13A and 13B are formed on the upper face 12*b* and the lower face 12*a* of the insulating plate 12, respectively and wires 47 and 48 are, respectively, laid in the wiring grooves 13A and 13B. Pressing contact terminals 42 and 43 are driven into the wires 47 and 48 downwardly and upwardly, respectively so as to be brought into pressing contact with the wires 47 and 48 such that an internal circuit constituted by the wires 47 and 48 and the pressing contact terminals 42 and 43 is formed preliminarily. Furthermore, a bus bar 45 formed by blanking an electrically conductive metal plate is provided between the upper face of the insulating plate 12 and the upper casing 10 and has a male terminal 45*a* formed by a tab bent upwardly. The terminal 45*a* is projected out of a terminal hole provided on the upper casing 10 so as to be connected to an electrical device mounted on the upper casing 10.

As shown in FIG. 19, a recess 46 for receiving the bus bar 45 is formed at a portion of the upper face of the insulating plate 12, which accommodates the bus bar 45. The wire 47 is laid on the bottom face of the recess 46 and the bus bar 45 is provided above the wire 47 so as to be flush with the upper face of the insulating plate 12.

The wires and the pressing contact terminals are integrally mounted on the insulating plate 12. Thus, in case the bus bar 45 is used as another internal circuit, the bus bar 45 is merely required to be fitted into the recess 46 of the insulating plate 12. Therefore, since the bus bar 45 is also mounted on the insulating plate 12 in advance, an internal circuit in which the internal circuit constituted by the wires and the pressing contact terminals is combined with the internal circuit constituted by the bus bar can be easily mounted in the casing of the electrical connection box K6.

Figure 20:
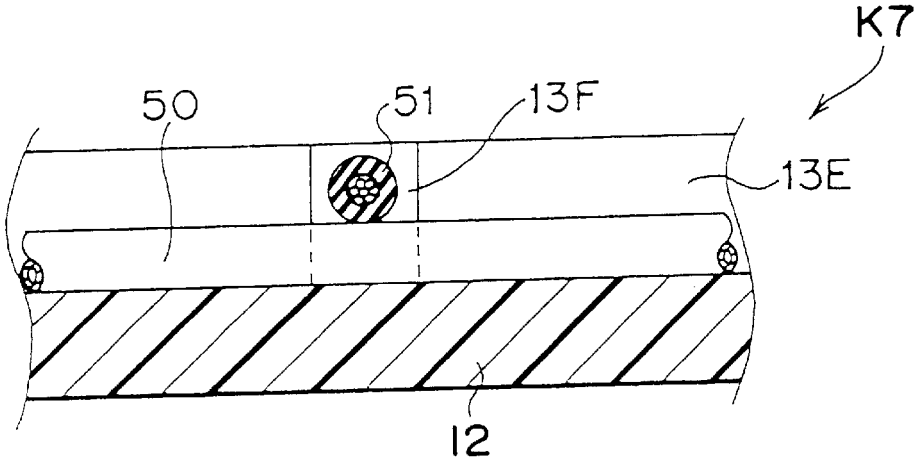
FIG. 20 is a fragmentary sectional view of an insulating plate of an electrical connection box according to a seventh embodiment of the present invention.

FIG. 20 shows the insulating plate 12 of an electrical connection box K7 according to a seventh embodiment of the present invention. In the electrical connection box K7, the insulating plate 12 has wiring grooves 13E and 13F for receiving wires 50 and 51, respectively. A depth of the wiring groove 13E is twice or more a diameter of the wire 50 and a depth of the wiring groove 13F is also twice or more a diameter of the wire 51. Furthermore, the wiring grooves 13E and 13F are formed so as to intersect with each other. Therefore, the wire 50 inserted into the wiring groove 13E and the wire 51 inserted into the wiring groove 13F can be laid so as to intersect with each other. Meanwhile, the two wires 50 or 51 can be laid in a single wiring groove 13E or 13F so as to be piled on each other.

Figure 21:
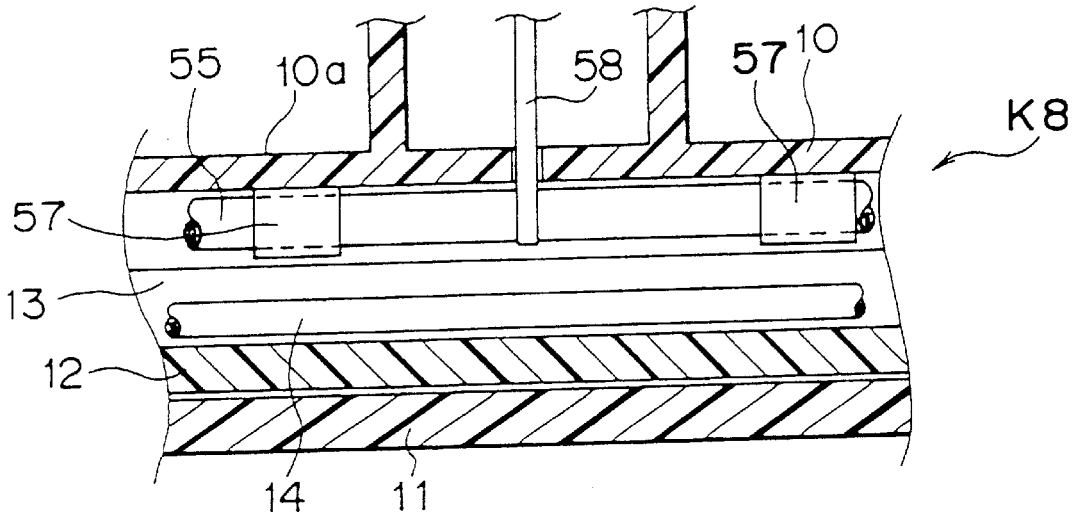
FIG. 21 is a fragmentary sectional view of an electrical connection box according to an eighth embodiment of the present invention.

FIG. 21 shows an electrical connection box K8 according to an eighth embodiment of the present invention. In the electrical connection box K8, a wire 55 is laid on an inner surface of the upper wall 10*a* of the upper casing 10 along guides 57, projecting from the inner surface of the upper wall 10*a* so as to be brought into pressing contact with pressing contact terminals 58 driven preliminarily into the upper casing 10. Alternatively, after the wire 55 has been laid on the upper casing 10, the pressing contact terminals 58 may be driven into the upper casing 10 so as to be brought into pressing contact with the wire 55. In the electrical connection box K8, since not only the wires 14 and 15 are laid in the insulating plate 12 gripped between the upper and lower casings 10 and 11 such that an internal circuit is formed through pressing contact of the wires with the pressing contact terminals but the wire 55 is laid in the upper casing 10 so as to form another internal circuit together with the pressing contact terminals 58, the internal circuits can be accommodated in the electrical connection box K8 at high density.

Hereinafter, effects gained by the above mentioned electrical connection boxes K1 to K5 are described. Since the internal circuit of the electrical connection box is constituted by only the wires and the pressing contact terminals connected to the wires and an external circuit without using bus bars, it is possible to easily cope with design changes of the internal circuit. Meanwhile, since bus bars are not used in the internal circuit as described above, the internal circuit does not have hybrid structure in contrast with those of prior art electrical connection boxes, so that the electrical connection box can be simplified structurally and efficiency for assembling the electrical connection box can be raised.

Meanwhile, since the deep wiring groove is formed on the insulating plate, the wire can be directly inserted into the wiring groove by the wire feeder so as to be laid in the wiring groove and thus, a hitherto necessary wiring die becomes unnecessary. Furthermore, an operation for bringing the pressing contact terminal into pressing contact with the wire laid on the insulating plate and an operation for attaching the pressing contact terminal to the insulating plate are performed by one step. On the contrary, it has been conventionally necessary to perform a step of fixing the pressing contact terminal to the insulating plate or the casing, a step of laying the wire in the wiring die and a step of transferring the wire from the wiring die so as to bring the wire into pressing contact with the pressing contact terminal. Therefore, in contrast with prior art, the number of operational steps can be reduced greatly. Moreover, since the wire is laid on the insulating plate having no uneven portion or few uneven portions and the pressing contact terminal is brought into pressing contact with the wire, these operations can be performed stably.

Meanwhile, since the pressing contact terminals can be connected to the wires laid in the wiring grooves of the insulating plate from opposite upper and lower sides of the insulating plate and the upper and lower casings are assembled with each other so as to grip therebetween the insulating plate on which the pressing contact terminals have been mounted, the electrical connection box can be assembled easily at quite high density.

Furthermore, if both the large-diameter wire and the small-diameter wire are laid in the wiring grooves of the insulating plate and are brought into pressing contact with the pressing contact terminals, the large-diameter wire can be laid at one portion of the electrical connection box, which requires the power source circuit for high current, while the small-diameter wire can be laid at the other portion of the electrical connection box, which requires the load circuit for low current. Therefore, the internal circuit of electrical connection box of the present invention does not need to employ a conventional hybrid structure in which by using bus bars for the power source circuit for high current, the bus bars and the wires are provided mixedly. As a result, even if design changes of the power source circuit, the design changes can be easily coped with by merely changing wiring of the large-diameter wire, thereby resulting in increase of degrees of freedom. Moreover, if the internal circuit of the electrical connection box is constituted by only the wires and the pressing contact terminals, internal construction of the electrical connection box is simplified and mounting steps of the electric circuit are restricted to a single step of connecting the pressing contact terminal to the wire, thereby resulting in large reduction of the number of the mounting steps of the electric circuit.

In addition, if depth of the wiring groove is made large, the wire can be directly inserted into the wiring groove from the wire feeder and it is possible to prevent the wire from moving away from the bottom of the wiring groove. Since the input-output terminal portions of the pressing contact terminals can be projected from the upper and lower casings, the terminal fitting portions for receiving the external terminals can be provided on the upper and lower faces of the electrical connection box and thus, the electrical connection box can be made compact. If the width of the wiring groove is made larger than the diameter of the wire, the wire can be smoothly inserted into the wiring groove. Therefore, since it is possible to eliminate operation for manually depressing the wire into the wiring groove, thereby resulting in rise of productivity.

Figure 22:
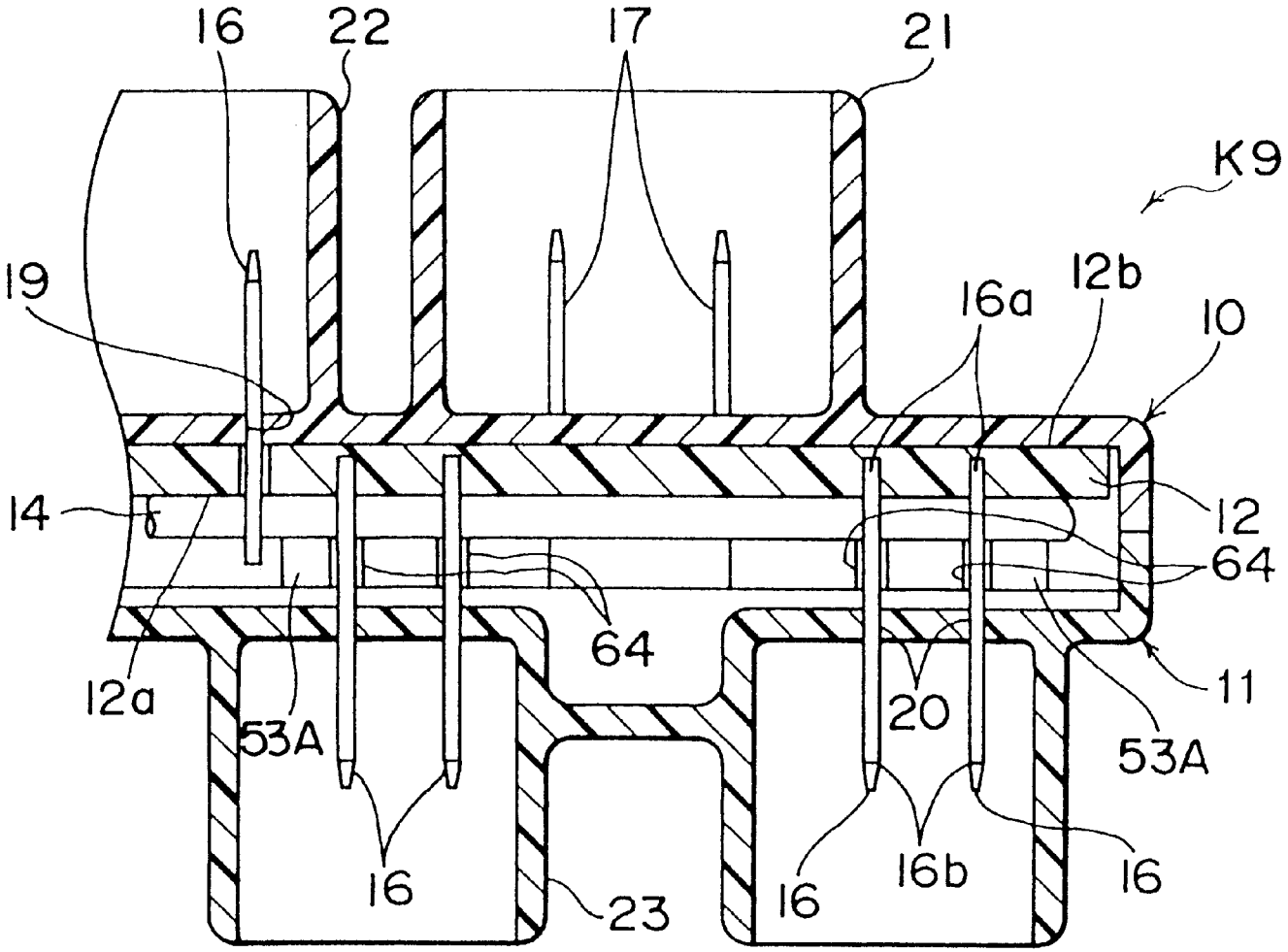
FIGS. 22 and 23 are fragmentary vertical sectional views of an electrical connection box according to a ninth embodiment of the present invention.
Figure 23:
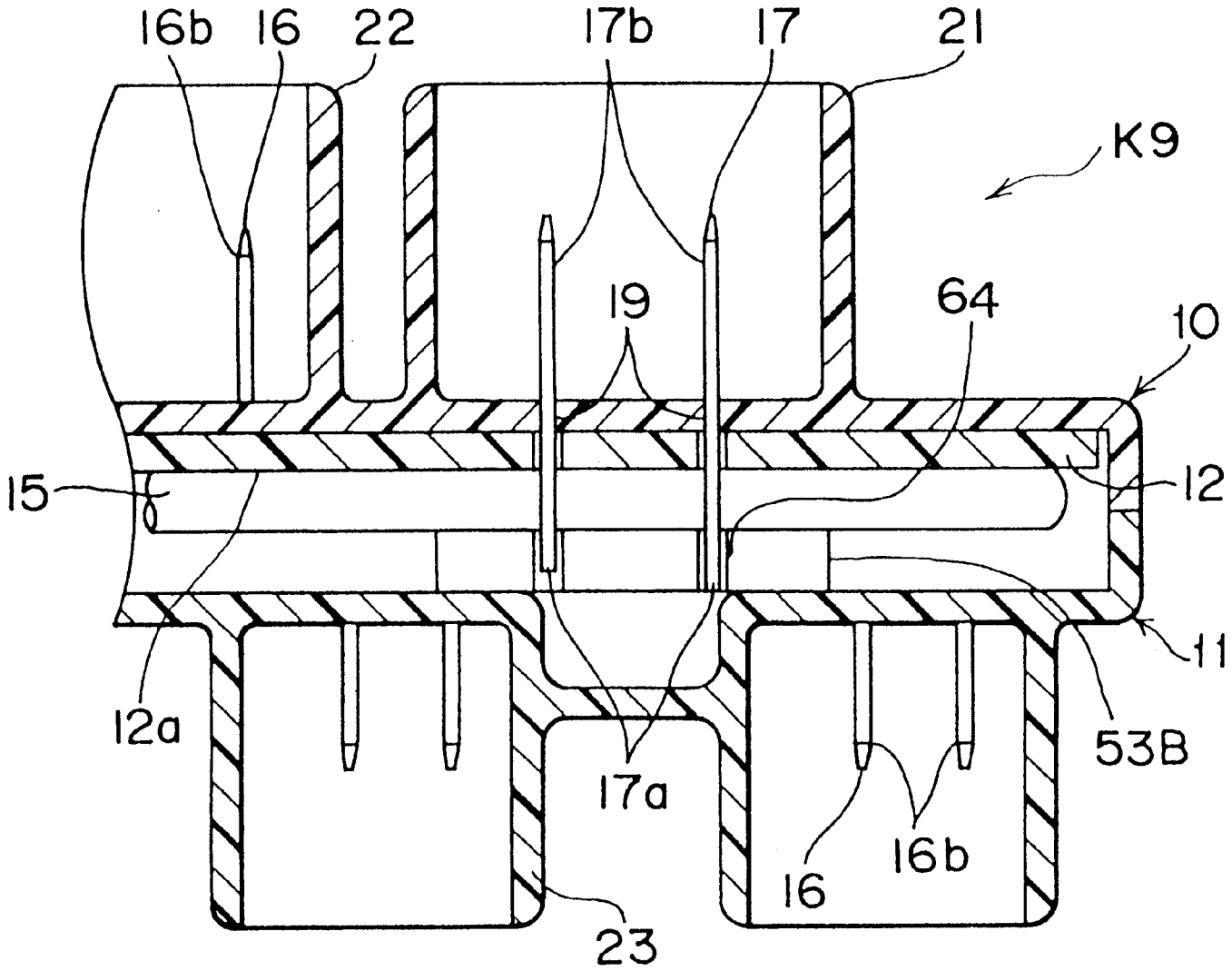
Figure 24:
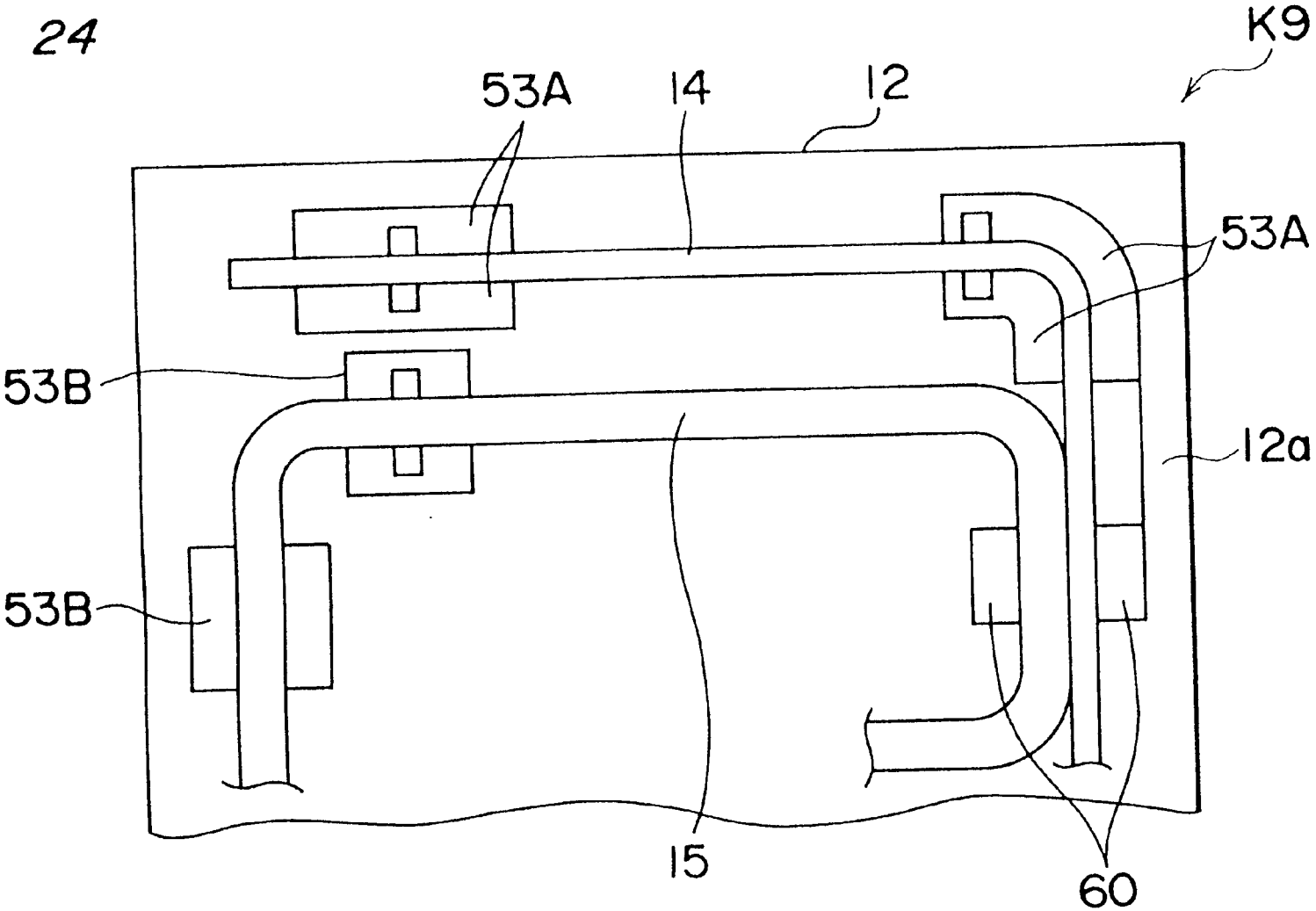
FIG. 24 is an enlarged fragmentary bottom plan view of an insulating plate of the electrical connection box of FIG. 22.
Figure 25:
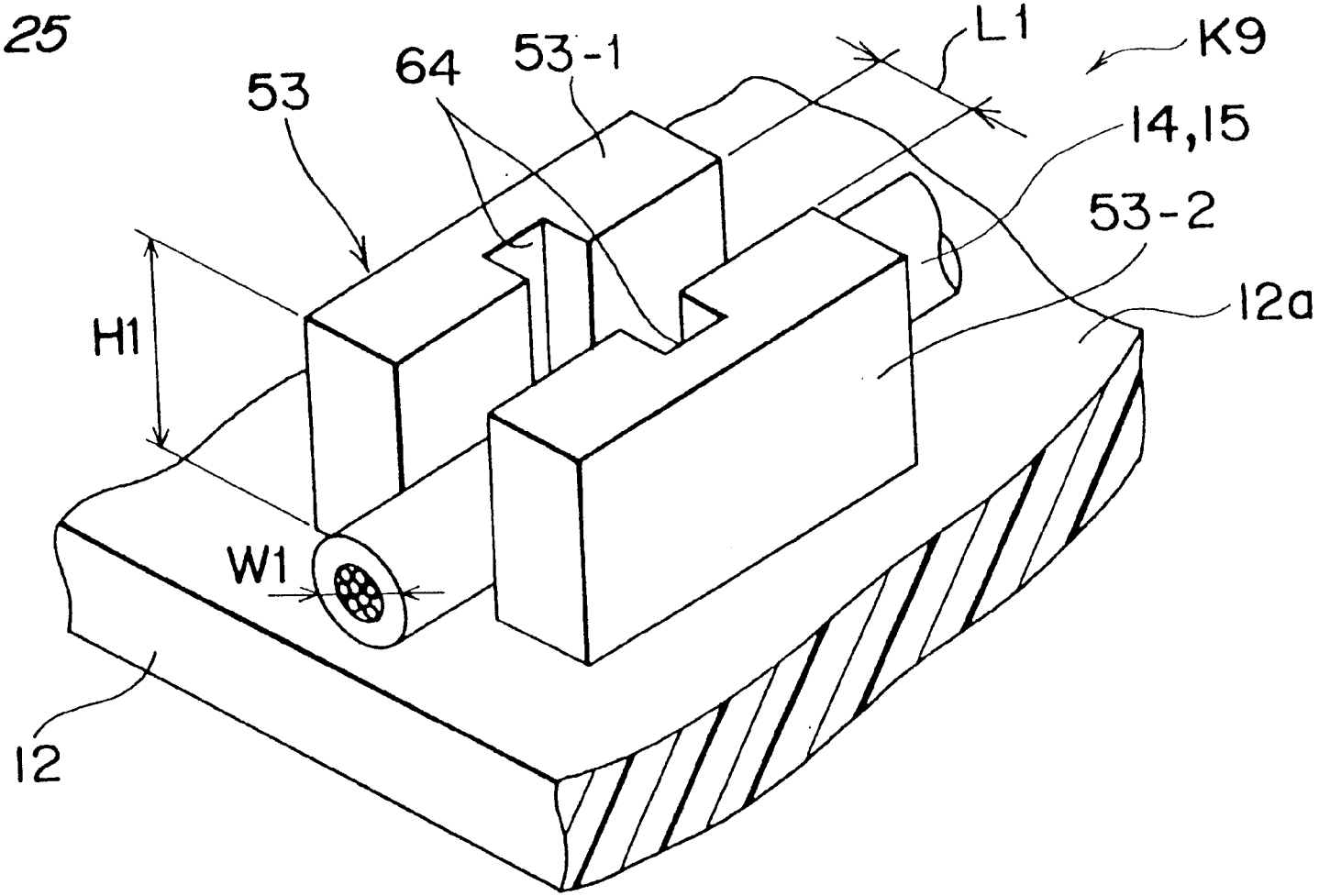
FIG. 25 is a fragmentary perspective view of the insulating plate of FIG. 24.
Figure 26:
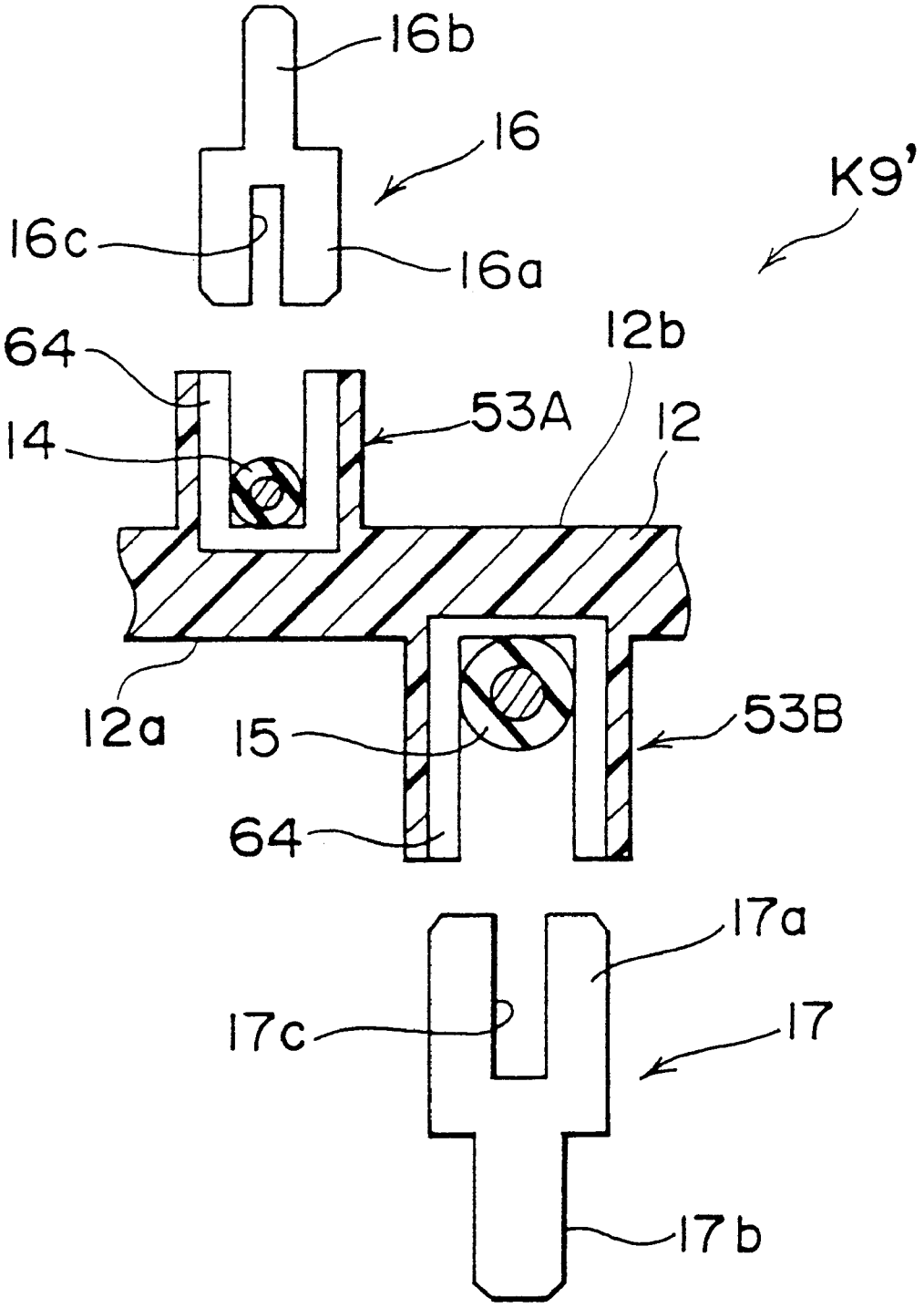
FIG. 26 is a fragmentary sectional view of an insulating plate of an electrical connection box which is a modification of the electrical connection box of FIG. 22.
Figure 27:
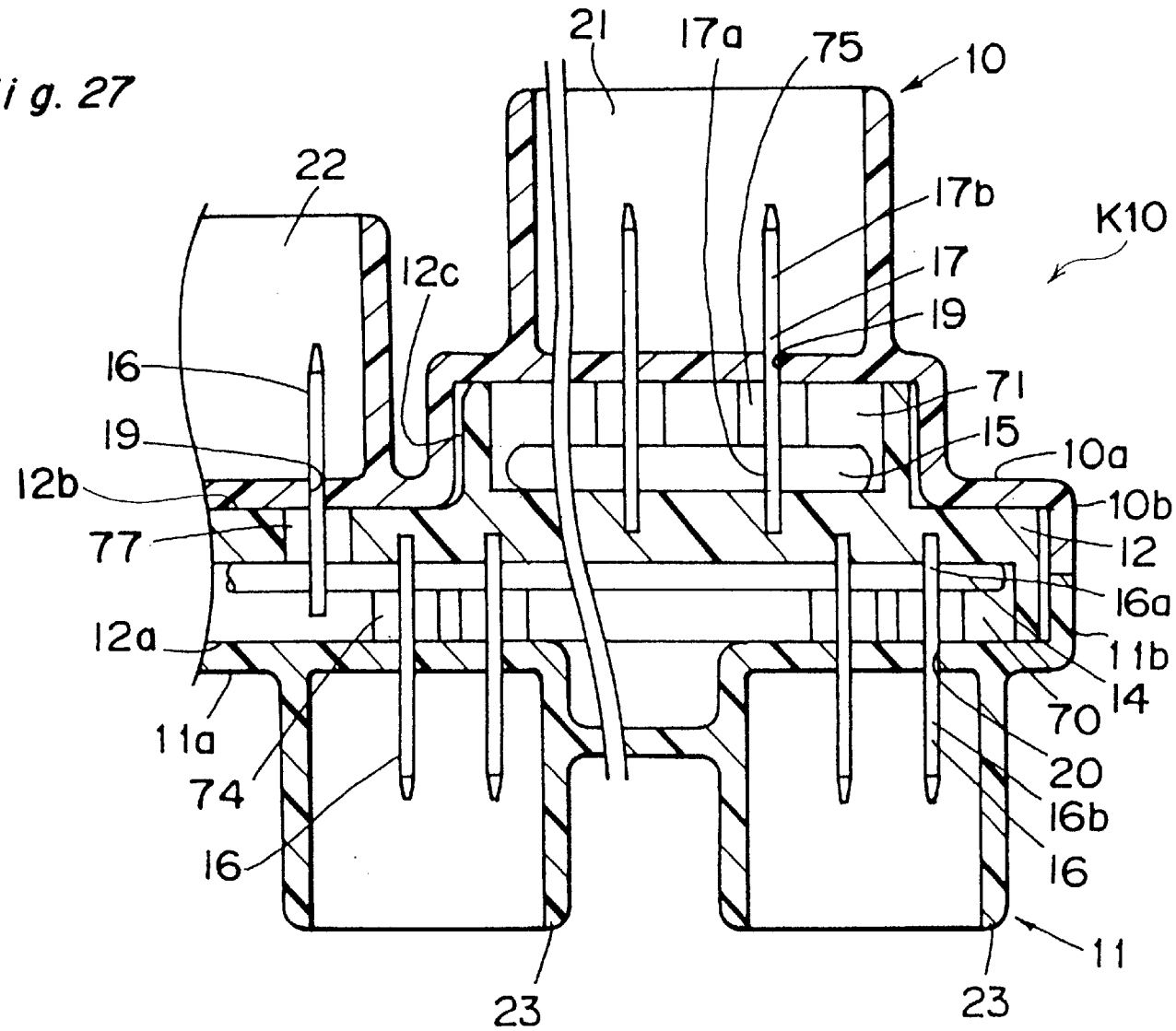
FIG. 27 is a fragmentary vertical sectional view of an electrical connection box according to a tenth embodiment of the present invention.

FIG. 22 and 23 show an electrical connection box K9 according to a ninth embodiment of the present invention. In the electrical connection box K9, a plurality of wiring projections 53A and 53B for holding the wires 14 and 15, respectively are provided on the lower face 12*a* of the insulating plate 12 in accordance with a circuit pattern as shown in FIGS. 24 and 25. As shown in FIG. 25, each of the wiring projections 53A and 53B includes a pair of opposed rectangular projections 53-1 and 53-2 spaced a distance L1 from each other. By setting the distance L1 to a small value, the wiring projection 53A is arranged to grip one small-diameter wire 14. On the other hand, by setting the distance L1 to a large value, the wiring projection 53B is arranged to grip one large-diameter wire 15. The wires 14 and 15 are directly inserted in between the projections 53-1 and 53-2 of each of the wiring projections 53A and 53B, respectively by the wire feeder.

The pressing contact portions 16*a* and 17*a* of the pressing contact terminals 16 and 17 are press fitted in between the projections 53-1 and 53-2 of each of the wiring projections 53A and 53B so as to be connected, through pressing contact, to the wires 14 and 15 held in the wiring projections 53A and 53B, respectively. Meanwhile, the input-output terminal portions 16*b* and 17*b* of the pressing contact terminal 16 and 17 are protruded out of the terminal holes 19 and 20 of the upper and lower casings 10 and 11.

As shown in FIG. 24, the wiring projections 53A and 53B are provided only at locations required for laying the wires 14 and 15 along the wiring pattern. Namely, in FIG. 24, the wiring projections 53A are provided at a distal end of a straight portion of the wire 14 and a curved portion of the wire 14, while the wiring projections 53B are provided at opposite ends of a curved portion of the wire 15. The wiring projections 53A and 53B are arranged to grip one small-diameter wire 14 and one large-diameter wire 15, respectively as described above. However, a wiring projection 60 which grips one small-diameter wire 14 and one large-diameter wire 15 therebetween may also be used.

Assuming that H1 denotes a height of each of the wiring projections 53A and 53B, the height H1 and the diameter W1 of each of the wires 14 and 15 are so set as to satisfy a relation of ($H1 \geqq W1$). Meanwhile, as long as the height H is larger than the diameter W1, the height H1 is not restricted to the above mentioned relation but it is preferable that the height H1 is twice or more the diameter W1.

Meanwhile, at portions of the projections 53-1 and 53-2 of each of the wiring projections 53A and 53B where the pressing contact terminals 16 and 17 are, respectively, connected to the wires 14 and 15 inserted in between the projections 53-1 and 53-2, opposed side faces of the projections 53-1 and 53-2 are recessed so as to form terminal driving portions 64 for driving the pressing contact terminals 16 and 17 thereinto such that the terminal driving portions 64 open to the lower face 12*a* of the insulating plate 12. The terminal driving portions 64 are disposed so as to confront the terminal holes 20 of the lower casing 11, the terminal holes 19 of the fuse fitting portion 21 of the upper casing 10 and the terminal holes 19 of the connector portion 22 of the upper casing 10.

Hereinafter, a method of assembling the electrical connection box K9 of the above described arrangement is described. Initially, the insulating plate 12 is turned upside down such that the lower face 12*a* of the insulating plate 12 is oriented upwardly. Then, the small-diameter wire 14 is fed by the wire feeder so as to be directly inserted in between the projections 53-1 and 53-2 of the wiring projection 53A. At this time, since the height H1 of the projections 53-1 and 53-2 is twice or more the diameter W1 of the wire 14, the wire 14 can be positively held in the wiring projection 53A without moving away from the bottom of the wiring projection 53A. Subsequently, the large-diameter wire 15 is likewise fed by the wire feeder so as to be directly inserted in between the projections 53-1 and 53-2 of the wiring projection 53B.

After the wires 14 and 15 have been laid in the wiring projections 53A and 53B of the insulating plate 12, respectively, the pressing contact terminals 16 are press fitted into the terminal driving portions 64 of the wiring projections 53A. At this time, the opposite side edges of the slot 16*c* of the pressing contact portion 16*a* of the pressing contact terminal 16 grip the wire 14 therebetween so as to be thrust into the insulating coating of the wire 14. By this pressing contact step, the pressing contact terminal 16 not only is electrically connected to the conductor of the wire 14 but is secured to the insulating plate 12 such that the input-output terminal portion 16*b* of the pressing contact terminal 16 projects out of the lower face 12*a* of the insulating plate 12.

Similarly, the pressing contact terminals 17 are press fitted into the terminal driving portions 64 of the wiring projections 53B. Thus, the pressing contact terminal 17 not only is electrically connected to the conductor of the wire 15 but is fixed to the insulating plate 12 such that the input-output terminal portion 17*b* of the pressing contact terminal 17 projects out of the upper face 12*b* of the insulating plate 12.

In a state where the pressing contact terminals 16 and 17 have been, respectively, connected, through pressing contact, to the wires 14 and 15 laid in the wiring projections 53A and 53B of the insulating plate 12 as described above, the upper and lower casings 10 and 11 are not mounted on the upper and lower faces 12*b* and 12*a* of the insulating plate 12 and thus, it is possible to check whether or not the pressing contact terminals 16 and 17 are, respectively, held in pressing contact with the wires 14 and 15 properly,.

Thereafter, the upper and lower casings 10 and 11 are assembled with each other so as to grip the insulating plate 12 therebetween. At this time, the not only the input-output terminal portions 17*b* of the pressing contact terminals 17 connected to the large-diameter wires 15 are projected out of the terminal holes 19 of the fuse fitting portion 21 of the upper casing 10 but the input-output terminal portions 16*b* of the pressing contact terminals 16 connected to the small-diameter wires 14 are projected out of the terminal holes 19 of the connector portion 22 of the upper casing 10. Meanwhile, the input-output terminal portions 16*b* of the pressing contact terminals 16 connected to the small-diameter wires 14 are projected out of the terminal holes 20 of the connector portions 23 of the lower casing 11.

In the electrical connection box K9, both the wiring projections 53A for receiving the small-diameter wires 14 and the wiring projections 53B for receiving the large-diameter wires 15 are mixedly formed on the lower face 12*a* of the insulating plate 12. However, the present invention is not restricted to this arrangement. For example, in an electrical connection box K9' of FIG. 26 which is a modification of the electrical connection box K9, the narrower wiring projections 53A and the wider wiring projections 53B are, respectively, formed on the opposite faces of the insulating plate 12 by disposing the wiring projections 53A and 53B on the upper face 12*b* and the lower face 12*a* of the insulating plate 12, respectively.

Figure 28:
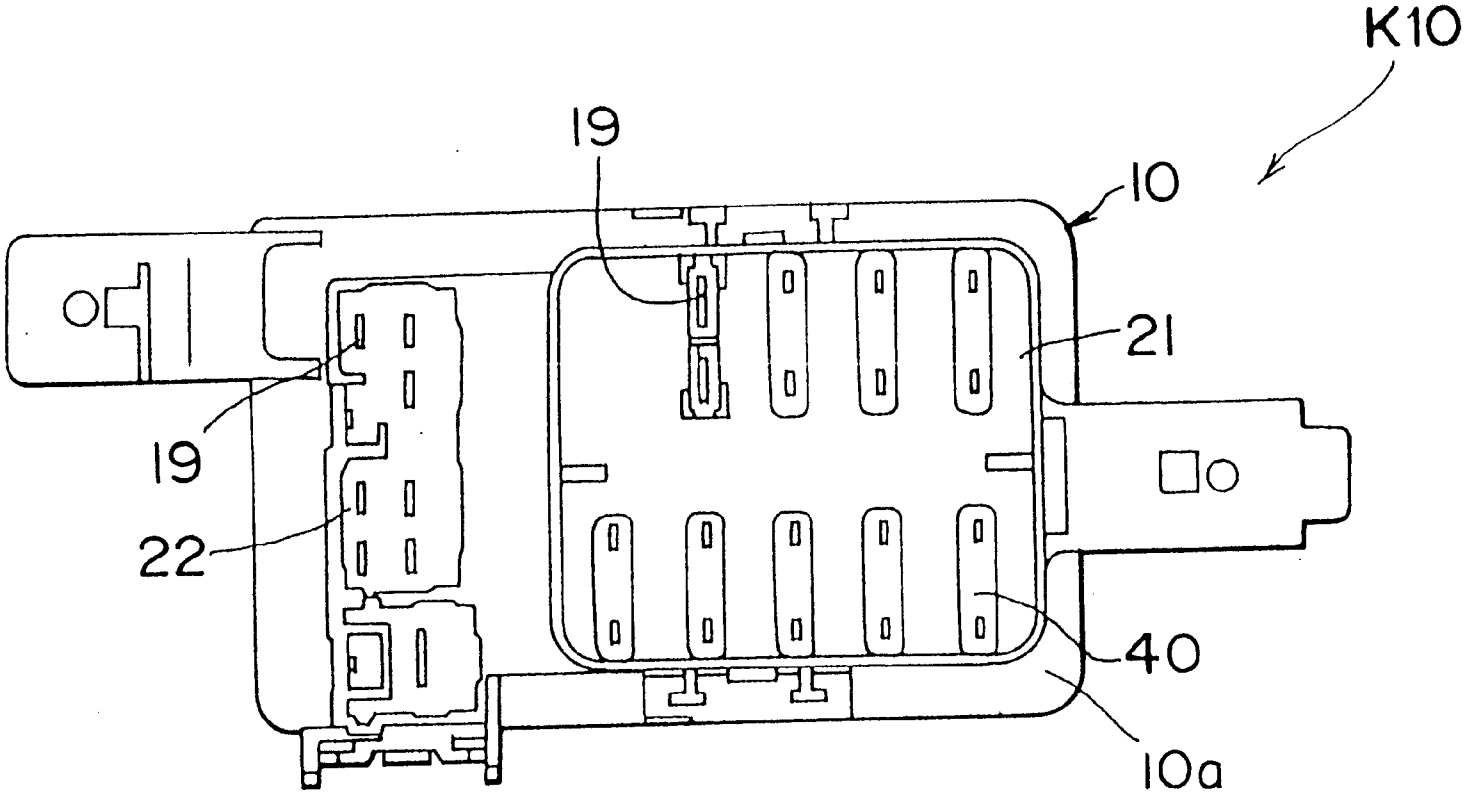
FIG. 28 is a top plan view of an upper casing of the electrical connection box of FIG. 27.
Figure 29:
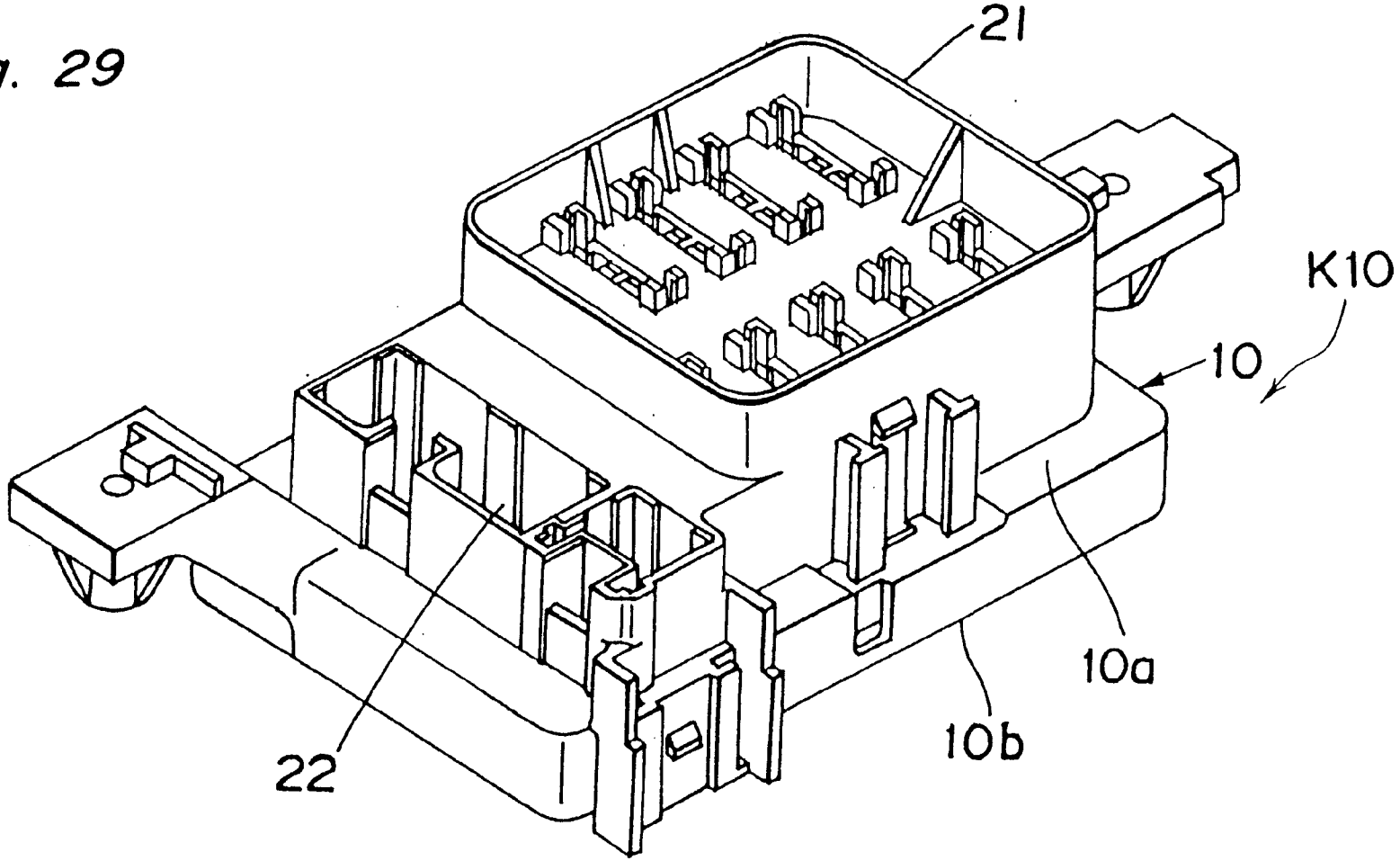
FIG. 29 is a perspective view of the upper casing of FIG. 28.

FIGS. 27 to 33 show an electrical connection box K10 according to a tenth embodiment of the present invention. First and second wiring grooves 70 and 71 for receiving the small-diameter wires 14 and the large-diameter wires 15, respectively are formed on the lower and upper faces 12*a* and 12*b* of the insulating plate 12, respectively in accordance with wiring patterns. As shown in FIGS. 28 and 29, the fuse fitting portion 21 is disposed higher than the connector portion 22 on the upper wall 10*a* of the upper casing 10.

At a portion of the insulating plate 12, which is gripped between the fuse fitting portion 21 of the upper casing 10 and the lower casing 11, a boss 12*c* is formed on the upper face 12*b* of the insulating plate 12 such that the insulating plate 12 is closely fitted into a space defined inside the upper and lower casings 10 and 11 at the time the upper and lower casings 10 and 11 have been assembled with each other.

Figure 32:
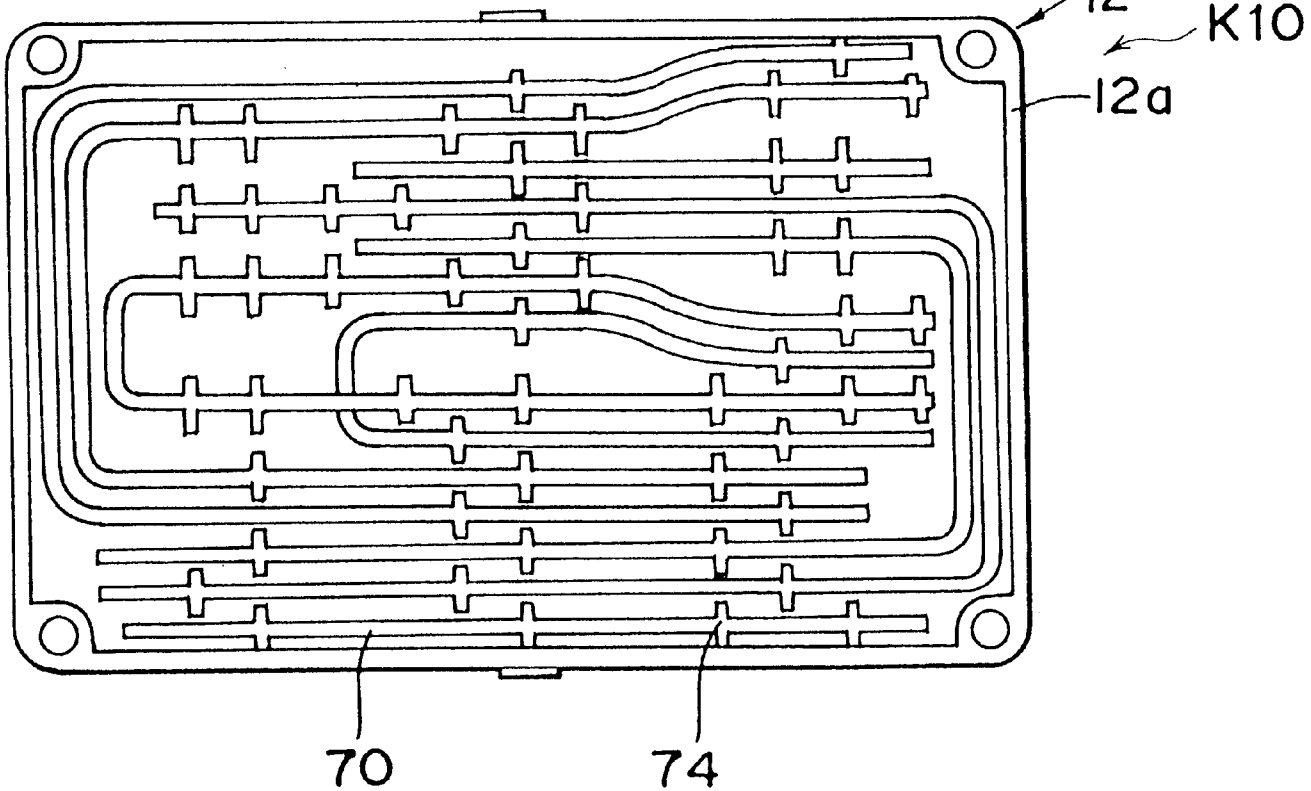
FIG. 32 is a bottom plan view of the insulating plate of FIG. 31.
Figure 33:
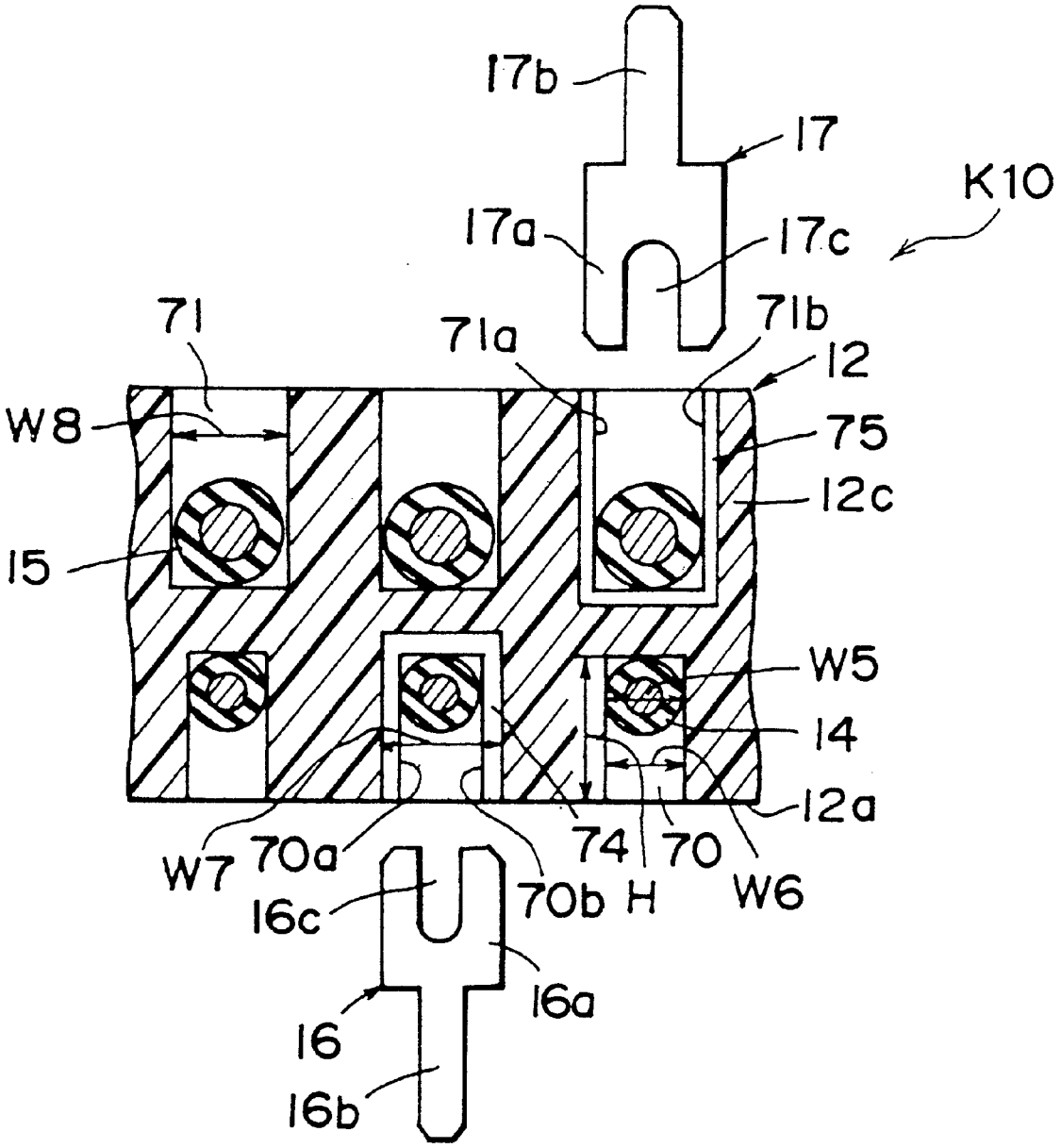
FIG. 33 is a sectional view showing insertion of wires and pressing contact terminals into the insulating plate of FIG. 31.

As shown in FIGS. 32 and 33, the first wiring grooves 70 for receiving the small-diameter wires 14 are formed on the lower face 12*a* of the insulating plate 12 in accordance with the wiring pattern. As shown in FIG. 33, a diameter W5 of the wires 14 and a width W6 of the first wiring grooves 70 are so set as to satisfy a relation of (W5≧W6). Meanwhile, a depth H of the first wiring grooves 70 is so set as to satisfy a relation of (H≧W5) The depth H of the first wiring grooves 70 is not restricted to this relation but may assume any value larger than the diameter W5 of the wires 14. However, it is preferable that the depth H of the first wiring grooves 70 is twice or more the diameter W5 of the wires 14.

Figure 31:
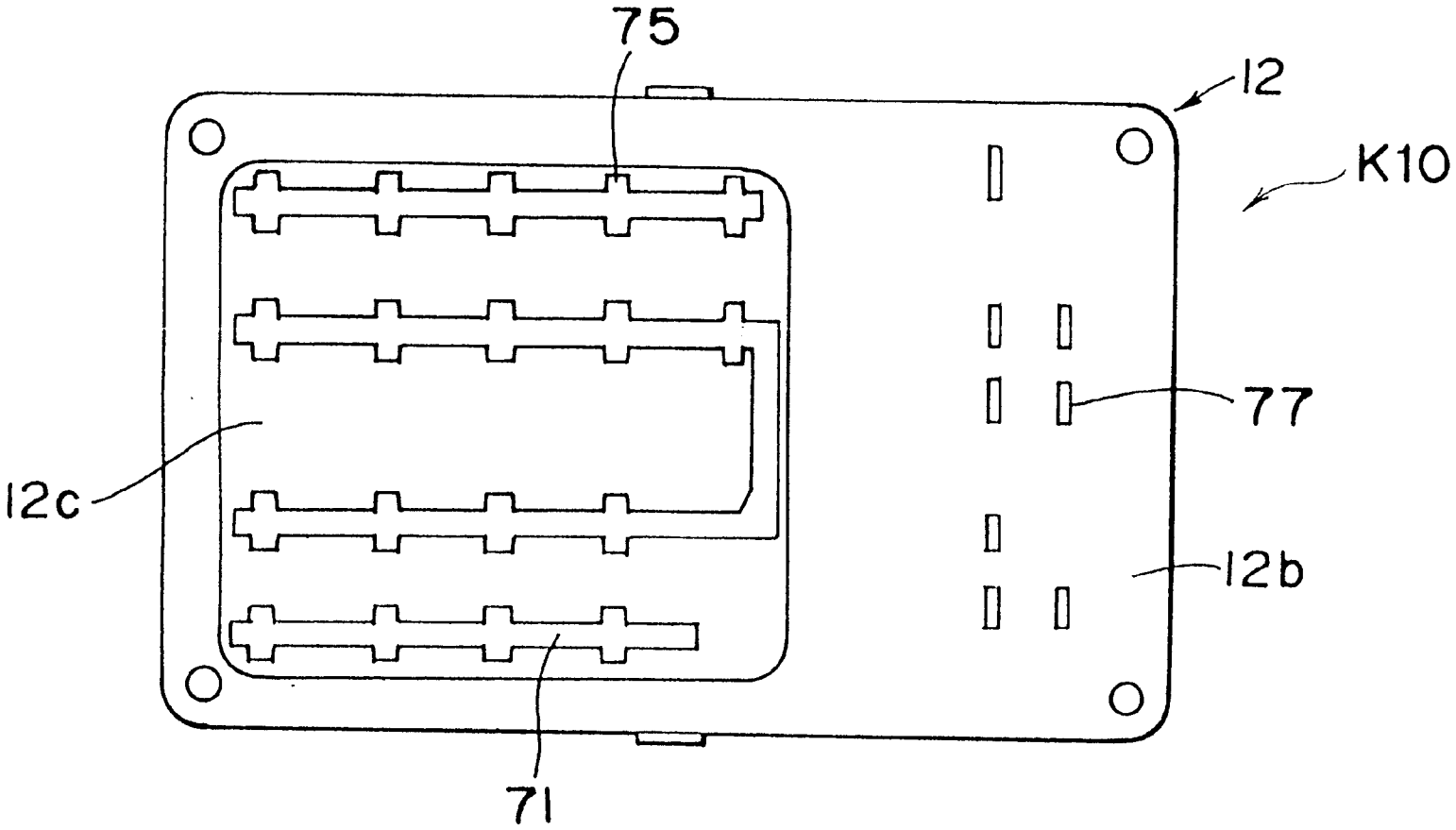
FIG. 31 is a top plan view of an insulating plate of the electrical connection box of FIG. 27.

Meanwhile, at portions of the first wiring groove 70 where the pressing contact terminals 16 are connected to the wire 14 inserted into the first wiring groove 70, opposed side faces 70*a* and 70*b* of the first wiring groove 70 are recessed so as to form downwardly opening terminal driving portions 74 having a width W7. As shown in FIG. 31, upwardly opening terminal driving portions 77 are formed at a portion of the first wiring grooves 70 so as to extend through the insulating plate 12 to the upper face 12*b* of the insulating plate 12. The terminal driving portions 77 do not extend up to the lower face 12*a* of the insulating plate 12 and are formed from the upper face 12*b* to an intermediate portion of the side walls 70*a* and 70*b* of the first wiring groove 70. The terminal driving portions 74 and 77 are disposed so as to confront the terminal holes 20 of the lower casing 11 and the terminal holes 19 of the upper casing 10, respectively.

As shown in FIGS. 31 and 33, the second wiring grooves 71 for receiving the large-diameter wires 15 are formed on an upper face of the boss 12*c* of the insulating plate 12 in accordance with the wiring pattern so as to correspond to the fuse fitting portion 21 of the upper casing 10. Thus, a width W8 and a depth of the second wiring grooves 71 are, respectively, made larger than the width W7 and the depth H of the first wiring grooves 70. At portions of the second wiring groove 71 where the pressing contact terminals 17 are connected to the wire 15 inserted into the second wiring groove 71, opposed side faces 71*a* and 71*b* of the second wiring groove 71 are recessed so as to form upwardly opening terminal driving portions 75. At a portion of the insulating plate 12, which has the boss 12c, the first wiring grooves 70 are formed on the lower face 12*a* of the insulating plate 12. Thus, the second and first wiring grooves 71 and 70 are, respectively, formed on the upper and lower faces of the boss 12*c* as shown in FIG. 33.

Hereinafter, a method of assembling the electrical connection box K10 of the above described arrangement is described. Initially, the insulating plate 12 is turned upside down such that the lower face 12*a* is oriented upwardly. Then, the small-diameter wire 14 is fed by the wire feeder so as to be directly inserted into the first wiring groove 70. At this time, since the wire 14 is press fitted into the first wiring groove 70 which has the depth H twice or more the diameter W5 of the wire 14 and the width W6 slightly smaller than the diameter W5 of the wire 14. Therefore, even if the wire 14 has a tendency to wind, the wire 14 can be positively held in the first wiring groove 70 without moving away from the bottom of the first wiring groove 70.

Subsequently, the insulating plate 12 is over-turned such that the upper face 12*b* of the insulating plate 12 is oriented upwardly. Then, the large-diameter wire 15 is fed by the wire feeder so as to be directly inserted into the second wiring groove 71. Since depth of the second wiring groove 71 is made large and width of the second wiring groove 71 is made small in the same manner as the first wiring groove 70 such that the wire 15 is press fitted into the second wiring groove 71, the wire 15 can be held in the second wiring groove 71 without moving away from the bottom of the second wiring groove 71. Meanwhile, since the number of uneven portions of the insulating plate 12 is small, the wires 14 and 15 can be stably inserted into the first and second wiring grooves 70 and 71, respectively.

Thereafter, the insulating plate 12 is turned upside down such that the lower face 12*a* is oriented upwardly. Then, the pressing contact terminals 16 are press fitted into the terminal driving portions 74. At this time, opposite side edges of the slot 16*c* of the pressing contact portion 16*a* of the pressing contact terminal 16 grip the wire 14 therebetween so as to be thrust into an insulating coating of the wire 14. Thus, the pressing contact terminal 16 not only is electrically connected to the wire 14 but is secured to the insulating plate 12.

Subsequently, the insulating plate 12 is over-turned such that the upper face 12*b* is oriented upwardly. Then, the pressing contact terminals 16 are press fitted into the terminal driving portions 77 so as to be connected to the small-diameter wires 14 and the pressing contact terminals 17 are press fitted into the terminal driving portions 75 so as to be connected to the large-diameter wires 15 such that the pressing contact terminals 16 and 17 are secured to the insulating plate 12.

In a state where the pressing contact terminals 16 and 17 have been, respectively, connected, through pressing contact, to the wires 14 and 15 laid in the first and second wiring grooves 70 and 71 which are formed on the lower and upper faces 12*a* and 12*b* of the insulating plate 12, the upper and lower casings 10 and 11 are not mounted on the upper and lower faces 12*b* and 12*a* of the insulating plate 12 and thus, it is possible to check whether or not the pressing contact terminals 16 and 17 are, respectively, held in pressing contact with the wires 14 and 15 properly.

Then, the upper and lower casings 10 and 11 are assembled with each other so as to grip the insulating plate 12 therebetween. At this time, not only the input-output terminal portions 17*b* of the pressing contact terminals 17 connected to the large-diameter wires 15 are projected out of the terminal holes 19 of the fuse fitting portion 21 of the upper casing 10 but the input-output terminal portions 16*b* of the pressing contact terminals 16 connected to the small-diameter wires 14 are projected out of the terminal holes 19 of the connector portion 22 of the upper casing 10. Meanwhile, the input-output terminals 16*b* of the pressing contact terminals 16 connected to the small-diameter wires 14 are projected out of the terminal holes 20 of the connector portions 23 of the lower casing 11.

An internal circuit of the electrical connection box K10 assembled as described above is constituted by only the small-diameter wires 14, the large-diameter wires 15 and the pressing contact terminals 16 and 17 connected to the wires 14 and 15, respectively. Namely, a power source circuit of the internal circuit is constituted by the large-diameter wires 15 and the pressing contact terminals 17 connected to the wires 15 through pressing contact such that the input-output terminal portions 17*b* of the pressing contact terminals 17 are connected to the fuses 40 (FIG. 28) attached to the fuse fitting portion 21. On the other hand, a load circuit of the internal circuit is constituted by the small-diameter wires 14 and the pressing contact terminals 16 connected to the wires 14 through pressing contact such that the input-output terminal portions 16*b* of the pressing contact terminals 16 are connected to the connectors fitted into the connector portions 22 and 23.

Since the internal circuit of the electrical connection box K10 is constituted by only the wires and the pressing contact terminals without using bus bars, it is possible to cope with design changes of the internal circuit easily. Namely, in case design changes take place in the load circuit which is likely to be subjected to design changes, it is possible to easily cope with the design changes by changing wiring for the small-diameter wires 14 or mounting positions of the pressing contact terminals 16. Meanwhile, in case design changes occur in the load circuit, it is possible to easily cope with the design changes by changing wiring for the large-diameter wires 15 or mounting positions of the pressing contact terminals 17.

In the tenth embodiment, the second wiring grooves for receiving the large-diameter wires are formed on the boss provided at a portion of one face of the insulating plate and the first wiring grooves for receiving the small-diameter wires are formed on the other face of the insulating plate. However, the present invention is not restricted to this arrangement. For example, the above arrangement may be reversed. Alternatively, the first and second wiring grooves may be mixedly formed on one of the opposite faces of the insulating plate. Furthermore, the first and/or second wiring grooves may also be formed at a portion of the one face of the insulating plate other than the boss.

In the electrical connection box K10, since the insulating plate is partially made thicker by providing the boss such that a plurality of rows of the wiring grooves can be formed only at the necessary location of the electrical connection box K10, the necessary wires can be laid in the electrical connection box K10 without the need for increasing thickness of whole of the electrical connection box K10.

Figure 34:
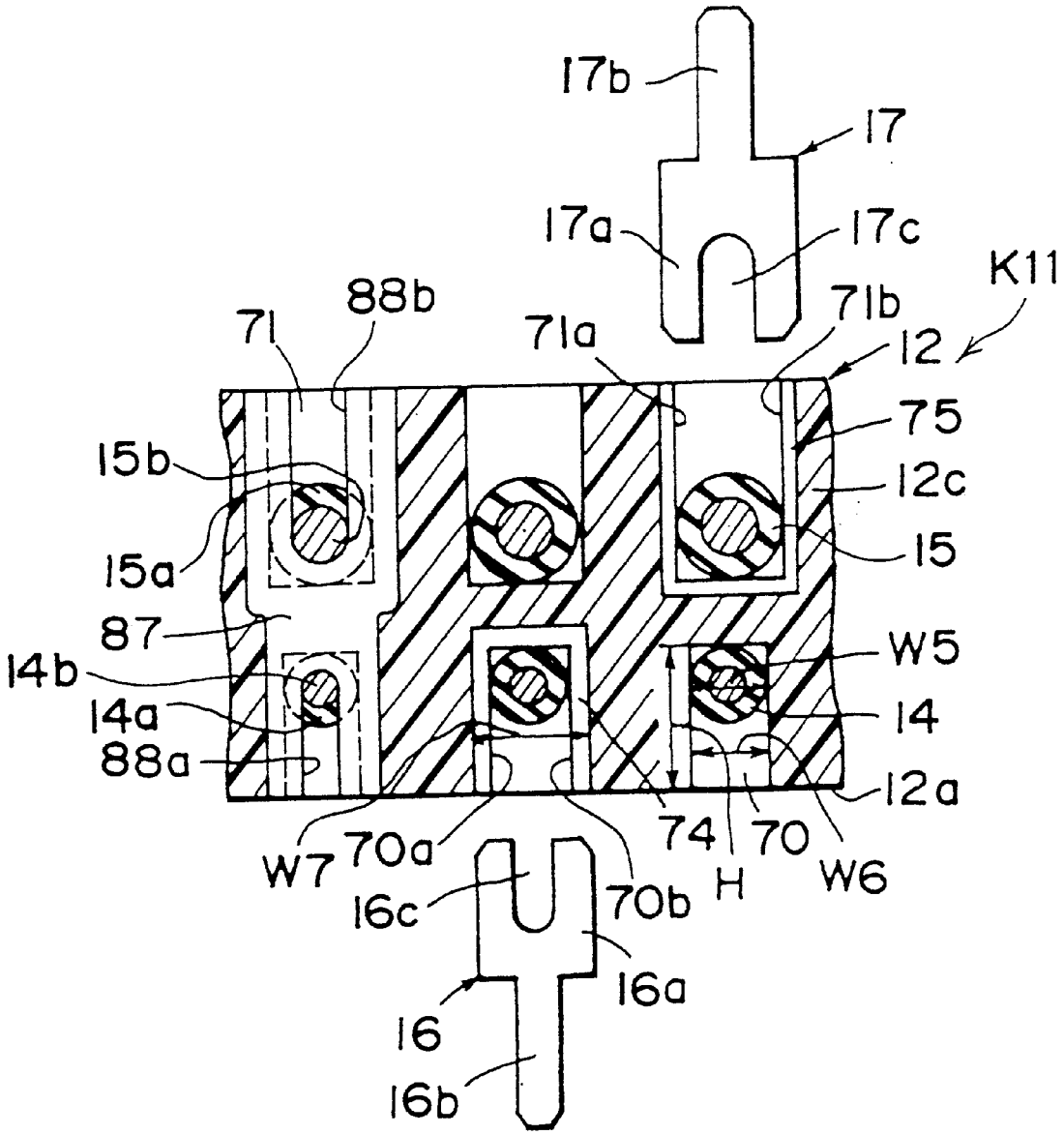
FIG. 34 is a sectional view showing insertion of wires and pressing contact terminals into an insulating plate of an electrical connection box according to an eleventh embodiment of the present invention.
Figure 35:
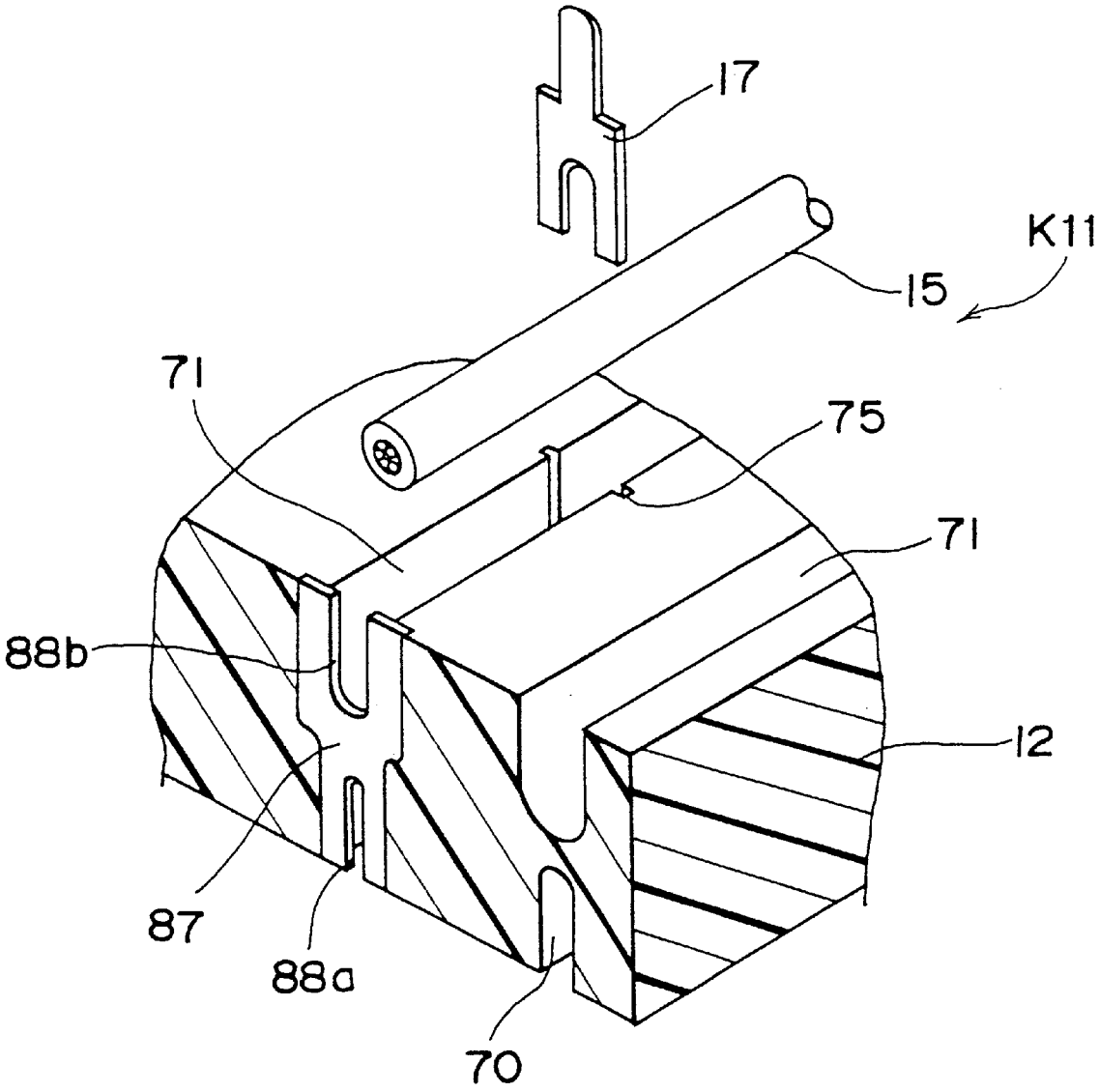
FIG. 35 is a partly sectional fragmentary perspective view showing insertion of the wires and the pressing contact terminals into the insulating plate of FIG. 34.

FIGS. 34 and 35 show an electrical connection box K11 according to an eleventh embodiment of the present invention. As will be seen from FIGS. 33 and 34, the electrical connection box K11 is similar to the electrical connection box K10. Thus, the insulating plate 12 of the electrical connection box K11 includes the boss 12*c* in the same manner as the electrical connection box K10. However, in the insulating plate 12 of the electrical connection box K11, some of the second wiring grooves 71 formed on the boss 12*c* are aligned with the first wiring grooves 70 as shown in FIG. 35, and joint terminal 87 are integrally molded at these first and second wiring grooves 70 and 71 or are press fitted into recesses extending through these first and second wiring grooves 70 and 71.

The joint terminal 87 is formed by a rectangular electrically conductive plate and opposite end portions of the joint terminal 87 are recessed into U-shaped electrical contact portions 88*a* and 88*b*, respectively. The electrical contact portion 88*a* is provided for the small-diameter wire 14 and has a width substantially equal to a diameter of the conductor of the wire 14. Meanwhile, the electrical contact portion 88*b* is provided for the large-diameter wire 15 and has a width substantially equal to a diameter of the conductor of the wire 15. Since other constructions of the electrical connection box K11 are similar to those of the electrical connection box K10, the description is abbreviated for the sake of brevity.

Initially, the insulating plate 12 is turned upside down such that the lower face 12*a* is oriented upwardly. Then, the small-diameter wire 14 is fed by the wire feeder so as to be directly inserted into the first wiring groove 70. When the wire 14 is inserted into the first wiring groove 70, the electrical contact portion 88*a* of the joint terminal 87 provided integrally with the insulating plate 12 is thrust into an insulating coating 14*a* of the wire 14 so as to be brought into contact with a conductor 14*b* of the wire 14. Since the number of uneven portions of the insulating plate 12 is small, the wire 14 can be smoothly fed at an identical height during insertion of the wire 14 into the first wiring groove 70 and thus, the wire 14 can be inserted into the first wiring groove 70 stably.

Subsequently, the insulating plate 12 is over-turned such that the upper face 12*b* is oriented upwardly. Then, the large-diameter wire 15 is likewise directly inserted into the second wiring groove 71 by the wire feeder. Therefore, the electrical contact portion 88*b* of the joint terminal 87, which extends into the second wiring groove 71, is thrust into an insulating coating 15*a* of the wire 15 so as to be brought into contact with a conductor 15*b* of the wire 15. As a result, the wires 15 and 14 are electrically connected to each other.

In the internal circuit of the electrical connection box K11, since the wires 14 and 15 can be, respectively, laid on the opposite faces of the insulating plate 12 by using the joint terminals 87 as described above, configurations of the first and second wiring grooves 70 and 71, i.e., the wiring patterns can be simplified.

Figures 36A, 36B, 36C, 36D:
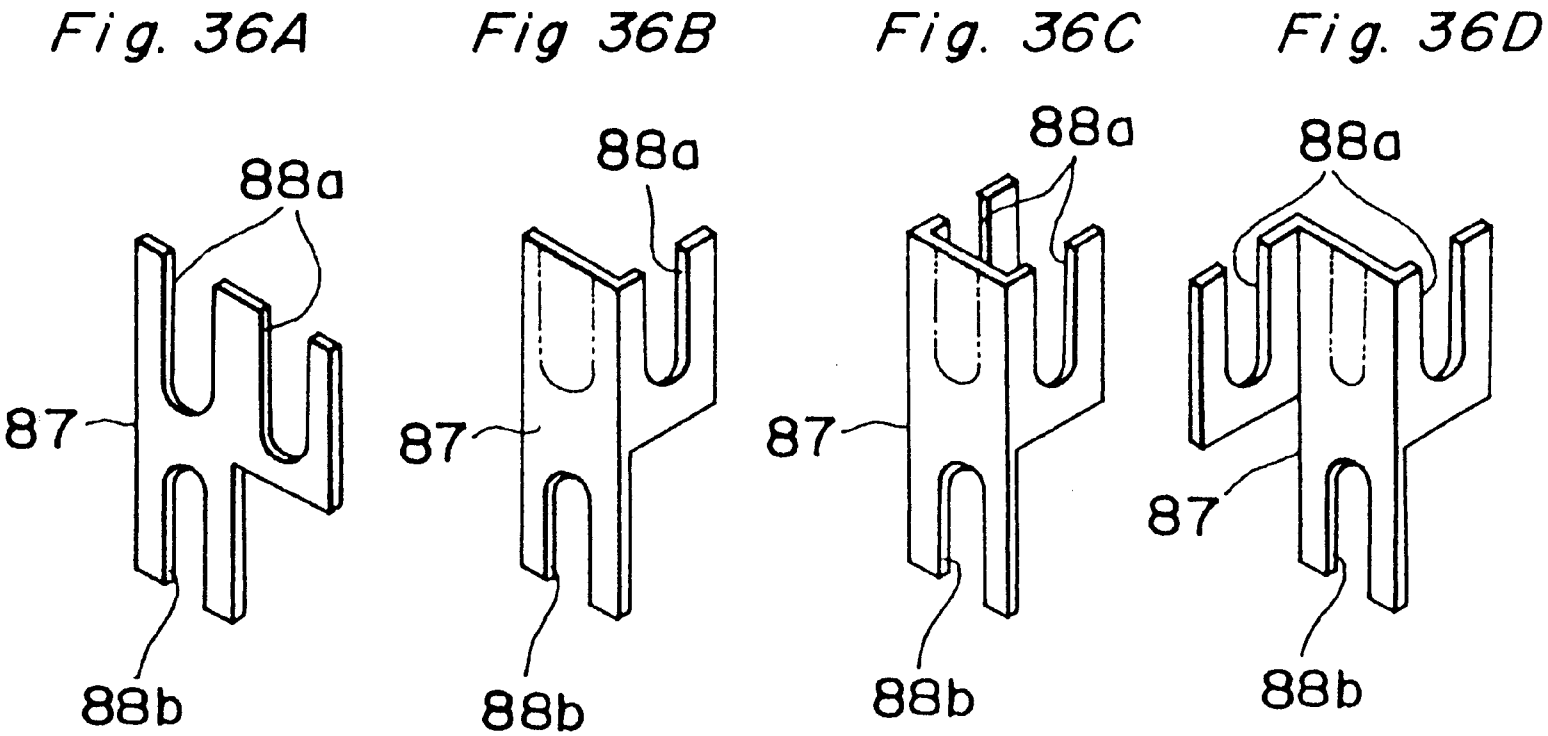
FIGS. 36A, 36B, 36C and 36D are perspective views of joint terminals which are first, second, third and fourth modifications of a joint terminal shown in FIG. 35.

Meanwhile, the joint terminal 87 can be modified variously. In FIG. 36A, the joint terminal 87 is of a flat shape .but has two electrical contact portions 88*a*. In FIG. 36B, one side of one end of the joint terminal 87 opposite to the electrical contact portion 88*b* is bent orthogonally to the other side of the one end of the joint terminal 87. In this case, only one electrical contact portion 88*a* may be provided at one of the bent portions or two electrical contact portions 88*a* including one shown by the two-dot chain line may be provided. Furthermore, in FIG. 36C, opposite sides of one end of the joint terminal 87 opposite to the electrical contact portion 88*b* are bent into a substantially U-shaped configuration. In this case, two electrical contact portions 88*a* may be provided at the opposite bent portions, respectively or three electrical contact portions 88*a* including one shown by the two-dot chain line may also be provided. In addition, as shown in FIG. 36D, opposite sides of one end of the joint terminal 87 opposite to the electrical contact portion 88*b* may be bent in opposite directions. Moreover, a plurality of the electrical contact portions 88*a* are provided at one end of the joint terminal 87 but may also be provided at opposite ends of the joint terminal 87.

Figure 37:
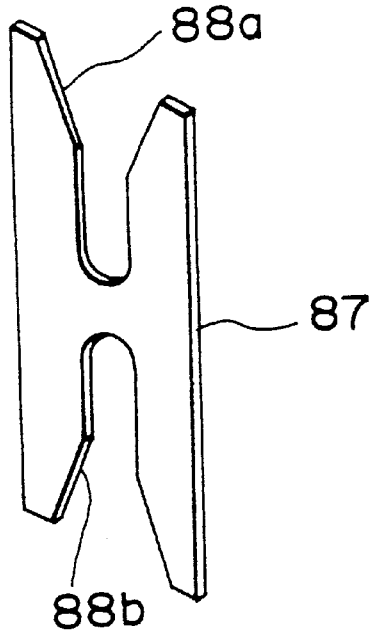
FIG. 37 is a perspective view of a joint terminal which is a fifth modification of the joint terminal of FIG. 35.

Furthermore, in the joint terminal 87, each of the electrical contact portions 88*a* and 88*b* is formed by a substantially U-shaped recess such that opposite side portions of each of the electrical contact portions 88*a* and 88*b* extends in parallel with each other. However, the joint terminal 87 may be further modified as shown in FIG. 37 in which the opposite side portions of each of the electrical contact portions 88*a* and 88*b* are gradually spaced further away from each other towards an end of each of the electrical contact portions 88*a* and 88*b*. When the wires 14 and 15 are, respectively, inserted into the first and second wiring grooves 70 and 71 by using the joint terminal 87 of FIG. 37, the wires 14 and 15 are not forced out of the first and second wiring grooves 70 and 71. Thus, by merely press fitting the wires 14 and 15 into the first and second wiring grooves 70 and 71, the insulating coatings 14*a* and 15*a* of the wires 14 and 15 can be smoothly slashed by the electrical contact portions 88*a* and 88*b*, respectively.

In the electrical connection box K11, since the first and second wiring grooves are formed on the opposite faces of the insulating plate, respectively and the wires inserted into the first and second wiring grooves are electrically connected to each other by the joint terminals, the wiring patterns for the insulating plate can be simplified and thus, the wires can be inserted into the first and second wiring grooves easily. Meanwhile, when the pressing contact terminals are driven into the insulating plate, the pressing contact terminals can be electrically connected to the wires inserted into the first and second wiring grooves. Therefore, since a hitherto necessary wiring die is not required to be used and wiring and pressing contact between the wires and the pressing contact terminals can be performed simultaneously, wiring can be performed at low cost through reduction of the number of its operational steps.

Meanwhile, in the electrical connection box K11, when the joint terminal projecting into one of the first and second wiring grooves has a plurality of the electrical contact portions, a plurality of the wires in the one of the first and second wiring grooves can be connected to the wires in the other of the first and second wiring grooves by the joint terminal.

Figure 40:
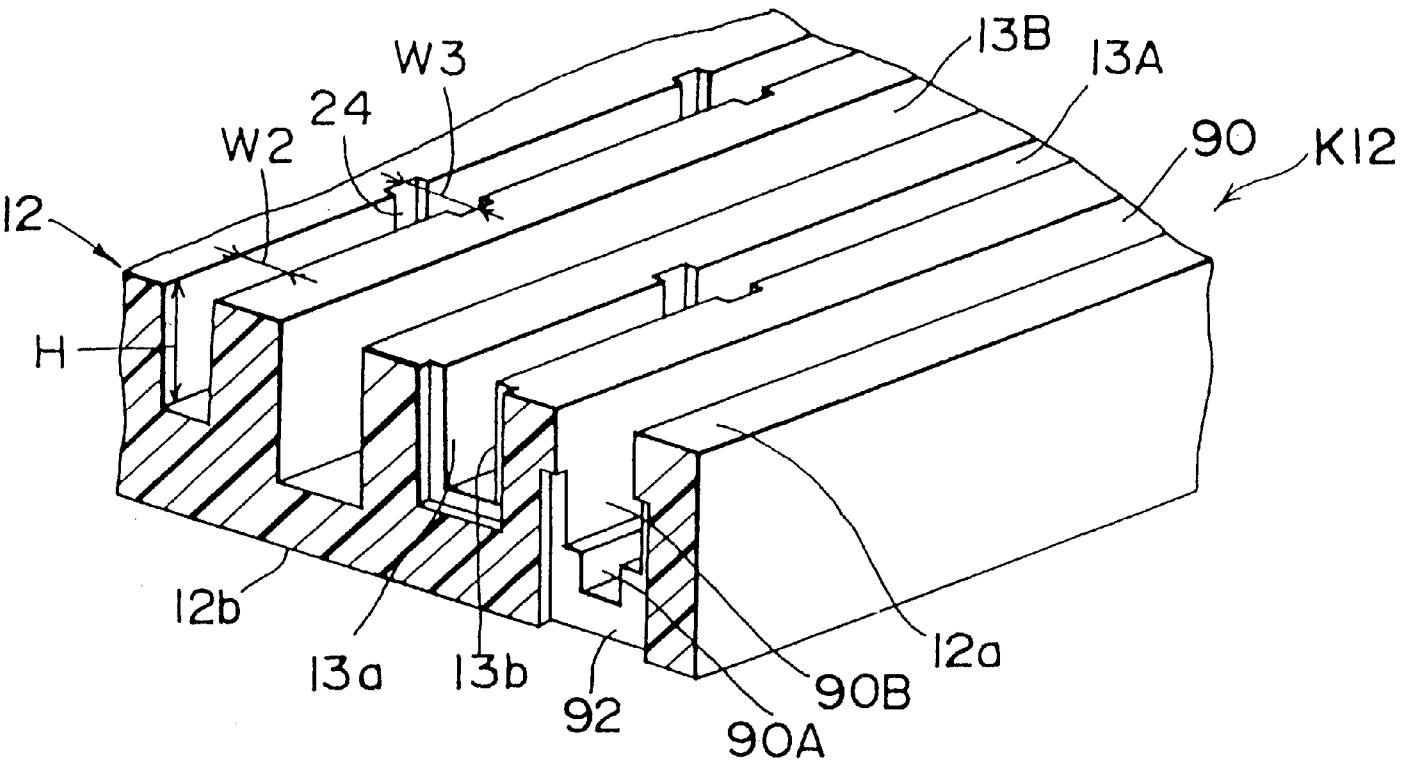
FIG. 40 is a fragmentary perspective view of the insulating plate of FIG. 39.

FIGS. 38 to 41 show an electrical connection box K12 according to a twelfth embodiment of the present invention. In the electrical connection box K12, the insulating plate 12 is gripped between the upper and lower casings 10 and 11. As shown in FIG. 40, a plurality of the wiring grooves 13A and 13B each having only one step as well as stepped wiring grooves 90 each having a plurality of steps are formed on the lower face 12*a* of the insulating plate 12 in accordance with a wiring pattern. The small-diameter wires 14 and/or the large-diameter wires iS are directly inserted into the wiring grooves 13A, 13B and 90 by the wire feeder. The pressing contact portions 16*a*, 17*a* and 91*a* of the pressing contact terminals 16, 17 and 91 are press fitted into the wiring grooves 13A, 13B and 90 so as to be brought into pressing contact with the wires 14 and 15 held in the wiring grooves 13A, 13B and 90 such that the input-output terminal portions 16*b*, 17*b* and 91*b* of the pressing contact terminals 16, 17 and 91 are projected out of the terminal holes 19 and 20 formed on the outer walls of the upper and lower casings 10 and 11, respectively.

The wiring groove 90 is formed into such a stepped shape that both of the wires 14 and 15 can be piled on each other in the wiring groove 90 in a direction of a thickness of the insulating plate 12. Thus, the wiring groove 90 includes a small groove portion 90A for receiving the small-diameter wire 14 and a large groove portion 90B for receiving the large-diameter wire 15. One end of the small groove portion 90A is formed continuously with the wiring groove 13A, while one end of the large groove portion 90B is formed continuously with the wiring groove 13B.

More specifically, the wiring groove 90 opens to the lower face 12*a* of the insulating plate 12. Thus, the lower face 12*a* of the insulating plate 12 is recessed to the large groove portion 90B and then, a middle portion of a bottom face of the large groove portion 90B is recessed to the small groove portion 90A. Widths of the small groove portion 90A and the large groove portion 90B are, respectively, set so as to be slightly smaller than the diameter W1 of each of the wires 14 and 15. Meanwhile, a depth of the large groove portion 90B is set so as to be about 1.5 times the diameter W1 of the wire 15, while a depth of the small groove portion 90A is set so as to be approximately equal to the diameter W1 of the wire 14. Meanwhile, a thickness of the insulating plate 12 is set so as to be larger than a whole depth of the wiring groove 90 extending from a bottom face of the small groove portion 90A to the lower face 12*a* of the insulating plate 12.

Meanwhile, at portions of the wiring groove 90 where both of the wires 14 and 15 are connected to the pressing contact terminal 91, opposed side faces 90*a* and 90*b* of the large groove portion 90B are recessed so as to form upwardly opening terminal driving portions 92. The terminal driving portion 92 extends from the upper face 12*b* of the insulating plate 12 to an intermediate location of the large groove portion 90B without reaching the lower face 12*a* of the insulating plate 12. The terminal driving portions 92 are formed at such locations as to confront the terminal holes 19 of the fuse fitting portion 21 of the upper casing 10.

Figure 41:
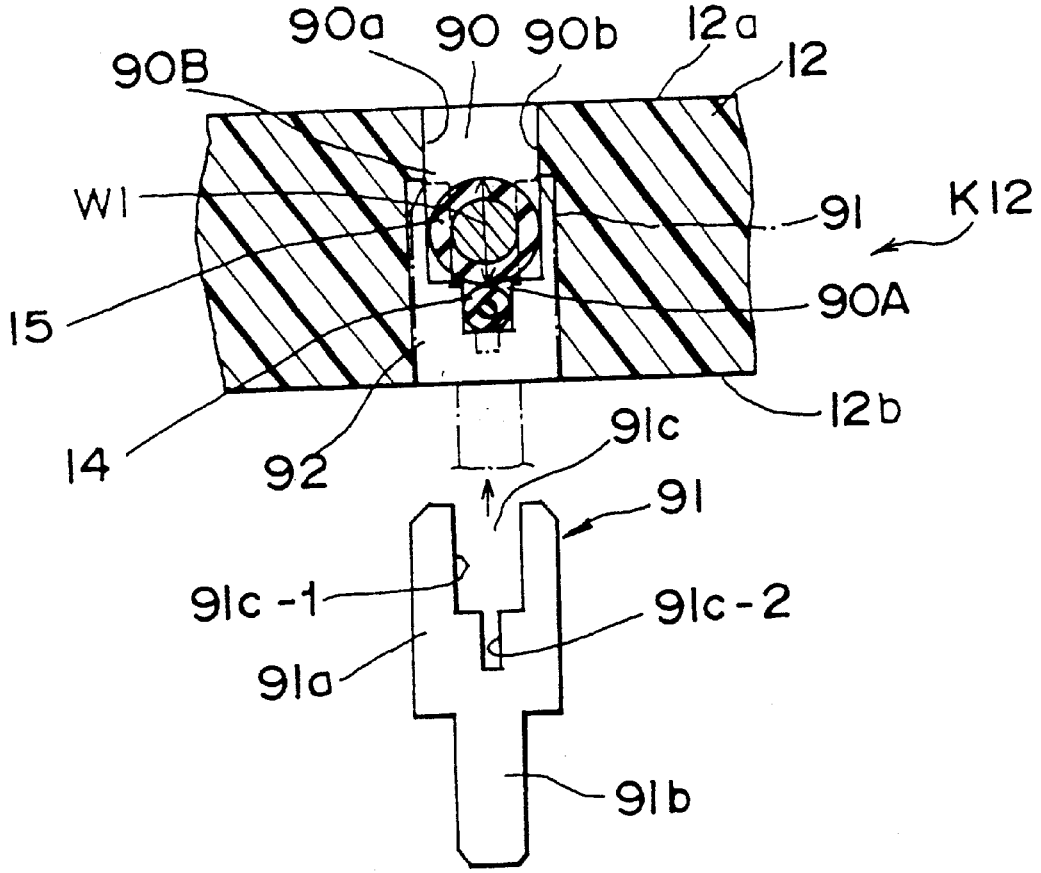
FIG. 41 is a sectional view showing insertion of a wire and a pressing contact terminal into the insulating plate of FIG. 39.

As shown in FIG. 41, the pressing contact terminal 91 is formed by an electrically conductive metal plate and has a male input-output terminal portion 91*b* and a bifurcate pressing contact portion 91*a* formed at one end and the other end of the pressing contact terminal 91, respectively. The pressing contact portion 91*a* has such a width as to be press fitted into the terminal driving portion 92. The pressing contact portion 91*a* is formed, at its central portion, with a two-step slot 91*c*. A large slot portion 91*c*-1 for receiving the large-diameter wire 15 is formed at an inlet of the slot 91*c* so as to have a width substantially equal to the diameter of the conductor of the wire 15, while a small slot portion 91*c*-2 for receiving the small-diameter wire 14 is formed at a bottom of the slot 91*c* so as to have a width substantially equal to the diameter of the conductor of the wire 14. Since other constructions of the electrical connection box K12 are similar to those of the electrical connection box K1, the description is abbreviated for the sake of brevity.

Hereinafter, a method of assembling the electrical connection box K12 of the above described arrangement is described. Initially, the insulating plate 12 is turned upside down such that the lower face 12*a* of the insulating plate 12 is oriented upwardly. Then, the small-diameter wire 14 is fed by the automatic feeder so as to be directly inserted into the wiring groove 13A or the small groove portion 90A of the wiring groove 90. At this time, the wire 14 is press fitted into the wiring groove 13A or the small groove portion 90A, which has the width slightly smaller than the diameter of the wire 14. Therefore, even if the wire 14 inserted into the wiring groove 13A or the small groove portion 90A has a tendency to wind, the wire 14 can be positively held in the wiring groove 13A or the small groove portion 90A without moving away from the bottom of the wiring groove 13A or the small groove portion 90A.

Subsequently, the large-diameter wire 15 is fed by the wire feeder so as to be directly inserted into the wiring groove 13B or the large groove portion 90B of the wiring groove 90. Since the depths of the wiring groove 13B and the large groove portion 90B are made large and the widths of the wiring groove 13B and the large groove portion 90B are made small, the wire 15 is press fitted into the wiring groove 13B or the large groove portion 90B without moving away from the bottom of the wiring groove 13B or the large groove portion 90B. Since the insulating plate 12 has a shape of a flat plate free from projections, the wires 14 and 15 can be stably inserted into the wiring grooves 13A and 13B and the small groove portion 90A and the large groove portion 90B of the wiring groove 90, respectively. In this state, the wires 14 and 15 are piled on each other in the wiring groove 90 in the direction of the thickness of the insulating plate 12.

Figure 38:
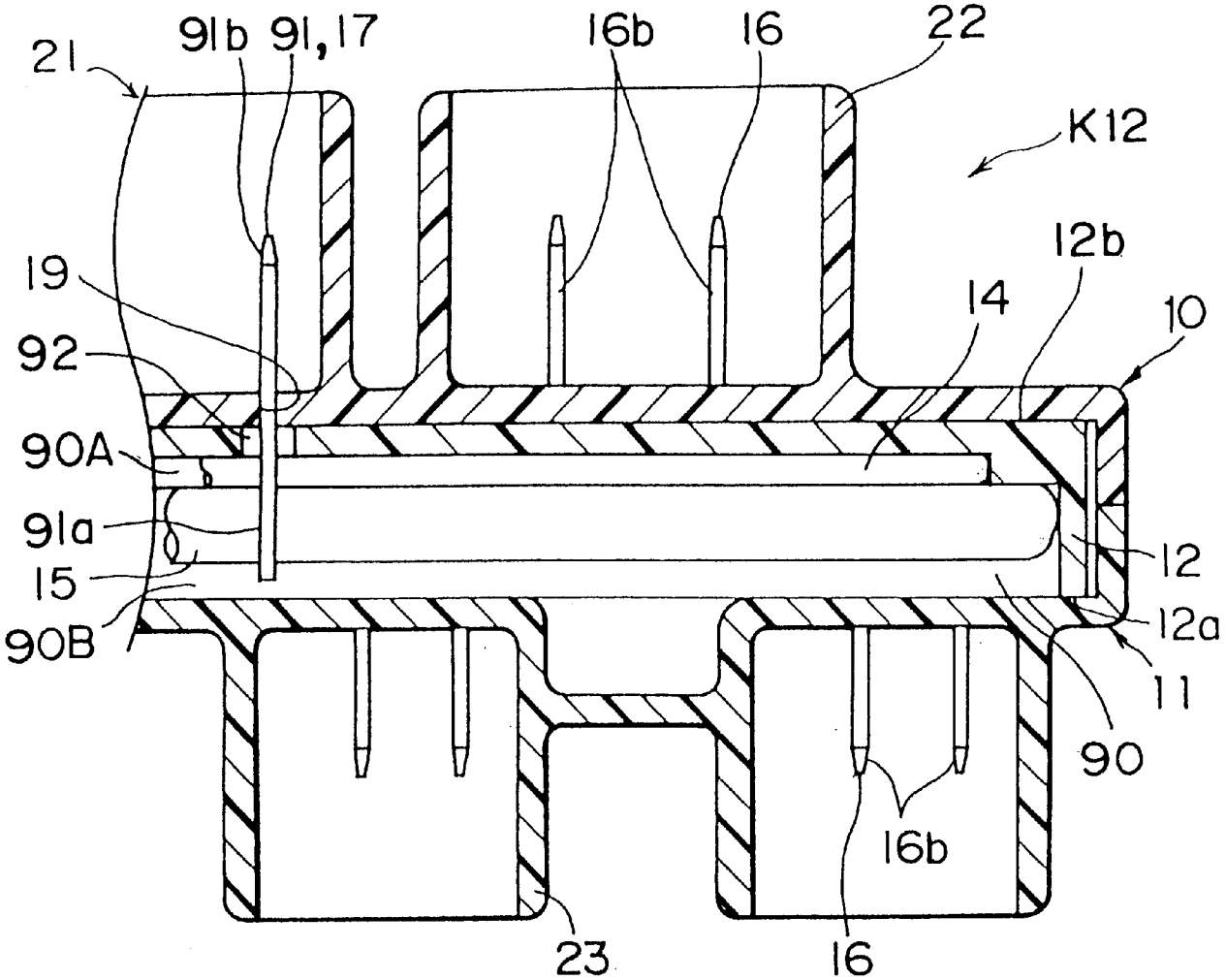
FIG. 38 is a fragmentary sectional view of an electrical connection box according to a twelfth embodiment of the present invention.
Figure 39:
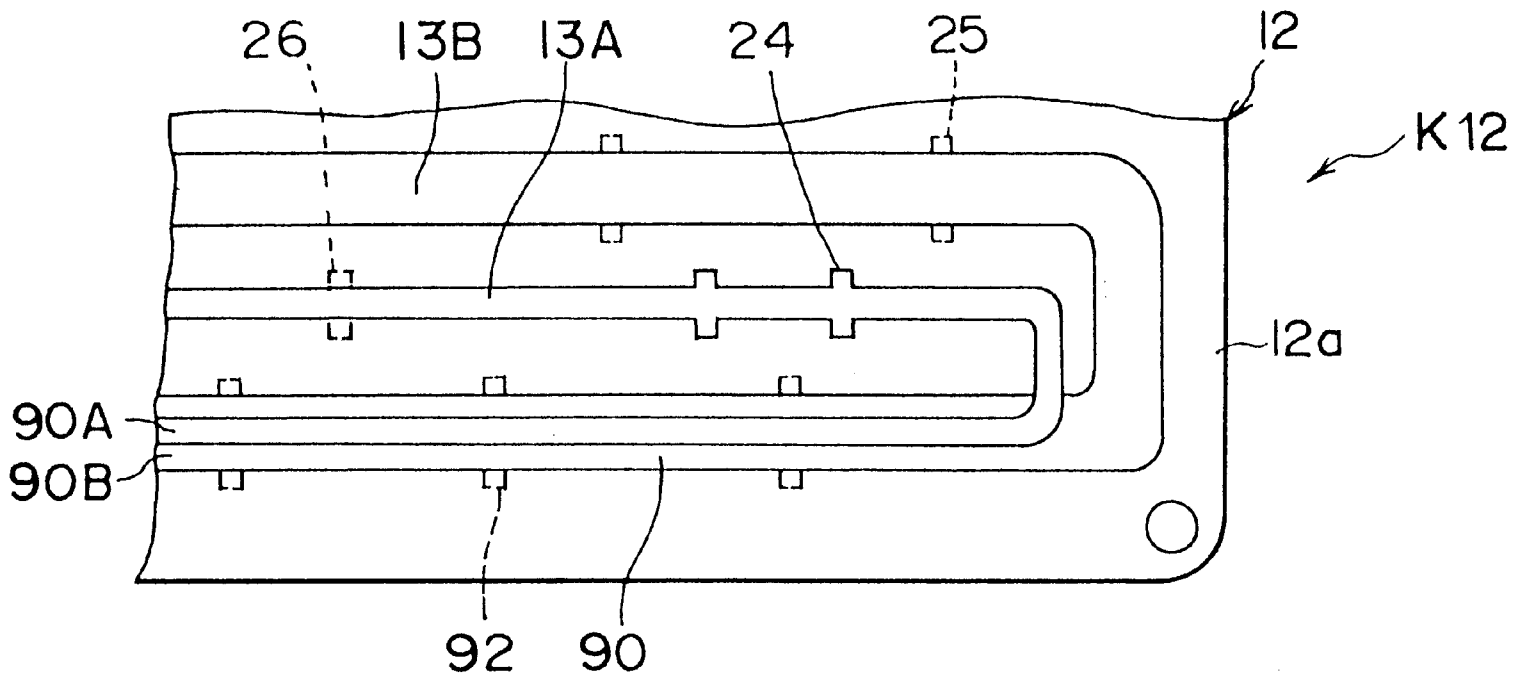
FIG. 39 is fragmentary bottom plan view of a n insulating plate of the electrical connection box of FIG. 38.

Referring to FIG. 38, after the wires 14 and 15 have been laid in the wiring grooves 13 and 90, the pressing contact terminals 16 are press fitted into the terminal driving portions 24 initially. At this time, the opposite side edges of the slot 16*c* of the pressing contact terminal 16 grip the wire 14 therebetween so as to be thrust into the insulating coating of the wire 14. By this pressing contact step, the pressing contact terminal 16 not only is electrically connected to the conductor of the wire 14 but is secured to the insulating plate 12 such that the input-output terminal portion 16*b* of the pressing contact terminal 16 projects out of the lower face 12*a* of the insulating plate 12.

Thereafter, the insulating plate 13 is over-turned such that the upper face 12*b* of the insulating plate 12 is oriented upwardly. Then, the pressing contact terminals 16, 17 and 91 are press fitted into the terminal driving portions 26, 25 and 92, respectively. By press fitting of the pressing contact terminal 16 into the terminal driving portion 26, the pressing contact terminal 16 not only is electrically connected to the wire 14 but is secured to the insulating plate 12 such that the input-output terminal portion 16*b* of the pressing contact terminal 16 projects out of the upper face 12*b* of the insulating plate 12. Likewise, the pressing contact terminal 17 not only is electrically connected to the wire 15 but is secured to the insulating plate 12 such that the input-output terminal portion 17*b* of the pressing contact terminal 17 projects out of the upper face 12*b* of the insulating plate 12.

Meanwhile, by press fitting of the pressing contact terminal 91 into the terminal driving portion 92, the pressing contact terminal 91 not only is electrically connected to the ,wires 14 and 15 but is secured to the insulating plate 12 such that the input-output terminal portion 91*b* of the pressing contact terminal 91 projects out of the upper face 12*b* of the insulating plate 12. Namely, the pressing contact portion 91*a* of the pressing contact terminal 91 is caused to confront a mouth of the terminal driving portion 92 and then, is press fitted into the terminal driving portion 92. Thus, the large slot portion 91*c*-1 of the pressing contact terminal 91 is thrust into the insulating coating of the wire 15 and the small slot portion 91*c*-2 of the pressing contact terminal 91 is thrust into the insulating coating of the wire 14. Therefore, the large slot portion 91*c*-1 and the small slot portion 91*c*-2 of the pressing contact terminal 91*c* are, respectively, electrically connected to the conductors of the wires 15 and 14. Accordingly, the wires 14 and 15 are electrically connected to each other through the pressing contact terminal 91.

In a state where the pressing contact terminals 16, 17 and 91 have been, respectively, connected, through pressing contact, to the wires 14 and 15 laid in the wiring grooves 13A, 13B and 90 of the insulating plate 12 as described above, the upper and lower casings 10 and 11 are not mounted on the upper and lower faces 12*b* and 12*a* of the insulating plate 12 and thus, it is possible to check whether or not the pressing contact terminals 16, 17 and 91 are held in pressing contact with the wires 14 and 15 properly.

Then, the upper and lower casings 10 and 11 are assembled with each other so as to grip the insulating plate 12 therebetween. At this time, not only the input-output terminal portions 17*b* and 91*b* of the pressing contact terminals 17 and 91 connected to the large-diameter wires 15 are projected out of the terminal holes 19 of the fuse fitting portion 21 of the upper casing 10 but the input-output terminal portions 16*b* of the pressing contact terminals 16 connected to the small-diameter wires 14 are projected out of the terminal holes 19 of the connector portion 22 of the upper casing 10. Meanwhile, the input-output terminal portions 16*b* of the pressing contact terminals 16 connected to the small-diameter wires 14 are projected out of the terminal holes 20 of the connector portions 23 of the lower casing 11.

An internal circuit of the electrical connection box K12 assembled as described above is constituted by only the small-diameter wires 14, the large-diameter wires 15 and the pressing contact terminals 16, 17 and 91 connected to the wires 14 and 15. Namely, a power source circuit of the internal circuit is constituted by the large-diameter wires 15 and the pressing contact terminals 17 and 91 connected to the wires 15 through pressing contact such that the input-output terminal portions 17*b* and 91*b* of the pressing contact terminals 17 and 91 are connected to the fuses 40 (FIG. 7) attached to the fuse fitting portion 21. On the other hand, a load circuit of the internal circuit is constituted by the small-diameter wires 14 and the pressing contact terminals 16 connected to the wires 14 through pressing contact such that the input-output terminal portions 16*b* of the pressing contact terminals 16 are connected to connectors fitted into the connector portions 22 and 23.

Since the electrical circuit of the electrical connection box K12 of the present invention is constituted by only the wires and the pressing contact terminals without using bus bars as described above, it is possible to cope with design changes of the internal circuit easily. Meanwhile, since the stepped wiring grooves 90 each having the small groove portion 90A for receiving the small-diameter wire 14 and the large groove portion 90B for receiving the large-diameter wire 15 are formed on the insulating plate 12, the small-diameter wire 14 and the large-diameter wire 15 are inserted into the small groove portion 90A and the large groove portion 90B, respectively such that the large-diameter wire 15 is placed on the small-diameter wire 14. Therefore, even if the small-diameter wires 14 and the large-diameter wires 15 are used mixedly in the electrical connection box K12, area required for laying the wires 14 and 15 can be lessened and thus, the electrical connection box K12 is made compact in size. Furthermore, since the wires 14 and 15 can be connected to each other by a single pressing contact step, the number of operational steps can be reduced.

Figure 42:
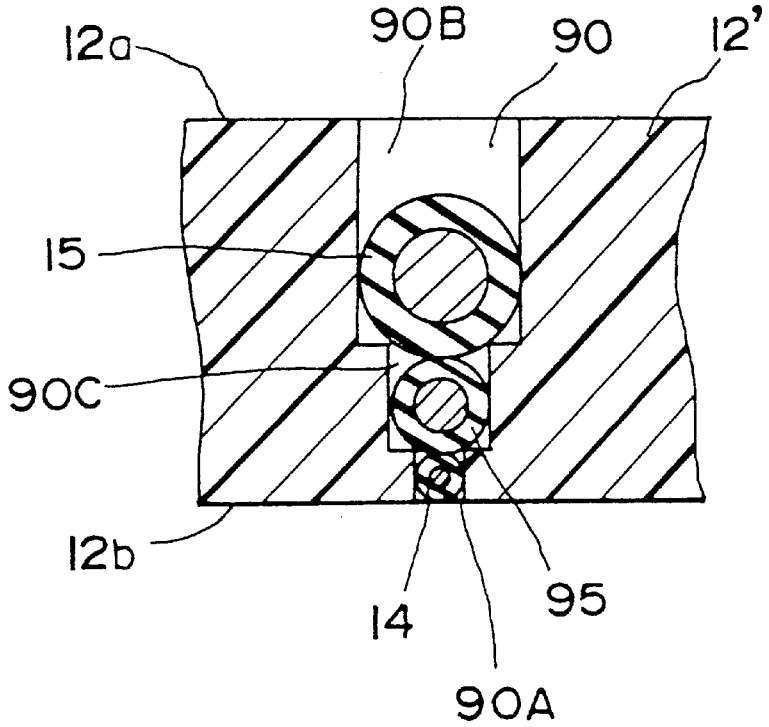
FIGS. 42, 43 and 44 are fragmentary sectional views of insulating plates which are first, second and third modifications of the insulating plate of FIG. 39, respectively.

FIG. 42 shows an insulating plate 12' which is a first modification of the insulating plate 12 of the electrical connection box K12. The insulating plate 12' is arranged to receive three kinds of wires, namely, the small-diameter wires 14 for a load circuit, intermediate-diameter wires 95 for the load circuit and the large-diameter wires 15 for a power source circuit. The wiring groove 90 is formed into a three-step shape on the lower face 12*a* of the insulating plate 12 and includes, sequentially from the lower face 12*a* of the insulating plate 12, the large groove portion 90B for receiving the large-diameter wire 15, a middle groove portion 90C for receiving the intermediate-diameter wire 95 and the small groove portion 90A for receiving the small-diameter wire 14. The middle groove portion 90C is formed at a middle portion of a bottom face of the large groove portion 90B, while the small groove portion 90A is formed at a middle portion of a bottom face of the middle groove portion 90C. A depth of the wiring groove 90 formed by the groove portions 90B, 90C and 90A is set so as to be equal to a thickness of the insulating plate 12 such that the small groove portion 90A opens to the upper face 12*b* of the insulating plate 12.

By using the insulating plate 12' having the wiring grooves 90 for receiving three kinds of the wires, i.e., the wires 14, 15 and 95 of three different diameters, area required for laying the wires 14, 15 and 95 can be lessened and thus, the electrical connection box can be made compact in size.

Figure 43:
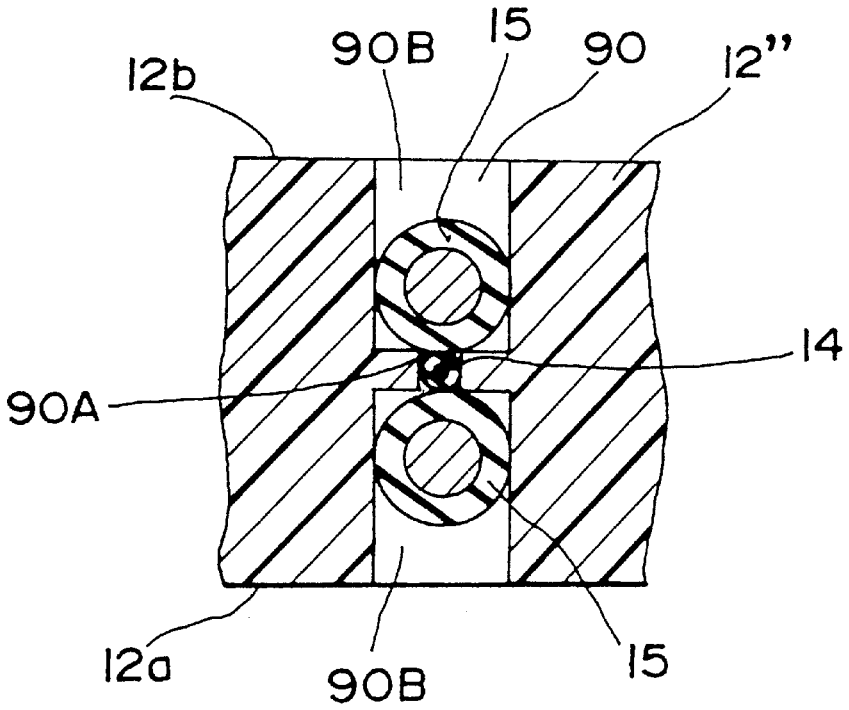

FIG. 43 shows an insulating plate 12" which a second modification of, the insulating plate 12 of the electrical connection box K12. The large groove portion 90B is formed on each of the upper and lower faces 12*b* and 12*a* of the insulating plate 12 and the small groove portion 90A is formed at a central portion of the insulating plate 12 in a direction of a thickness of the insulating plate 12 so as to be communicated with the opposite large groove portions 90B such that the wiring groove 90 has a three-step shape.

Figure 44:
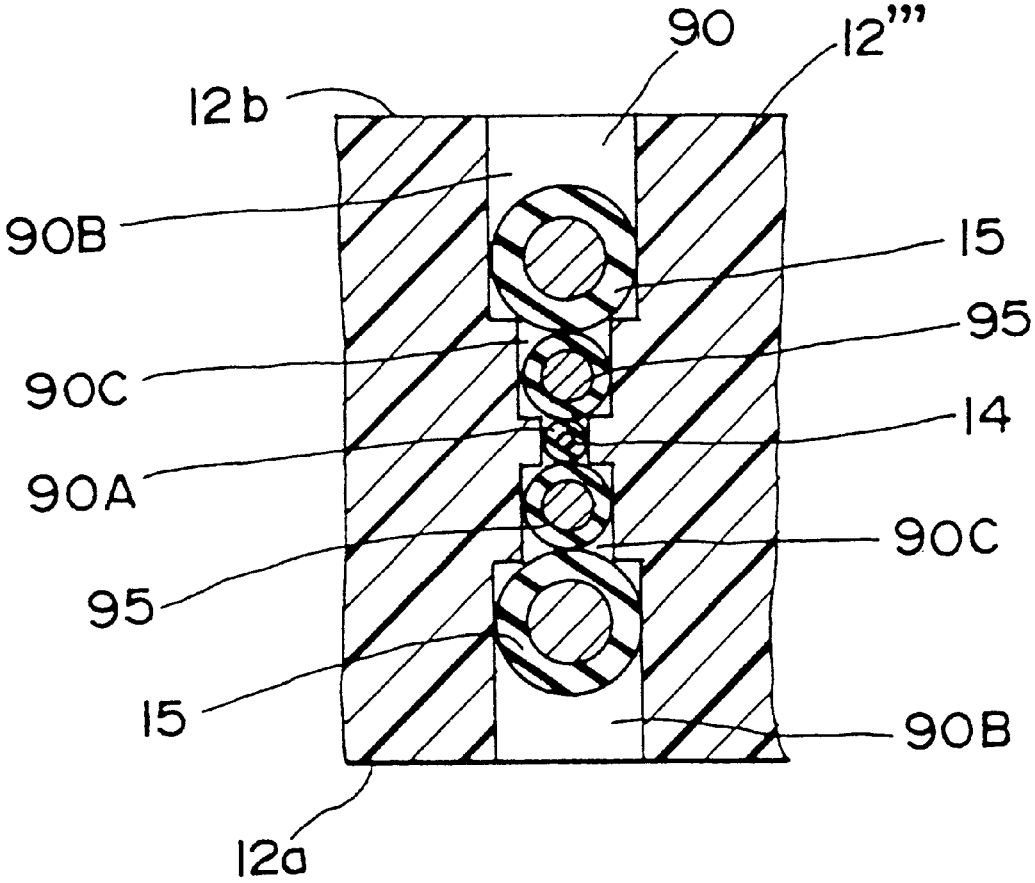

FIG. 44 shows an insulating plate 12'" which is a third modification of the insulating plate 12 of the electrical connection box K12. The middle groove portion 90C and the large groove portion 90B are formed on each of the upper and lower faces 12*b* and 12*a* of the insulating plate 12 and the small groove portion 90A is formed at a central portion of the insulating plate 12 in a direction of a thickness of the insulating plate 12 so as to be communicated with the opposite middle groove portion 90C such that the wiring groove 90 has a five-step shape.

In the insulating plates 12" and 12'", the pressing contact terminals are not brought into pressing contact with the intermediate-diameter wires 95 and/or the small-diameter wires 14, which are disposed at the central portion of the insulating plate 12, so as to be brought into pressing contact with the large-diameter wires 15 disposed outside the intermediate-diameter wires 95 and/or the small-diameter wires 14. If the wiring grooves are formed on the insulating plate as shown in FIGS. 43 and 44, area required for laying the wires can be further reduced as compared with the arrangements of FIGS. 41 and 42 and thus, the electrical connection box as a whole can be made compact in size.

Meanwhile, the present invention is not restricted to the above described arrangements. For example, the wiring grooves 13A, 13B and 90 are formed on the lower face 12*a* of the insulating plate 12 but may be formed on the upper face 12*b* of the insulating plate 12 or may also be formed on the upper and lower faces 12*b* and 12*a* of the insulating plate 12 mixedly.

In the electrical connection box K12, since the insulating plate has the stepped wiring groove in which the small groove portion is formed on the bottom face of the large groove portion formed on one face of the insulating plate, the wires having different diameters can be laid in the insulating plate so as to be piled on each other in the direction of the thickness of the insulating plate. Therefore, such a conventional problem can be prevented that an insulating plate in which the wires having different diameters are laid becomes large in size.

Meanwhile, since the stepped wiring grooves 90 and the wiring grooves 13A and 13B are formed to the predetermined depths, the small-diameter wires and the large-diameter wires can be directly laid in these wiring grooves. Thus, a hitherto necessary wiring die is not required to be used and thus, production cost of the electrical connection box K12 can be lowered. Furthermore, since surface of the insulating plate is free from projections, laying the wires in the insulating plate and bringing the pressing contact terminals into pressing contact with the wires in the insulating plate can be performed stably.

Furthermore, in the stepped wiring groove of the insulating plate, the terminal driving portion is formed such that the pressing contact terminal is press fitted into the terminal driving portion from one face of the insulating plate adjacent to the small groove portion. In addition, the slot of the pressing contact terminal for the stepped wiring groove is formed into a stepped shape. Therefore, by a single pressing contact step, the pressing contact terminal can be electrically connected to the wires piled on each other in the insulating plate. Accordingly, in case the power source circuit and the load circuit are connected to each other, the number of operational steps can be lessened and thus, operating efficiency is raised.

It is possible to easily cope with design changes of the load circuit and the power source circuit by changing positions for bringing the pressing contact terminals into pressing contact with the small-diameter and large-diameter wires laid in the wiring grooves 13A and 13B.

Figure 45:
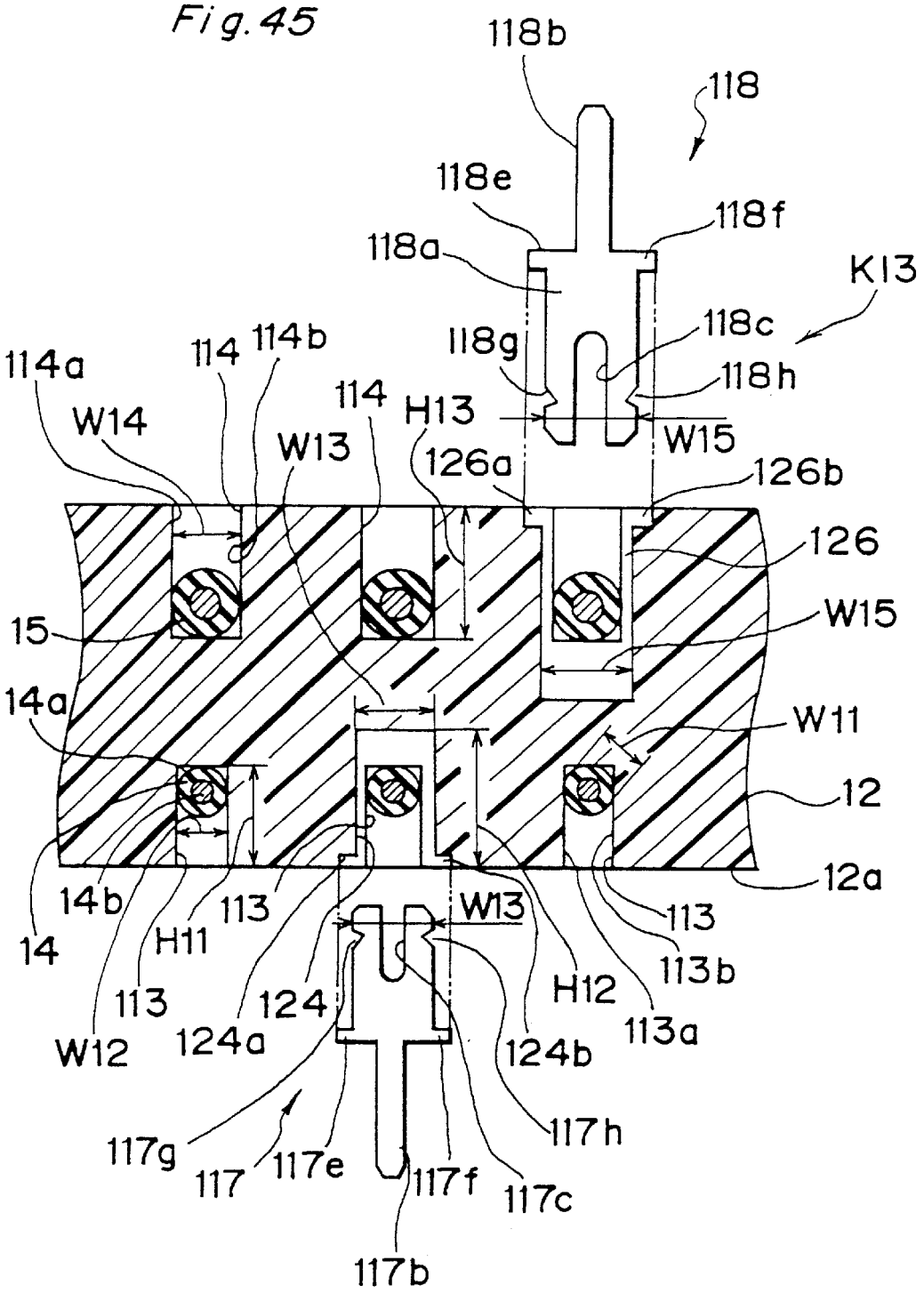
FIG. 45 is a fragmentary sectional view showing relation among an insulating plate, wires and pressing contact terminals in an electrical connection box according to a thirteenth embodiment of the present invention.
Figure 46:
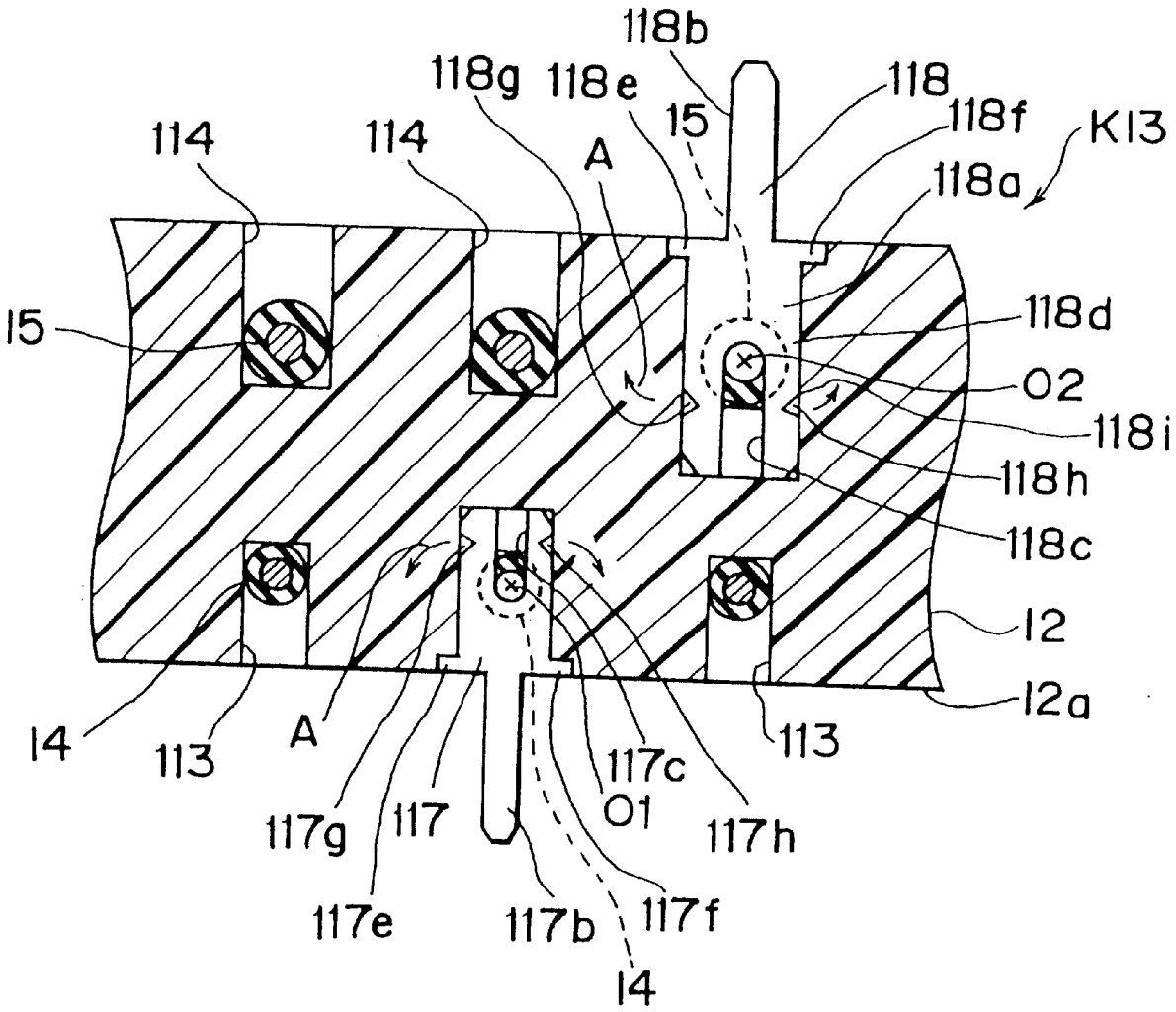
FIG. 46 is a fragmentary sectional view showing insertion of the wires and the pressing contact terminals into the insulating plate of FIG. 45.
Figure 47:
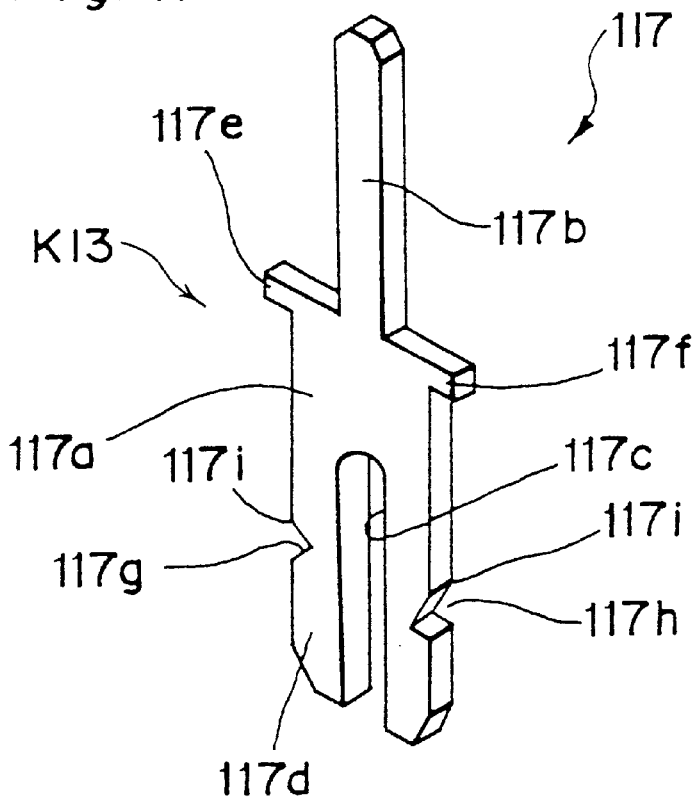
FIG. 47 is a perspective view of the pressing contact terminal of FIG. 45.

FIGS. 45 to 47 show the insulating plate 12 of an electrical connection box K13 according to a thirteenth embodiment of the present invention. The electrical connection box K13 is structurally similar to the electrical connection box K10. Therefore, only differences between the electrical connection box K13 and K10 are described, hereinafter. In the electrical connection box K13, a pressing contact terminal 117 which is brought into pressing contact with the small-diameter wire 14 is formed by an electrically conductive metal plate. As best shown in FIG. 47, a male type input-output terminal portion 117*b* is provided at one end of a rectangular base portion 117*a*, while a pressing contact portion 117*d* bifurcated by a slot 117*c* formed at its central portion is provided at the other end of the base portion 117*a*. A width of the pressing contact portion 117*d* is set so as to be equal to a width W13 of a terminal driving portion 124 for receiving the pressing contact terminal 117. Rectangular positioning ribs 117*e* and 117*f* project from opposite sides of the base portion 117*a* at a portion of the base portion 117*a* adjacent to the input-output terminal portion 117*b*, respectively. Furthermore, triangular notches 117*g* and 117*h* are, respectively, formed on opposite sides of the pressing contact portion 117*d*. When the pressing contact terminal 117 has been press fitted into the terminal driving portion 124 as shown in FIG. 46, the notches 117*g* and 117*h* are disposed above a center O1 of the wire 14 towards the bottom face of a first wiring groove 113 for receiving the wire 14.

A pressing contact terminal 118 which is brought into pressing contact with the large-diameter wire 15 has a shape similar to that of the pressing contact terminal 117 referred to above. Namely, an input-output terminal portion 118*b* is provided at one end of a base portion 118*a*, while a pressing contact portion 118*d* bifurcated by a slot 118*c* formed at its central portion is provided at the other end of the base portion 118*a*. The pressing contact terminal 118 further has positioning ribs 118*e* and 118*f* and notches 118*g* and 118*h*. Meanwhile, when the pressing contact terminal 118 has been press fitted into a terminal driving portion 126 as shown in FIG. 46, the notches 118*g* and 118*h* are disposed below a center O2 of the wire 15 towards the bottom face of a second wiring groove 114 for receiving the wire 15. Furthermore, a width of the pressing contact portion 118*d* of the pressing contact terminal 118 is set so as to equal to a width W15 of the terminal driving portion 126. The pressing contact portions 117*a* and 118*a* of the pressing contact terminals 117 and 118 are arranged to be press fitted into the terminal driving portions 124 and 77 (FIG. 31) and the terminal driving portions 126, respectively.

Hereinafter, a method of assembling the electrical connection box K13 of the above described arrangement is described. Initially, the insulating plate 12 is turned upside down such that the lower face 12*a* of the insulating plate 12 is oriented upwardly. Then, the wire 14 is fed by the automatic feeder so as to be directly inserted into the first wiring groove 113. At this time, since a height Hll of the first wiring groove 113 is set so as to be twice or more a diameter W11 of the wire 14 and a width W12 of the first wiring groove 113 is set so as to be slightly smaller than the diameter W11 of the wire 14, the wire 14 can be positively held in the first wiring groove 113 without moving away from the bottom of the wiring groove 113 even if the wire 14 has a tendency to wind.

Subsequently, the insulating plate 12 is over-turned such that the upper face 12*b* of the insulating plate 12 is oriented upwardly. Then, the wire 15 is fed by the wire feeder so as to be directly inserted into the second wiring groove 114. Since the wire 15 is also press fitted into the second wiring groove 114 by setting depth and width of the second wiring groove 114 large and small, respectively, the wire 15 can also be held in the second wiring groove 114 without moving away from the bottom of the second wiring groove 114. Meanwhile, since the number of uneven portions of the insulating plate 12 is small, the wires 14 and 15 can be stably inserted into the first and second wiring grooves 113 and 114, respectively.

Thereafter, the lower face 12*a* of the insulating plate 12 is oriented upwardly. Then, the pressing contact terminal 117 is press fitted into the terminal driving portion 124. As the pressing contact portion 117*d* of the pressing contact terminal 117 is further press fitted into the terminal driving portion 124, the wire 14 is depressed into the slot 117*c* and thus, the pressing contact portion 11*d* is thrust into the insulating coating 14*a* of the wire 14 so as to be brought into contact with the conductor 14*b* of the wire 14.

At this time, as the wire 14 is further depressed into the slot 117*c*, the pressing contact portion 117*d* is urged to expand outwardly as shown by the arrows A in FIG. 46. However, since the terminal driving portion 124 and the pressing contact portion 117*d* have the identical width W13 as described above, edges 117*i* of the notches 117*g* and 117*h* bite into opposed side faces 113*a* and 113*b* of the first wiring groove 113. As a result, when the pressing contact-terminal 117 has been press fitted into the terminal driving portion 124, the pressing contact terminal 117 is firmly held in the terminal driving portion 124. Meanwhile, since the positioning ribs 117*e* and 117*f* of the pressing contact terminal 117 are, respectively, received by wide portions 124*a* and 124*b* of the terminal driving portion 124, the pressing contact terminal 117 is positioned accurately in a direction of its press fitting. Thus, in the electrical connection box K13, the pressing contact terminal 117 is mounted on the insulating plate 12 simultaneously with electrical connection between the pressing contact terminal 117 and the wire 14.

Likewise, the upper face 12*b* of the insulating plate 12 is oriented upwardly and the pressing contact terminal 118 is press fitted into the terminal driving portion 126 such that the pressing contact terminal 118 is mounted on the insulating plate 12 concurrently with electrical connection between the pressing contact terminal 118 and the wire 15. Also at this time, as the wire 15 is further depressed into the slot 118*c*, the pressing contact portion 118*d* is urged to expand as shown by the arrows A in FIG. 46 and thus, edges 118*i* of the notches 118*g* and 118*h* of the pressing contact terminal 118 bite into opposed side faces 114*a* and 114*b* of the second wiring groove 114. Accordingly, when the pressing contact terminal 118 has been press fitted into the terminal driving portion 126, the pressing contact terminal 118 is firmly held in the terminal driving portion 126. Meanwhile, since the positioning ribs 118*e* and 118*f* of the pressing contact terminal 118 are, respectively, received by wide portions 126*a* and 126*b* of the terminal driving portion 126, the pressing contact terminal 118 is positioned accurately in a direction of its press fitting.

In the electrical connection box K13, the wires are laid in the wiring grooves provided on the insulating plate and then, the pressing contact terminals are connected to the wires through pressing contact by depressing the pressing contact terminals against the wires. However, the present invention may also be applied to a case in which the pressing contact terminals are preliminarily mounted on the upper casing or the lower casing. In this case, when the wires are press fitted into the pressing contact terminals, the notches of the pressing contact terminals expand such that the edges of the notches bite into wall surfaces of the casing and thus, the pressing contact terminals can be secured to the casing firmly.

As is clear from the foregoing description of the electrical connection box K13, the notches are formed on the opposite sides of the pressing contact portion of the pressing contact terminal. Therefore, if the notches expand outwardly when the pressing contact terminals is brought into pressing contact with the wire, the edges of the notches of the pressing contact terminal bite into a member for mounting the pressing contact terminal thereon, such as the insulating plate and the casing and thus, the pressing contact terminal is positively secured to the member. As a result, even if dimensional accuracy of the pressing contact terminal and the wiring groove for receiving the pressing contact terminal is relatively low, the pressing contact terminal can be secured to the member firmly. Furthermore, by merely driving the pressing contact terminal into the terminal driving portion or pressing fitting the wire into the pressing contact terminal, the pressing contact terminal can be secured to the member.

Meanwhile, in the electrical connection box K13, the pressing contact terminal has the positioning ribs in addition to the notches. Therefore, when the pressing contact terminal is driven into the terminal driving portion, the pressing contact terminal can be held at a predetermined position and thus, positional accuracy of the pressing contact terminal relative to the member for mounting the pressing contact terminal thereon is improved. As a result, the input-output terminal portion of the pressing contact terminal can be positively set at a predetermined position.

Figure 48:
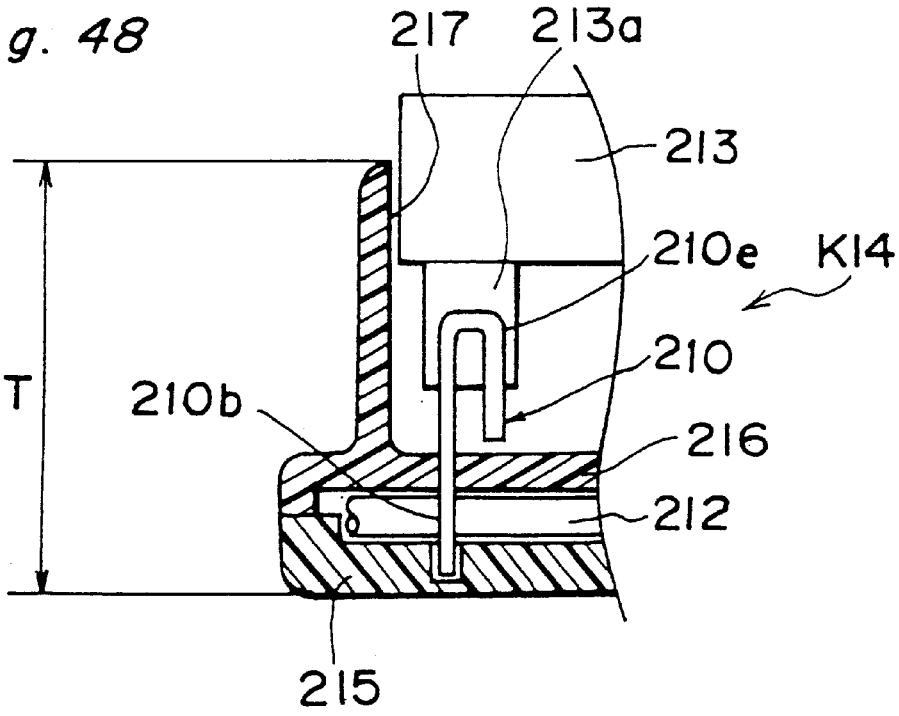
FIG. 48 is a fragmentary sectional view of an electrical connection box according to a fourteenth embodiment of the present invention.
Figure 50:
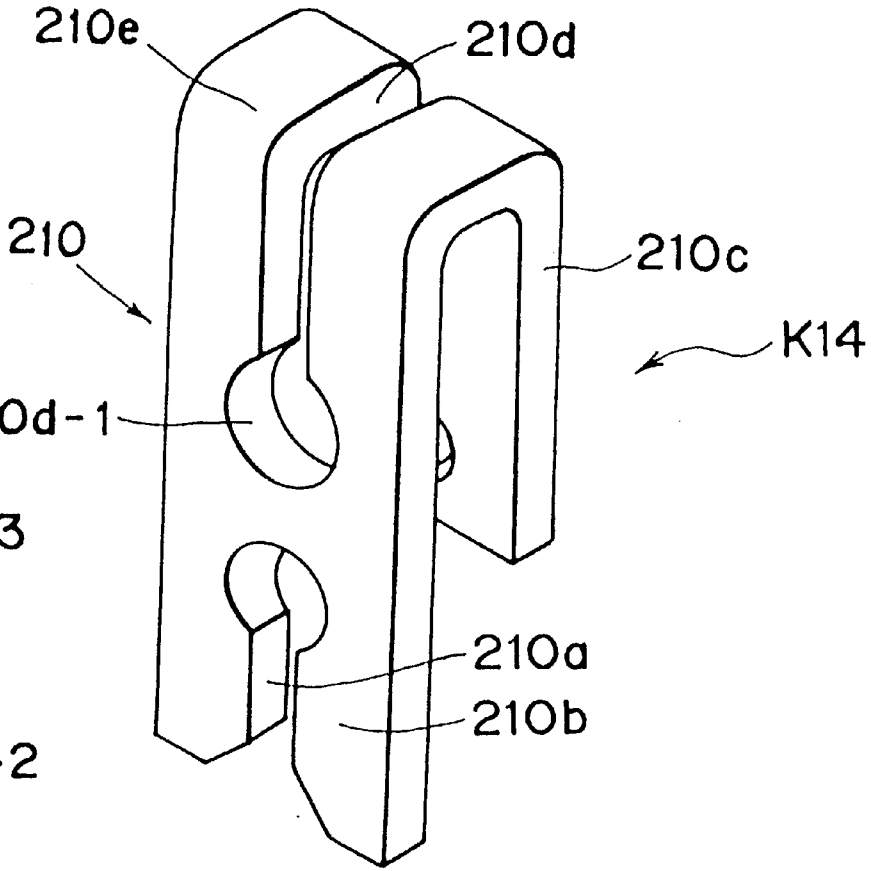
FIG. 50 is a rear perspective view of the pressing contact terminal of FIG. 49.
Figure 49:
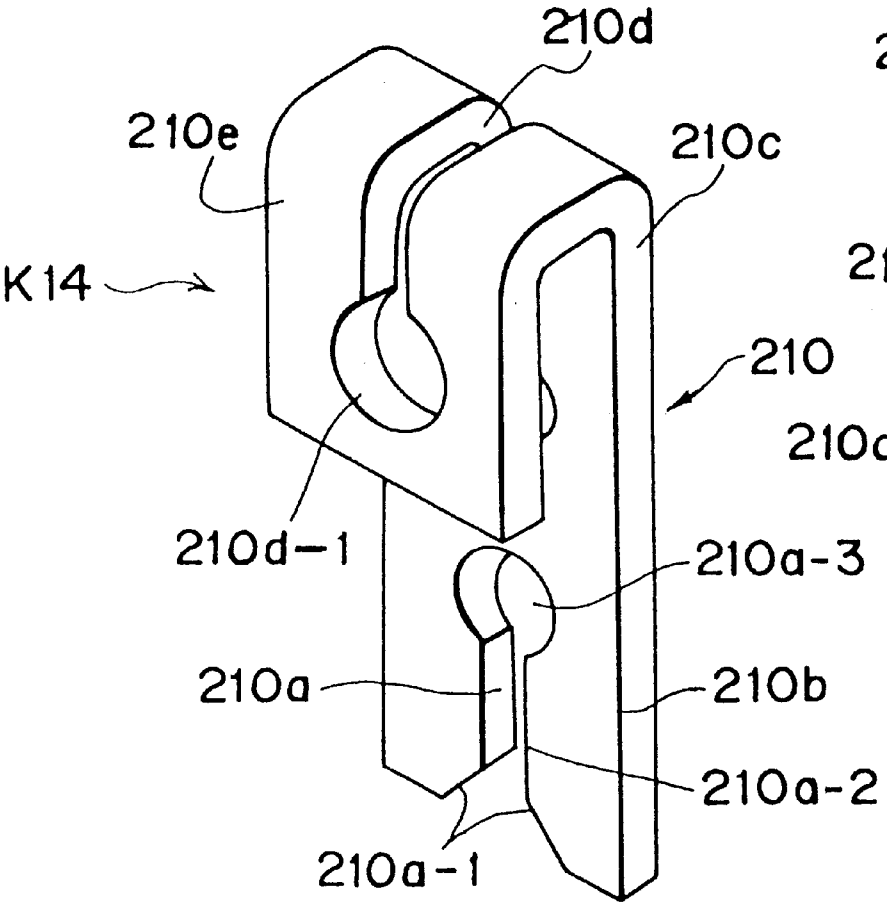
FIG. 49 is a front perspective view of a pressing contact terminal of the electrical connection box of FIG. 48.
Figure 52:
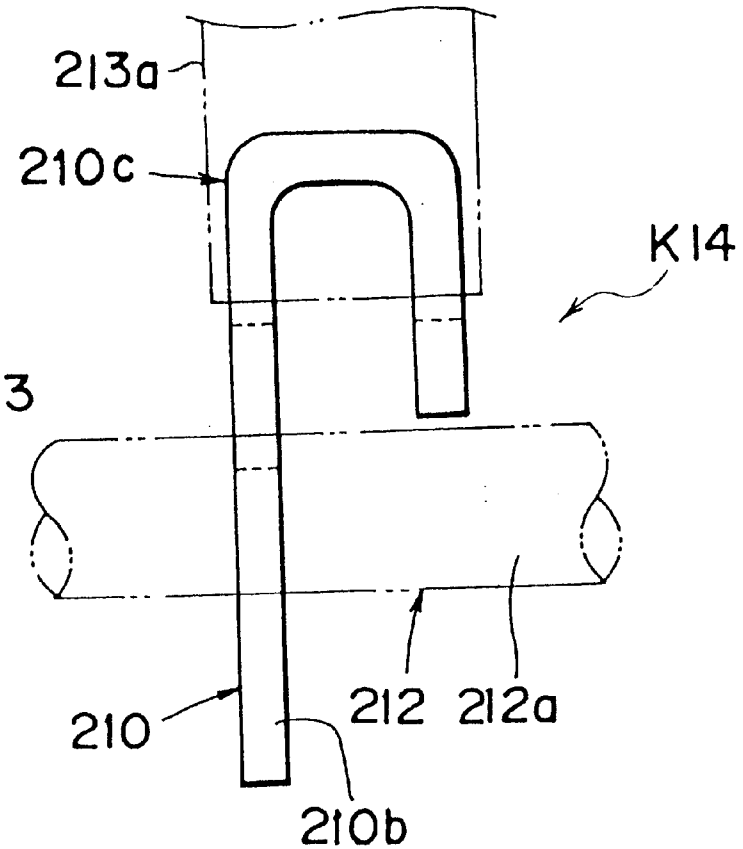
FIGS. 51, 52 and 53 are a front elevational view, a side elevational view and a top plan view showing relation among the pressing contact terminal of FIG. 49, a wire and a male terminal, respectively.
Figure 51:
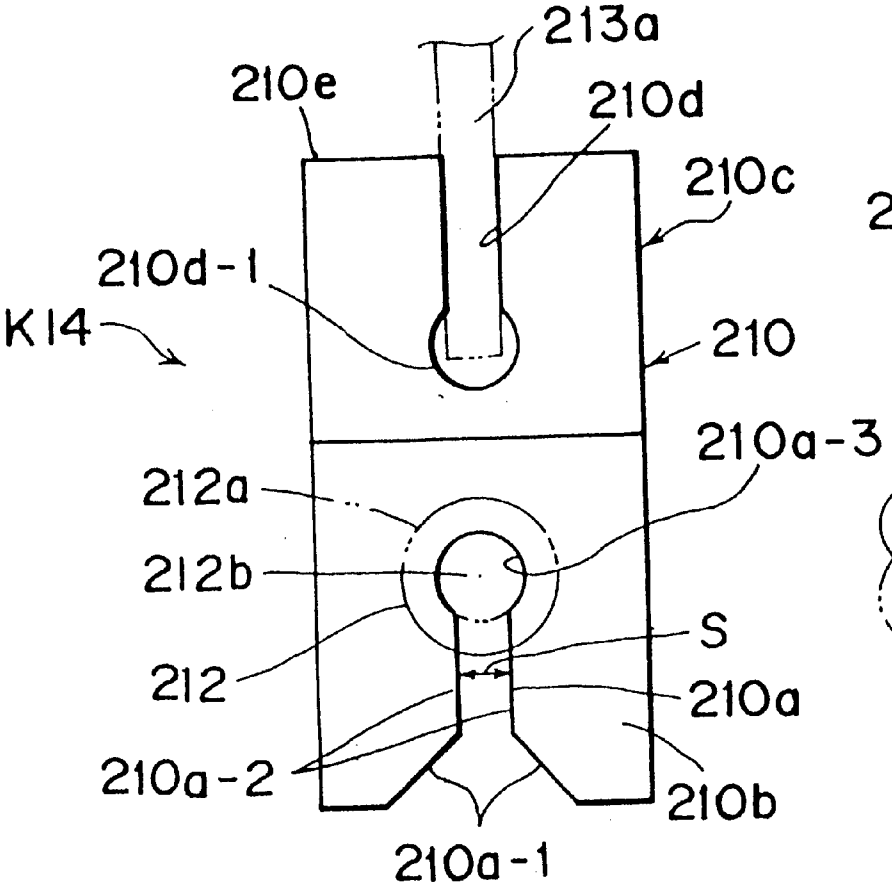
Figure 53:
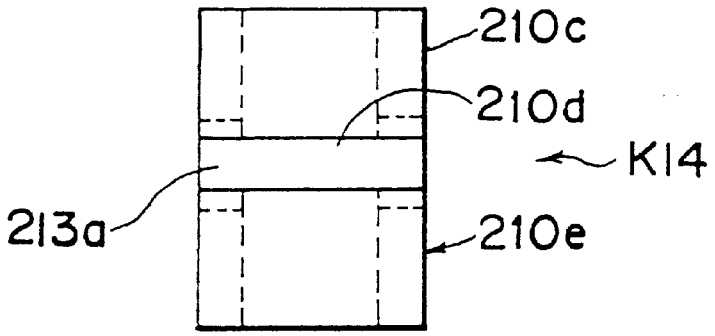

FIG. 48 shows an electrical connection box K14 according to a fourteenth embodiment of the present invention. The electrical connection box K14 includes a lower casing 215, an upper casing 216 and a pressing contact terminal 210. A wire 212 laid in the electrical connection box K14 and a fuse 213 attached to a fuse receiver 217 provided on an outer surface of the electrical connection box K14 are directly connected to each other by the pressing contact terminal 210.

The pressing contact terminal 210 is formed by blanking an electrically conductive metal plate and then, bending the metal plate as shown in FIGS. 49 to 53. In this embodiment, the pressing contact terminal 210 has a thickness of 0.8 mm. A pressing contact portion 210*b* having a slot 210*a* is provided at a lower end of the pressing contact terminal 210 and the slot 210*a* is thrust into an insulating coating 212*a* of the wire 212 so as to be brought into contact with a conductor 212*b* of the wire 212. The slot 210*a* is formed by cutting into a widthwise central portion of a lower end of the pressing contact terminal 210 and includes a pair of outwardly oblique chamfered portions 210*a*-1 formed at opposed lower edges of the slot 210*a*, opposed straight portions 210*a*-2 extending upwardly continuously from the chamfered portions 210*a*-1 and a circular portion 210*a*-3 formed at an upper end of the straight portions 210*a*-2. An interval S (FIG. 51) between the straight portions 210*a*-2 is set so as to be not more than a diameter of the conductor 212*b* of the wire 212. Furthermore, a diameter of the circular portion 210*a*-3 is set so as to be approximately equal to that of the conductor 212*b*.

When the straight portions 210*a*-2 of the slot 210*a* pass through the wire 212 during pressing contact of the pressing contact terminal 210 with the wire 212, not only the straight portions 210*a*-2 are thrust into the insulating coating 212*a* such that the conductor 212*b* is held in the circuit portion 210*a*-3 but an outer peripheral surface of the conductor 212*b* and a peripheral surface of the circular portion 210*a*-3 are brought into contact with each other such that the pressing contact terminal 210 is electrically connected to the wire 212. An upper end of the pressing contact terminal 210, which extends upwardly rectilinearly from the pressing contact portion 210*b*, is bent downwardly towards the pressing contact portion 210*b* so as to form a U-shaped portion 210*c*.

A slot 210*d* is formed on the U-shaped portion 210*c* by cutting into a widthwise central portion of an upper end of the U-shaped portion 210*c* from a bent leg of the U-shaped portion 210*c* to a straight leg of the U-shaped portion 210*c* and extends over a predetermined length from the upper end of the U-shaped portion 210*c* so as to form a female terminal portion 210*e*. A width of the slot 210*d* is set so as to be equal to or slightly smaller than a thickness of a male terminal 213*a* of the fuse 213 such that the male terminal 213*a* of the fuse 213 is press fitted into the slot 210*d* from above. The slot 210*d* has a pair of circular portions 210*d*-1 formed at its opposite ends, respectively such that a load applied to end faces of the slot 210*d* by the male terminal 213*a* press fitted into the slot 210*d* does not produce cracks, etc. on the end faces of the slot 210*d*. Thus, since not only the pressing contact portion 210*b* is provided at one end of the pressing contact terminal 210 so as to be connected to the wire 212 through pressing contact but the female terminal portion 210*e* is provided at the other end of the pressing contact terminal 210 such that the male terminal 213*a* of the fuse 213 is directly fitted into the slot 210*d* of the male terminal portion 210*e*, a height T of the electrical connection box K14 can be reduced.

In the electrical connection box K14, since the female terminal portion is provided at one end of the pressing contact terminal opposite to the pressing contact portion, the pressing contact terminal can be directly connected to the platelike male terminal of a relay, a fuse, etc. Meanwhile, since the U-shaped female terminal portion is obtained by bending the flat plate and the slot extends from the upper end of the female terminal portion to the two legs of the female terminal portion, the pressing contact terminal has such a sufficient strength as to positively hold the male terminal of a relay, a fuse, etc.

Furthermore, if a pair of the circular portions are, respectively, provided at the opposite ends of the slot of the female terminal portion, the load applied to the distal ends of the slot by the male terminal press fitted into the slot can be lessened and thus, cracks, etc. at the distal ends of the slot can be prevented.

Moreover, since the platelike male terminal of a relay, a fuse, etc. can be directly connected to the pressing contact terminal brought into pressing contact with the wire laid in the electrical connection box K14, a hitherto necessary relay terminal is not required to be provided, so that height of the electrical connection box K14 can be reduced accordingly and thus, the electrical connection box K14 can be made compact in size. In addition, since the number of the components of the electrical connection box is reduced and the number of operational steps can be reduced, production cost of the electrical connection box K14 can be lowered.

Figure 54:
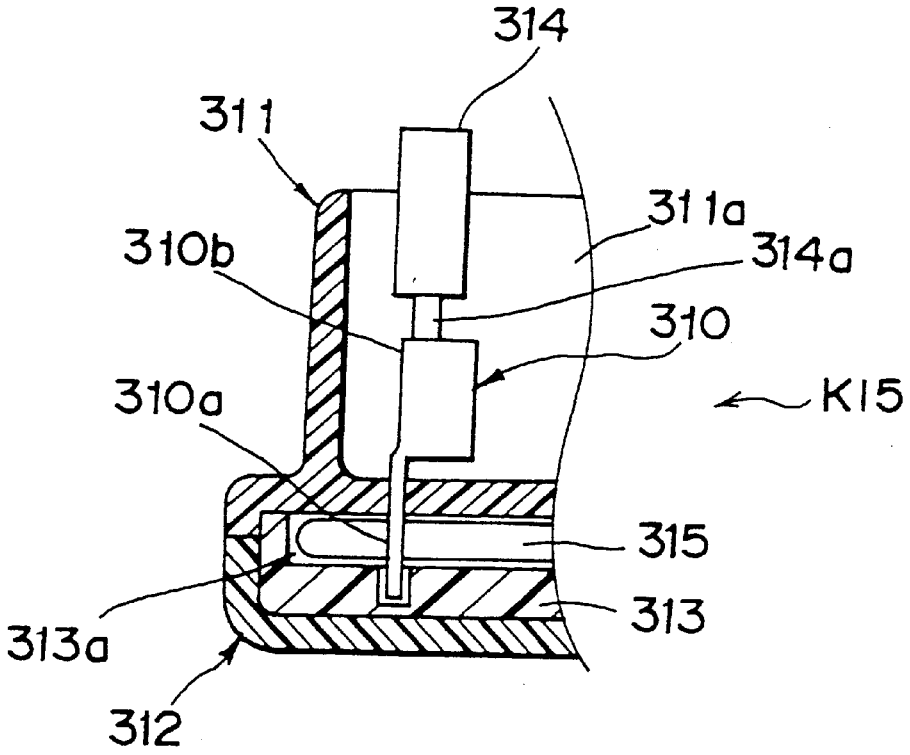
FIG. 54 is a fragmentary sectional view of an electrical connection box according to a fifteenth embodiment of the present invention.

FIG. 54 shows an electrical connection box K15 according to a fifteenth embodiment of the present invention. The electrical connection box K15 includes an upper casing 311, a lower casing 312, an insulating plate 313 provided in the electrical connection box K15 and a pressing contact terminal 310. A large-diameter wire 315 laid in a wiring groove 313*a* of the insulating plate 313 and a fuse 314 attached to a fuse receiver 311*a* provided on an outer surface of the upper casing 311 are directly connected to each other by the pressing contact terminal 310 without using a hitherto necessary relay terminal. A power source circuit of an internal circuit of the electrical connection box K15 is constituted by the pressing contact terminal 310 and the large-diameter wire 315.

Figure 55:
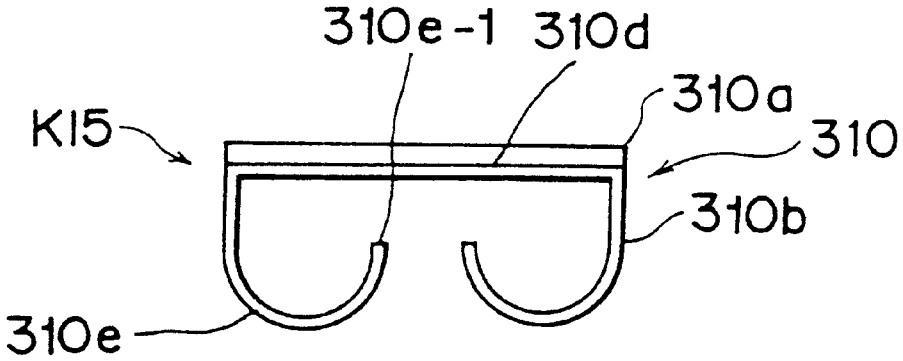
FIGS. 55 and 56 are a top plan view and a front elevational view of a pressing contact terminal of the electrical connection box of FIG. 54, respectively.
Figure 56:
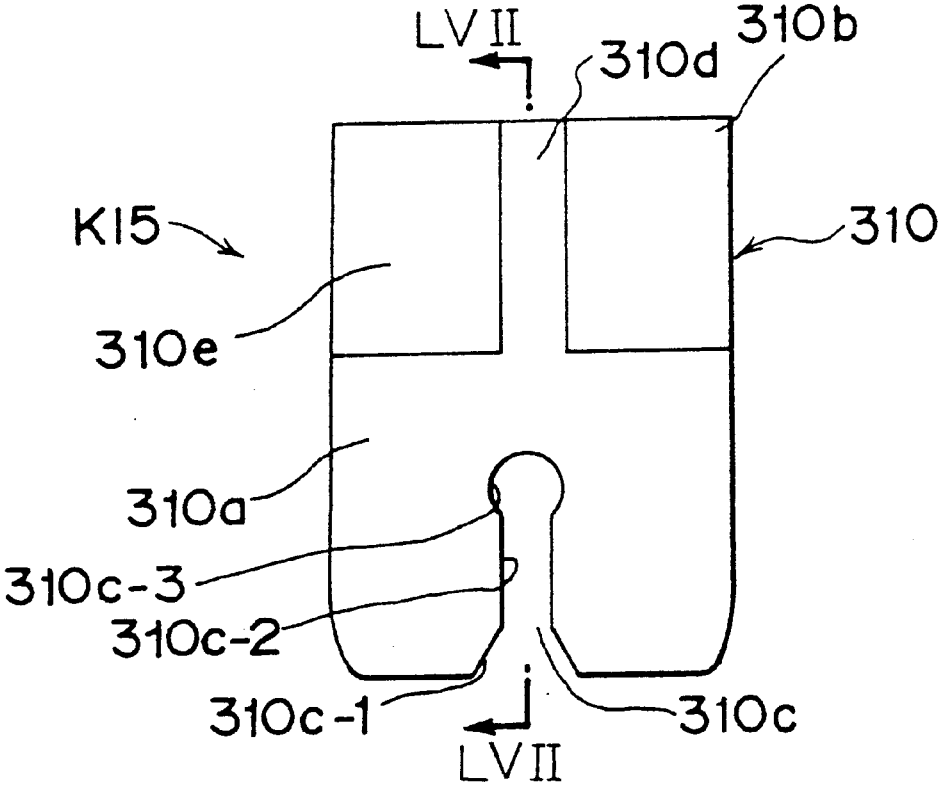
Figure 57:
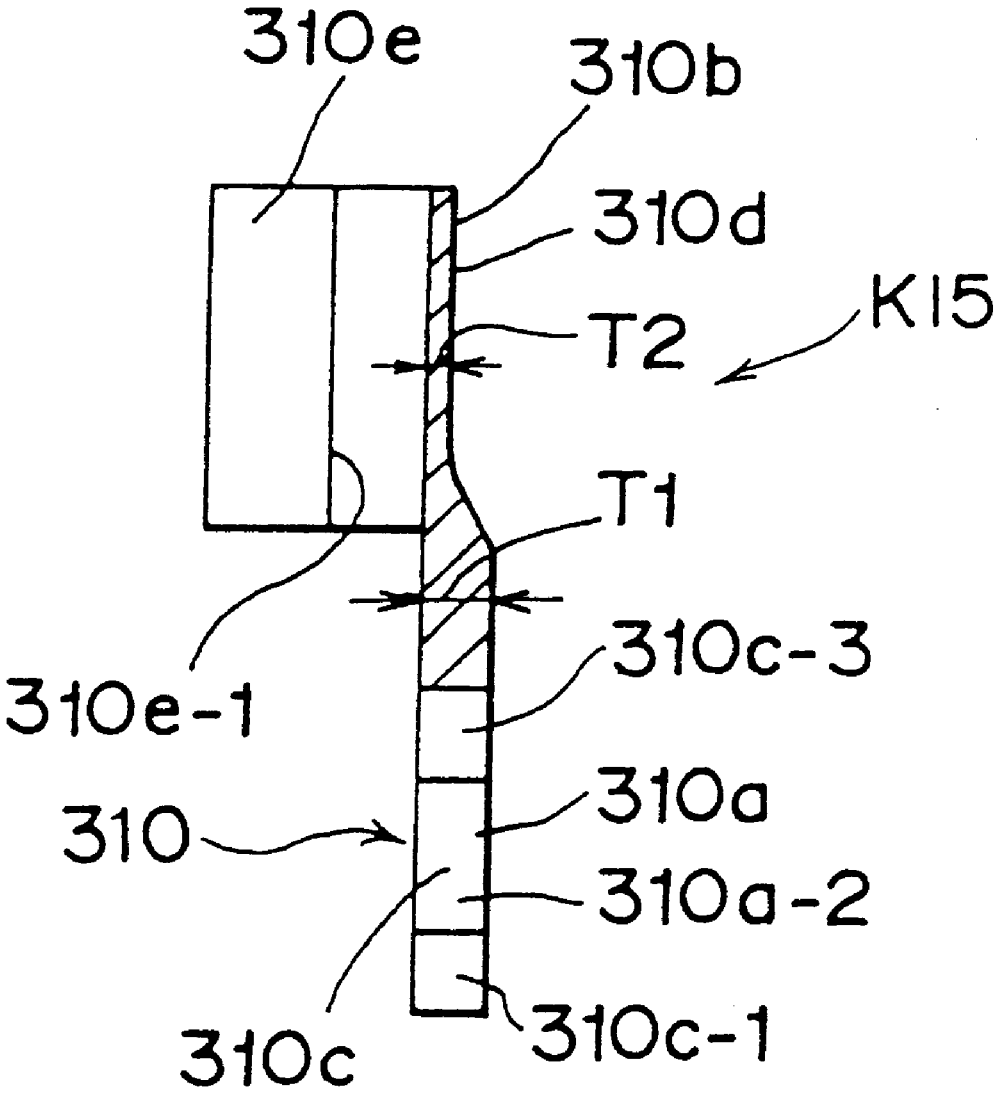
FIG. 57 is a sectional view taken along the line LVII—LVII in FIG. 56.

As shown in FIGS. 55 to 57, in the pressing contact terminal 310, a female type input-output terminal portion 310*b* extends continuously upwardly from a pressing contact portion 310*a*. The pressing contact terminal 310 is formed by blanking an electrically conductive metal plate and then, bending the metal plate as shown in FIGS. 55 to 57. The pressing contact portion 310*a* has a large thickness and a downwardly opening slot 310*c* is formed at a lower end of the pressing contact portion 310*a*. The slot 310*c* is thrust into an insulating coating 315*a* of the wire 315 so as to be connected to a conductor 315*b* of the wire 315.

The slot 310*c* is formed by cutting into a widthwise central portion of the lower end of pressing contact portion 310*a* and includes a pair of outwardly oblique chamfered portions 310*c*-1 formed at opposed lower edges of the slot 310*c*, opposed straight portions 310*c*-2 extending upwardly continuously from the chamfered portions 310*c*-1 and a circular portion 310*c*-3 formed at an upper end of the straight portions 310*c*-2. An interval between the straight portions 310*c*-2 is set so as to be not more than a diameter of the conductor 315*b* of the wire 315, while a diameter of the circular portion 310*c*-3 is set so as to be approximately equal to that of the conductor 315*b*.

The input-output terminal portion 310*b* is of female type including a base plate portion 310*d* and a pair of curled portions 310*e*, provided at opposite sides of the base plate portion 310*d* such that a platelike male terminal 314*a* of a fuse 314 is gripped between the curled portions 310*e* along the base plate portion 310d. As shown in FIG. 57, a thickness T2 of the input-output terminal portion 310*b* is about a half of a thickness T1 of the pressing contact portion 310*a*. The base plate portion 310*d* extends upwardly from an upper end of the pressing contact portion 310*a* and the curled portions 310*e* are curved laterally inwardly towards each other from the opposite sides of the base plate portion 310*d*. The curled portions 310*e* have elasticity and a gap between a distal end 310*e*-1 of each of the curled portions 310*e* and the base plate portion 310*d* is set so as to be smaller than a thickness of the male terminal 314*a* of the fuse 314. An intermediate portion of the pressing contact terminal 310, which connects the pressing contact portion 310*a* and the base plate portion 310*d*, is formed so as to gradually become thinner towards its upper end. In this embodiment, the thickness T1 of the pressing contact portion 310*a* is set at 8 mm, while the thickness T2 of the input-output terminal portion 310*b*, i.e., the base plate portion 310*d* and the curled portions 310*e* is set at 4 mm.

Figure 1:
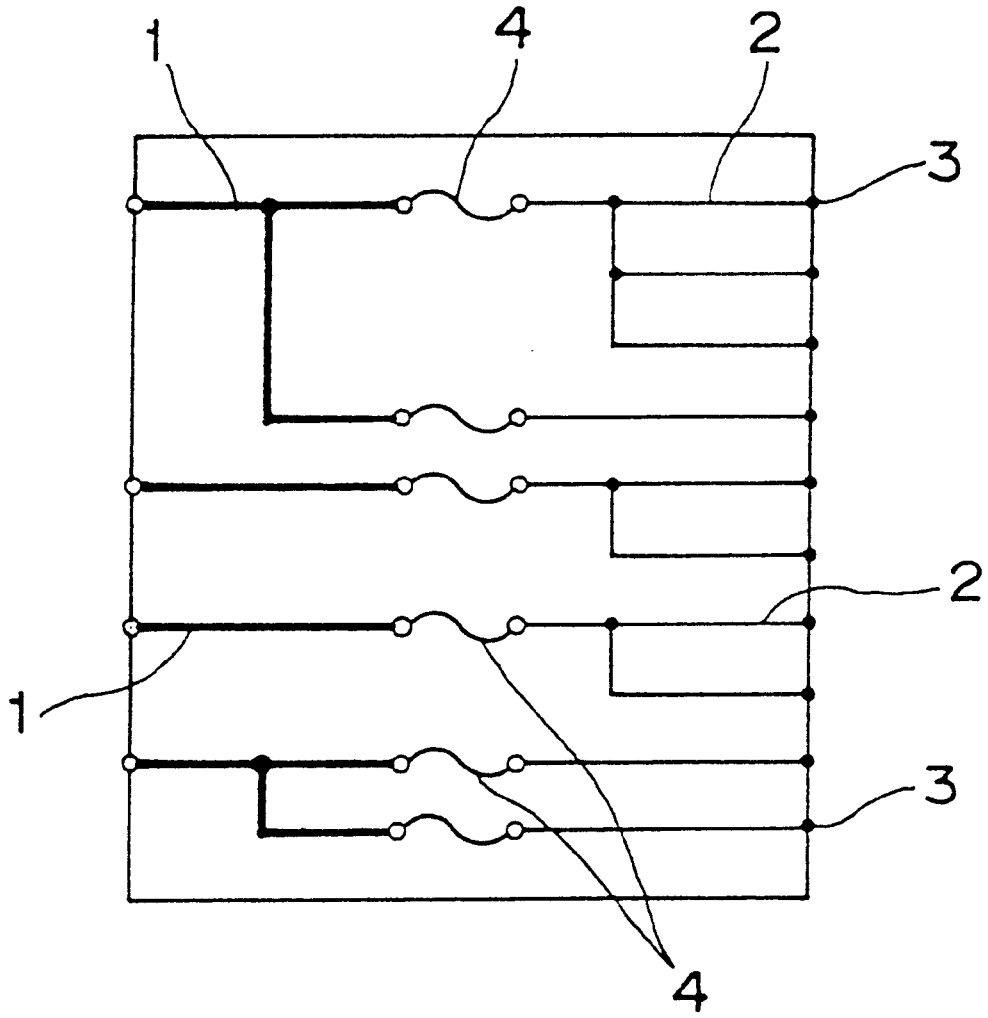
Fig. 1 PRIOR ART
FIG. 1 is a circuit diagram of an internal circuit of a prior art electrical connection box (already referred to)
Figure 2A:
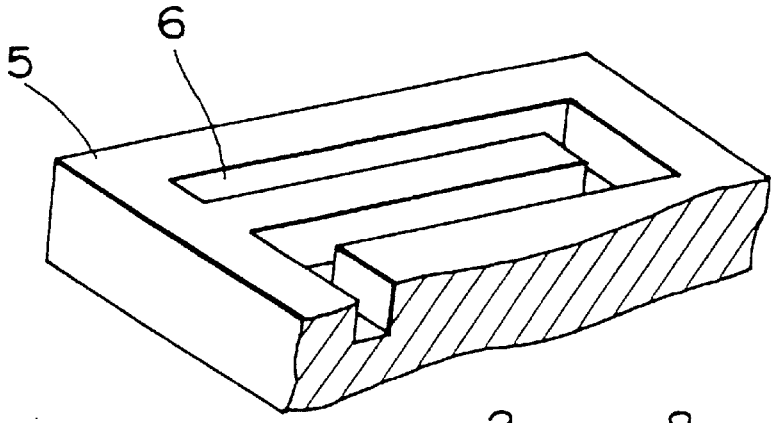
Fig. 2A PRIOR ART
FIG. 2A is a fragmentary perspective view of a wiring die used in a prior art wiring method (already referred to)
Figure 2B:
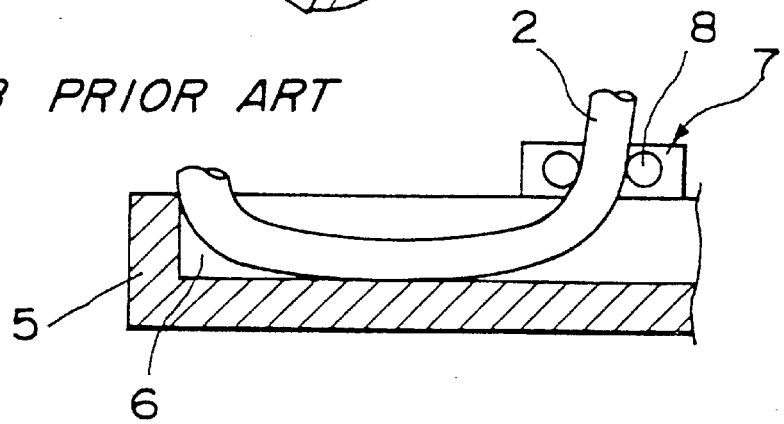
Fig. 2B PRIOR ART
FIG. 2B is a schematic sectional view indicative of a wire laid in the wiring die of FIG. 2A (already referred to)
Figure 3:
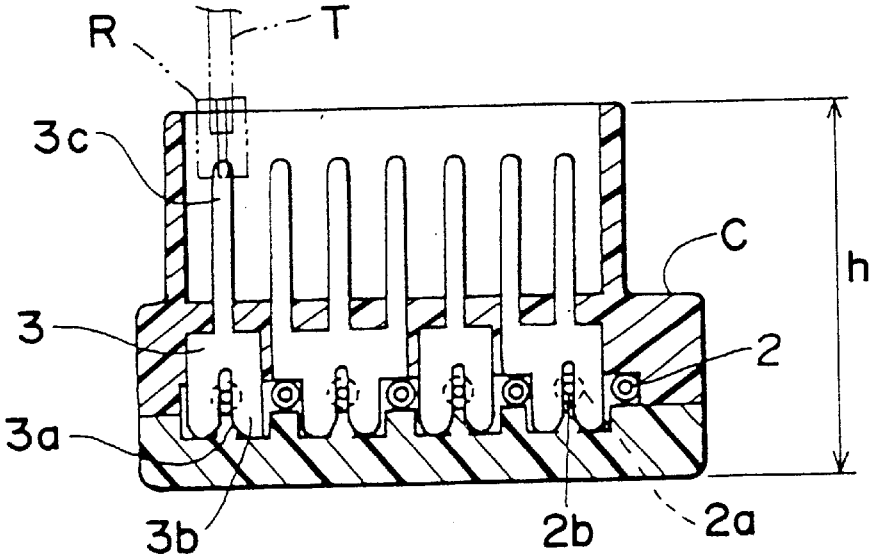
Fig. 3 PRIOR ART
FIG. 3 is a sectional view of a prior art electrical connection box (already referred to)
Figure 4:
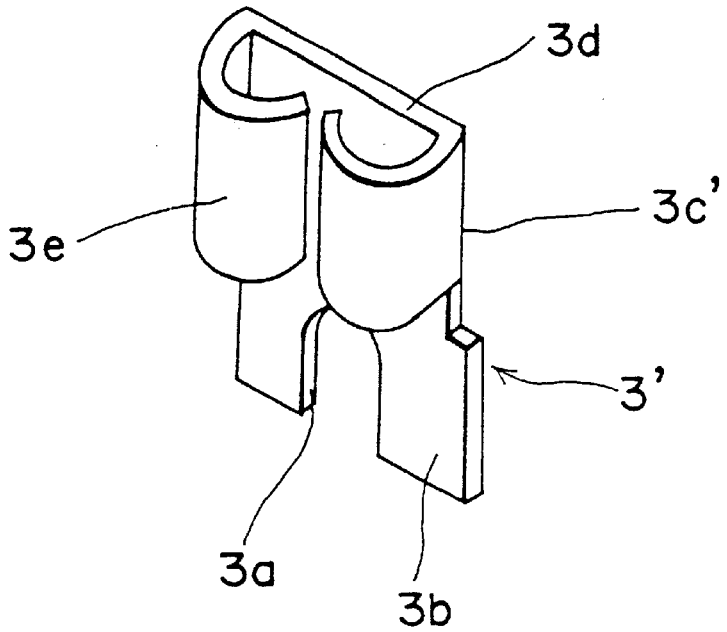
Fig. 4 PRIOR ART
FIG. 4 is a perspective view showing a modification of a pressing contact terminal used in the prior art electrical connection box of FIG. 3 (already referred to)
Figure 8:
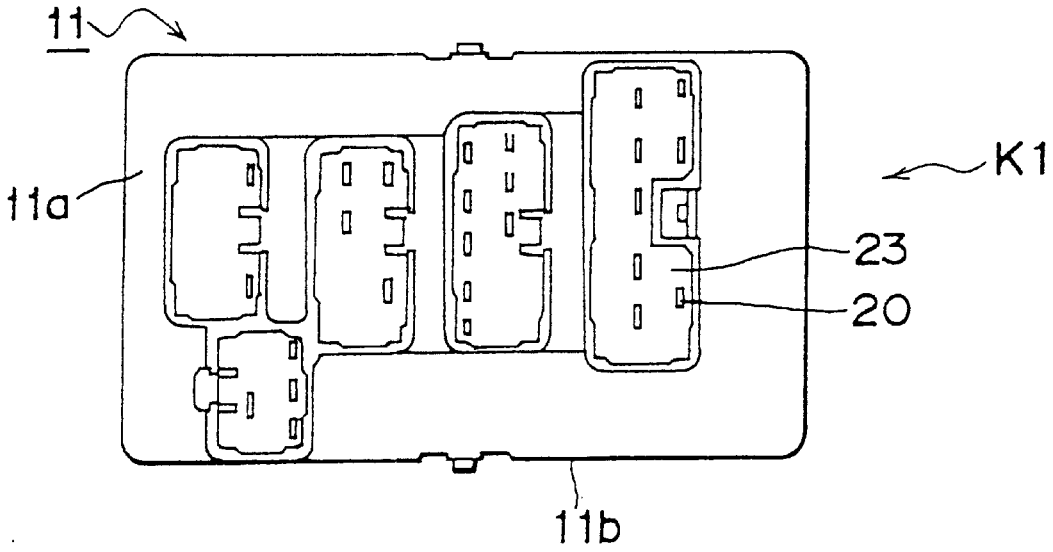
FIG. 8 is a bottom plan view of a lower casing of the electrical connection box of FIG. 5.

A small-diameter wire (not shown) is used for a load circuit of the internal circuit of the electrical connection box K15. In case a connector to be connected to the load circuit of the electrical connection box K15 has a female terminal, a pressing contact terminal similar to a known pressing contact terminal 3 shown in FIG. 3 is employed. Meanwhile, in case a connector to be connected to the load circuit of the electrical connection box K15 has a male terminal, a pressing contact terminal similar to a prior art pressing contact terminal 3' having uniform thickness and including a pair of curled portions 3*e* as shown in FIG. 4 is employed such that the small-diameter wire and the male terminal are directly connected to each other without using a relay terminal in the same manner as the power source circuit of the internal circuit of the electrical connection box K15.

In the electrical connection box K15, the large-diameter wire 315 is preliminarily laid in the wiring groove 313*a* of the insulating plate 313 to be accommodated in the electrical connection box K15 and the pressing contact terminal X10 is attached to the upper casing 311 relative to the wire 315. In this state, the upper casing 311 and the lower casing 312 are mounted on the insulating plate 313 such that the pressing contact portion 310*a* of the pressing contact terminal 310 is connected to the wire 315 through pressing contact simultaneously with mounting of the upper casing 311 and the lower casing 312 on the insulating plate 313.

Figure 59:
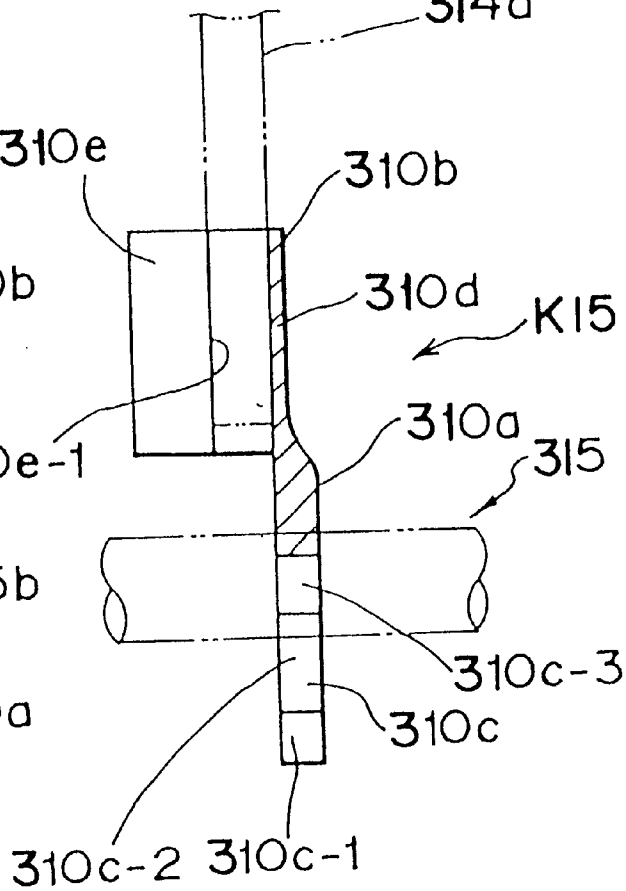
FIGS. 58 and 59 are a front elevational view and a sectional view showing connection of the pressing contact terminal of FIG. 55 to a male terminal of a fuse and a wire, respectively.
Figure 58:
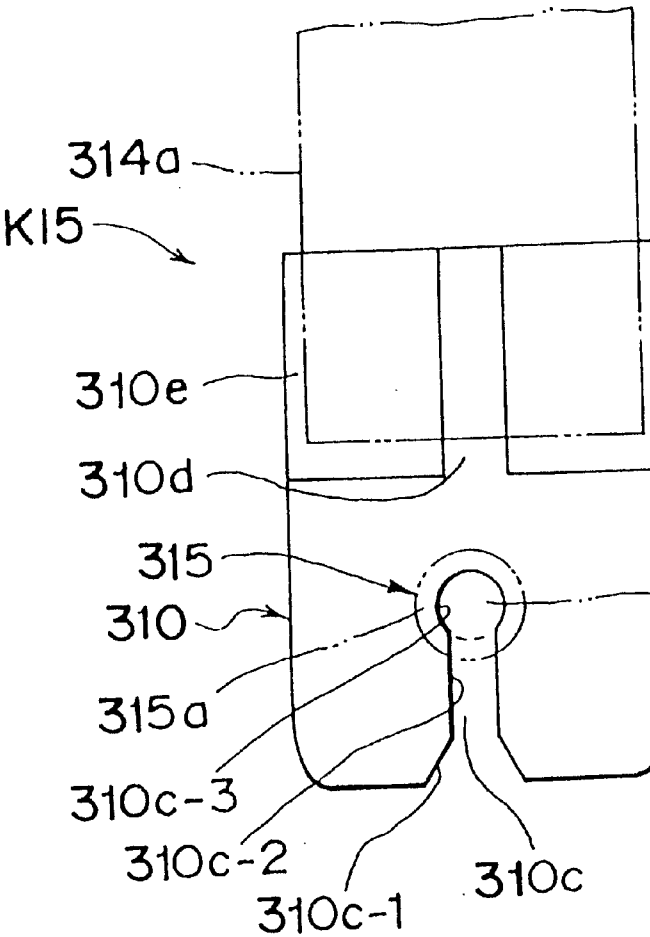

Since the thickness T2 of the pressing contact portion 310*a* of the pressing contact terminal 310 is made large, the straight portions 310*c*-2 of the slot 310*c* of the pressing contact terminal 310 is positively thrust into the insulating coating 315*a* of the wire 315 when passing through the wire 315 during pressing contact of the pressing contact terminal 310 with the wire 315. Therefore, as shown in FIGS. 58 and 59, the conductor 315*b* of the wire 315 is held by the circular portion 310*c*-3 of the slot 310*c* and the outer peripheral surface of the conductor 315*b* of the wire 315 and the peripheral surface of the circular portion 310*c*-3 are brought into contact with each other such that the pressing contact terminal 310 and the wire 315 are electrically connected to each other positively.

Meanwhile, in a state where the upper casing 311 and the lower casing 312 have been assembled with each other, the female type input-output terminal portion 310*b* of the pressing contact portion 310 is projected into the fuse receiver 311*a* provided on the outer surface of the upper casing 311 so as to be directly connected to the male terminal 314*a* of the fuse 314. Namely, by press fitting the male terminal 314*a* of the fuse 314 in between the curled portions 310*e* and the base plate portion 310*d* of the pressing contact terminal 310, the curled portions 310*e* are depressed outwardly from the base plate portion 310*d* so as to expand the gap between the curled portions 310*e* and the base plate portion 310*d* such that the curled portions 310*e* of the pressing contact terminal 310 are connected to the male terminal 314*a* of the fuse 314 through pressing contact.

Since the pressing contact terminal 310 has the thick pressing contact portion 310*a*, the pressing contact portion 310*a* is thrust into the insulating coating 315*a* of even the large-diameter wire 315 so as to be positively connected to the conductor 315*b*. Furthermore, since the thickness T1 of the input-output terminal portion 310*b* of the pressing contact terminal 310 is made small, the curled portions 310*e* can be provided at the input-output terminal portion 310*b* so as to form the input-output terminal portion 310*b* into female type. Accordingly, the pressing contact portion 310 can be directly connected to the fuse 314 without using a hitherto necessary relay terminal.

In the electrical connection box K15, since the pressing contact terminal has nonuniform thickness such that the thickness of the input-output terminal portion is made smaller than that of the pressing contact portion, the curled portions can be provided at the input-output terminal portion, so that the female type input-output terminal portion constituted by the base plate portion and the curled portions and thus, the pressing contact terminal can be connected to the platelike male terminal without using a relay terminal. On the other hand, since the thickness of the pressing contact portion of the pressing contact terminal is made large, the pressing contact terminal can be used for the large-diameter wire and thus, can be electrically connected to the large-diameter wire positively.

Furthermore, in the electrical connection box K15, since the platelike male terminal of a fuse, a relay, etc. can be directly connected to the female input-output terminal portion of the pressing contact terminal, a hitherto necessary relay terminal is not required to be used. Therefore, such a conventional problem can be eliminated that since height of connection between the male terminal of the fuse, the relay, etc. and the input-output terminal portion of the pressing contact terminal is increased by using the relay terminal, the electrical connection box is made large in size.

What is claimed is:

1. An electrical connection box comprising:

a casing including an upper casing and a lower casing, and a plurality of terminal holes formed on its outer wall;

an insulating plate mounted in the casing having a plurality of wiring grooves formed on both of its opposite faces;

a plurality of terminal driving portions, each obtained by increasing a width of each of the wiring grooves, provided at predetermined locations of each of the wiring grooves;

a plurality of wires, including first and second diameter wires having first and second diameters, respectively, said first diameter being smaller than said second diameter, inserted into and held in the wiring grooves;

a plurality of pressing contact terminals, including first and second pressing contact terminals having first and second lengths, respectively, said first length being shorter than said second length, and each of which includes a pressing contact portion and an input-output terminal portion formed at its opposite ends, respectively;

the pressing contact portion being driven into said insulating plate into each of the terminal driving portions to connect, through pressing contact, to each of the wires held in the wiring grooves, such that said terminals having said first and second lengths engage said wires having said first and second diameters, respectively, while the input-output terminal portions project out of each of the terminal holes, from both opposite faces of the insulating plate, to connect to an external circuit;

wherein each of the pressing contact terminals is formed by an electrically conductive metal plate;

wherein a slot is formed at the pressing contact portion of each of the pressing contact terminals and is thrust into an insulating coating of each of the wires so as to be connected to a conductor of each of the wires; and wherein a pair of notches are, respectively, formed on opposite outer sides of the pressing contact portion such that edges of the notches are expanded outwardly at the time of pressing contact of the pressing contact terminals with the wires and bite into opposed side faces of each of the wiring groves of the insulating plate.

2. An electrical connection box as claimed in claim 1, wherein a pair of positioning ribs are, respectively, projected from opposite sides of an upper end of the pressing contact portion and are, respectively, brought into engagement with a pair of positioning recesses formed at each of the terminal driving portions of the insulating plate.

* * * * *

UNITED STATES PATENT AND TRADEMARK OFFICE

CERTIFICATE OF CORRECTION

PATENT NO. : 6,168,456 B1
DATED : January 2, 2001
INVENTOR(S) : Y. Saka et al.

It is certified that error appears in the above-identified patent and that said Letters Patent is hereby corrected as shown below:

Title page,
Item [30], Foreign Application Priority Data, line 5, should be -- Jul. 27, 1994 --.
Item [30], Foreign Application Priority Data, line 8, should be -- Jul. 22, 1994 --.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*